7/1/86 OR 4,597,487

United States Patent [19]

Crosby et al.

[11] Patent Number: 4,597,487

[45] Date of Patent: Jul. 1, 1986

[54] METHOD AND APPARATUS FOR SELECTIVE SCRAP METAL COLLECTIONS

[75] Inventors: Kennith D. Crosby; William J. Tuten, both of Scottsdale; Harold W. Black; Bertil R. Bergquist, both of Mesa, all of Ariz.

[73] Assignee: Creative Technology, Inc., Scottsdale, Ariz.

[21] Appl. No.: 518,148

[22] Filed: Jul. 28, 1983

[51] Int. Cl.[4] ..... G07F 1/06

[52] U.S. Cl. ..... 194/209; 194/213; 209/930; 406/65

[58] Field of Search ..... 194/4 R, 4 B, 4 C, 4 D, 194/4 E, 4 F, 4 G, 1 N; 209/930; 406/63, 65, 68; 340/531, 533

[56] References Cited

U.S. PATENT DOCUMENTS

| | | | |
|---|---|---|---|
| 4,032,907 | 6/1977 | Young | 340/533 X |
| 4,058,227 | 11/1977 | Shakshober et al. | 406/65 |
| 4,179,018 | 12/1979 | Miller | 194/4 R |
| 4,241,821 | 12/1980 | Wu et al. | 194/4 C |
| 4,454,028 | 6/1984 | Vetter et al. | 194/4 C X |
| 4,463,844 | 8/1984 | Huffman et al. | 194/4 C |

*Primary Examiner*—Joseph J. Rolla

*Attorney, Agent, or Firm*—Harry M. Weiss & Associates

[57] ABSTRACT

An unattended apparatus for collecting aluminum cans and for compensating depositors of said aluminum cans based on the weight of the aluminum cans deposited, including a microprocessor-based control system which controls the energization of various system components, monitors system data, monitors alarm signals, operates a display, controls the weighing cycle, controls the compensation cycle, and the like. The apparatus includes a heavys detector which measures the weight of an incoming object as a function of the displacement of the platform it strikes. A second metal detector is used to separate non-ferrous metals from non-metals. A trapdoor is provided for dropping out non-metals and heavys and closed to pass aluminum cans to the input of the crusher hopper. The conveyors of the system operate continuously to improve system throughput, and when a transaction is complete or the bucket must be weighed, the crusher is stopped to prevent additional cans from falling into the weighing bucket, but the conveyors continue to operate and store cans at the crusher input hopper. An improved weight bucket door, an improved auto-calibration system, an improved apparatus for suspending the bucket, and an improved universal joint providing a connection between the load cell and a device suspending the bucket, all contribute to improved system accuracy in weighing the aluminum cans. A coin dispensor, monitored by a display, dispenses coins as aluminum cans are added with a final compensation for total weight to the nearest penny. A storage bin is provided for easy removal of contents.

116 Claims, 50 Drawing Figures

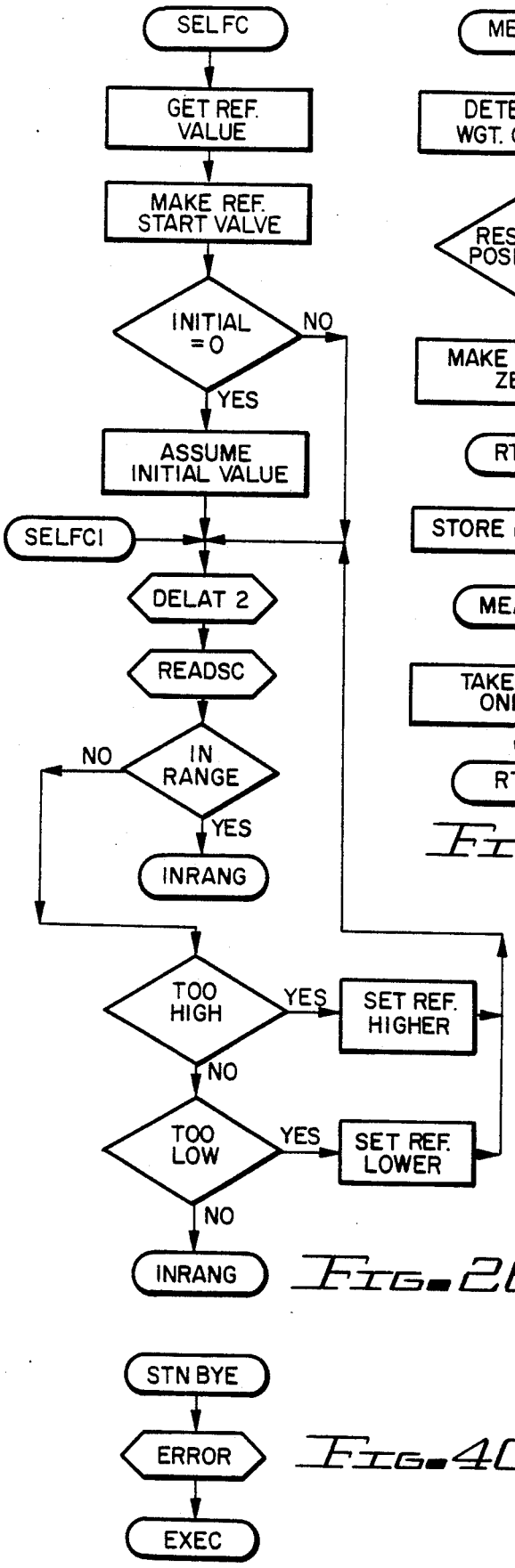
FIG. 26
FIG. 40
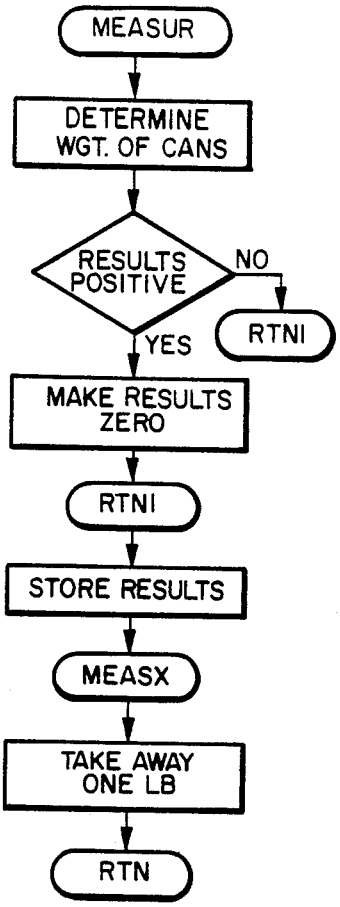
FIG. 29
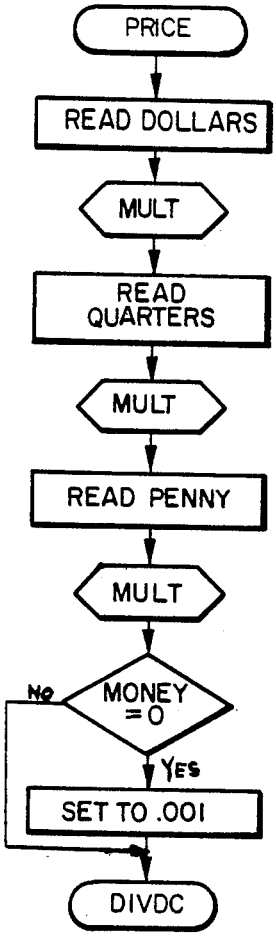
FIG. 28
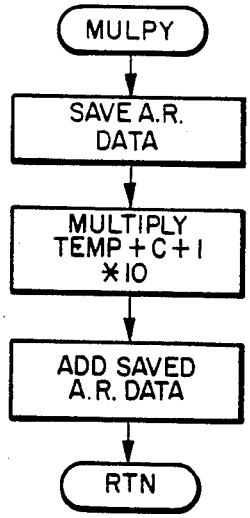
FIG. 43

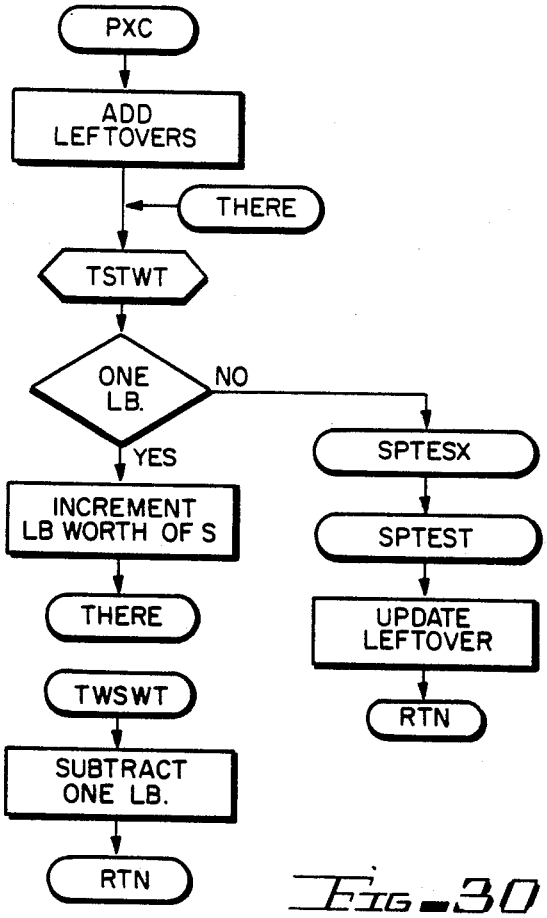
FIG. 30
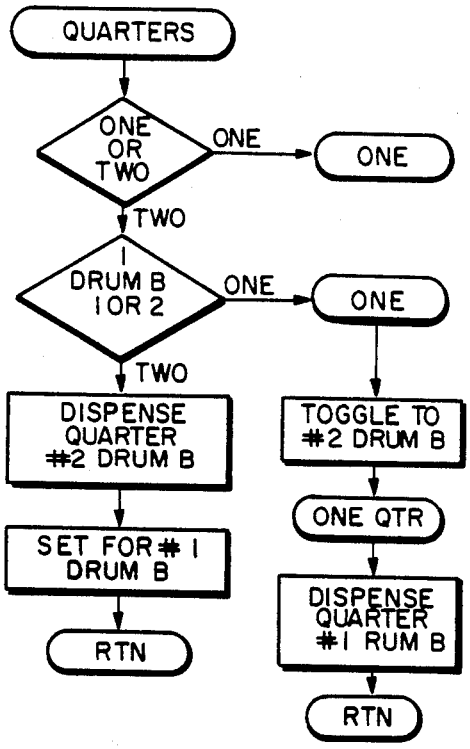
FIG. 31
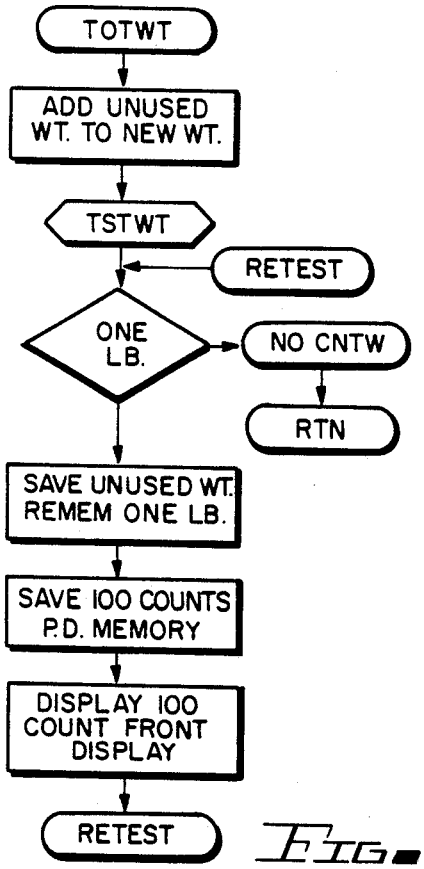
FIG. 32
FIG. 41
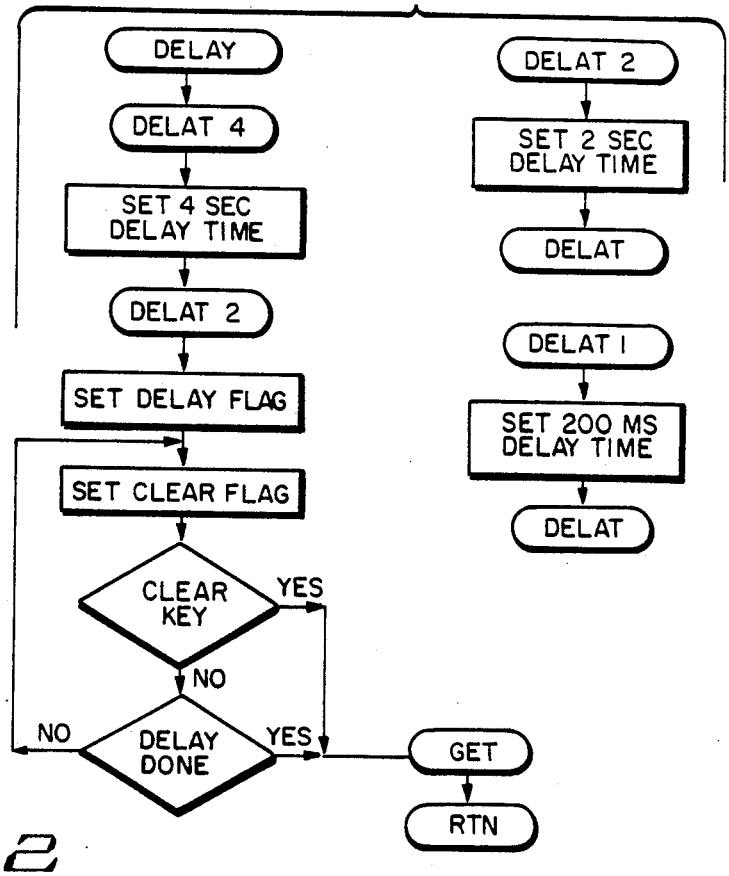

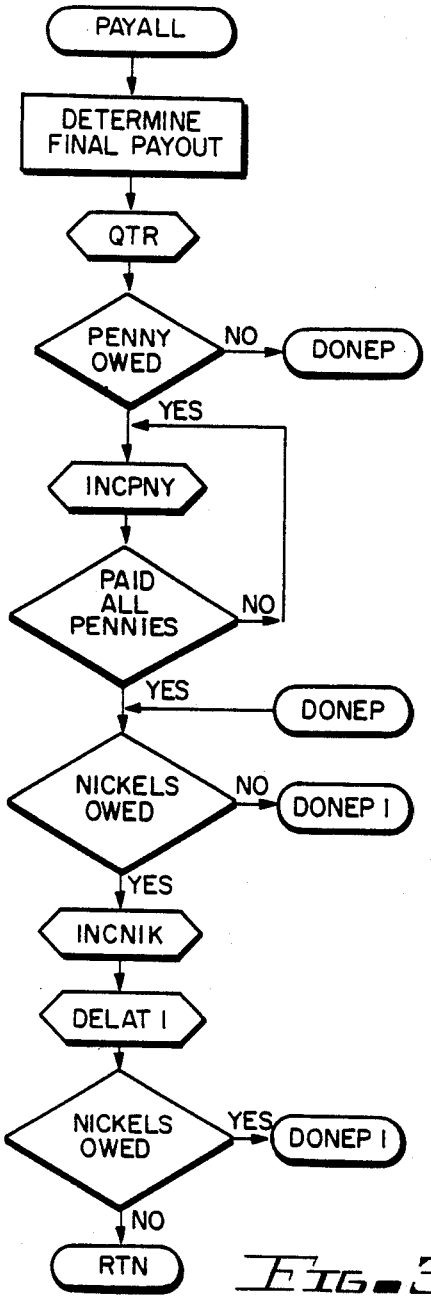
FIG-33
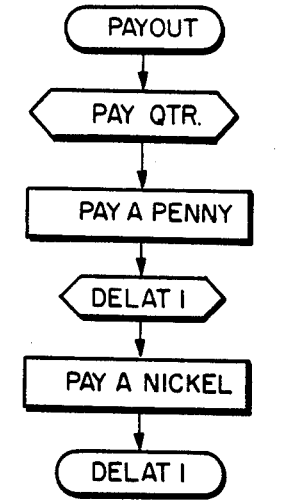
FIG-34
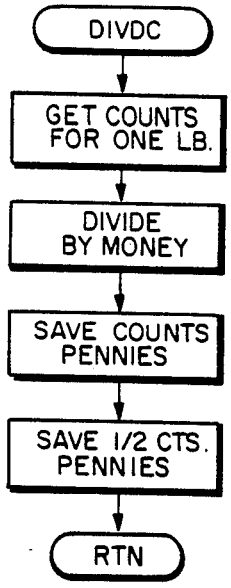
FIG-35
FIG-44
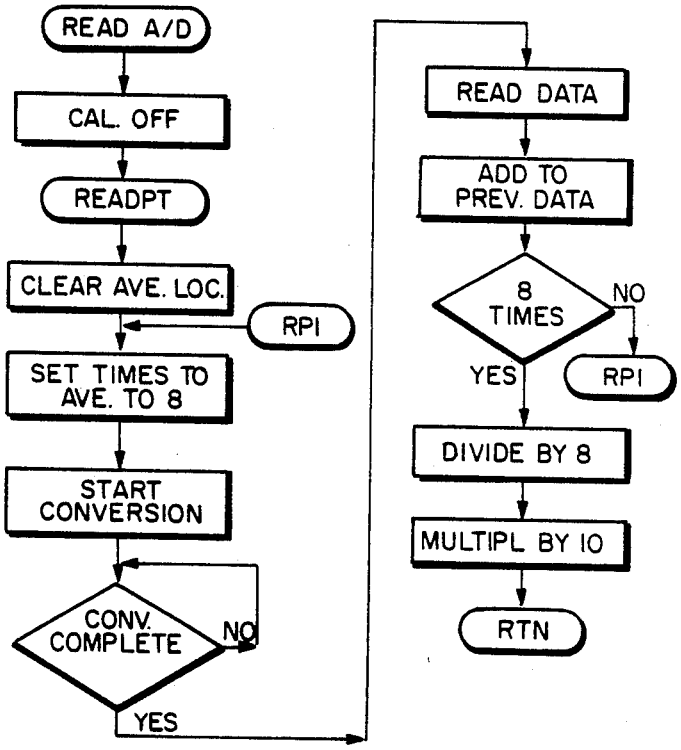
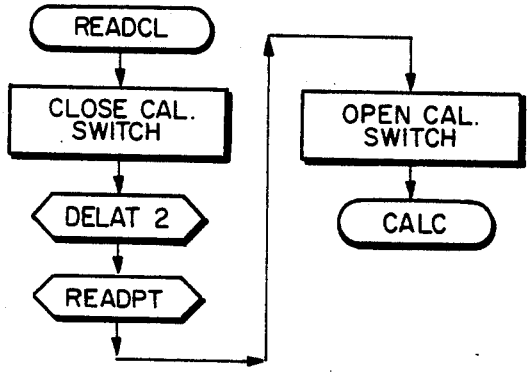
FIG-42
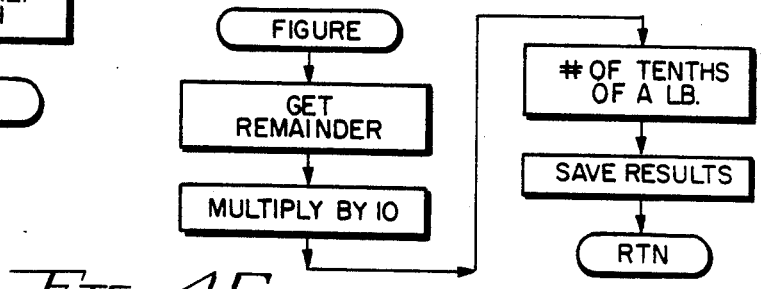
FIG-45

METHOD AND APPARATUS FOR SELECTIVE SCRAP METAL COLLECTIONS

BACKGROUND OF THE INVENTION

1. Field of the Invention

This invention relates generally to a method and apparatus for selectively recovering or collecting scrap metal of a given type. More particularly, the present invention relates to a method and apparatus for segregating metal containers of a certain type such as aluminum containers or cans and for compensating depositors of such scrap metal based on the weight of the scrap metal of a given type so collected.

2. Description of the Prior Art

Non-reusable, non-returnable metal containers or cans of various types are currently used to package many different types of foods and beverages and have become part of the American way of life. Many products, particularly soft drinks and malt cereal beverages, are provided to the consumer in metal cans. Aluminum cans or containers provide particular advantages because of the relatively light weight of aluminum. Aluminum's resistance to corrosion and food contamination is also an important characteristic, as is the fact that aluminum leaves no "tinny" taste. A further advantage of aluminum is that alumuninum cans or lids can be provided with tear tabs, press tabs or pop tops making them even more convenient for use by the consumer and eliminating the need for can openers and the like.

With the rapid increase in the use of non-reusable, nonreturnable metal containers, the problem of littering has become quite serious as anyone driving down most of American's highways can attest. Unfortunately, many consumers carelessly discard metal cans, blighting the countryside, spoiling the scenery and costing governments large sums of money for clean-up and the like. Consumer groups, beverage industry groups, governmental groups and others have attempted to meet this problem by establishing recycling centers which compensate individuals for aluminum containers brought back to the recycling center. The returned aluminum cans can be recovered and refabricated into new cans thus reducing litter, saving energy spent in refining aluminum ore, and conserving aluminum metal as a natural resource. However, even the establishment of recycling centers has not completely alleviated the problem as many people still carelessly throw away or discard used containers.

Part of the problem lay in the fact that is was often necessary for the consumer to collect or save the cans for a long period of time before returning them to the recycling center. Since the price paid at the recycling center did not always compensate the driver for the cost of the drive unless a large number of cans were saved, saving or storing the cans between trips to the recycling center often became messy and sloppy as some liquid always managed to remain in the cans and somehow leaked through the storage bags, boxes or the like drawing flies and other insects, as well as causing an unsightly mess, stains, sticky spots, and the like.

Further attempts were made at having a return center closer to the consumer, and many grocery stores began accepting aluminum cans. However, the grocery stores ran into the same problems of leakage, storage space, mess, and man power required to implement the system, and hence the price paid for the recycled aluminum cans was less than it would otherwise have been.

Therefore, a need existed for a method and apparatus for receiving and processing metal containers and particularly aluminum cans which would be convenient to the consumer and provide the necessary incentives so that the consumers would be encouraged to collect and return empty containers in any given amount. Preferably, such apparatus would be located throughout the community at convenient locations, such as parking lots and shopping malls and the like, and would operate unattended to reduce cost and enable the collection apparatus or facility to pay fair compensation for aluminum containers and the like.

The first significant attempt to solve the problem is disclosed in U.S. Pat. No. Re. 27,643 issued to Joseph D. Myers. This patent discloses a method and apparatus for the collection of metal containers, apparatus which automatically dispenses tokens for each non-magnetic container stored. The system, while effective, does not separate selected aluminum containers from general refuse, and trash and extraneous material can cause the machine to jam and completely stop. Further, compensation or tokens are dispensed in response to a count of non-magnetic containers rather than in relation to the weight of the selected metal recovered by the apparatus. There are many disadvantages to this type of approach.

The next step in the evolution of systems for selectively collecting scrap metal are best represented by U.S. Pat. Nos. 4,179,018 and 4,257,511 which issued to John H. Miller. These patents disclose a method and apparatus in which non-returnable aluminum cans such as are used to package soft drinks and malt cereal beverages are segregated from other material such as tin-plated steel cans that may be deposited in the apparatus. A start button or switch is pushed by the depositor to start the operation of the apparatus and the deposited materials are conveyed by a conveyor belt to a magnetic separation portion of the apparatus to separate magnetic, ferrous materials such as tin-plated steel cans from the non-magnetic material and store the ferrous materials in a storage bin. However, non-magnetic materials are collected at the bottom of a pneumatic classifier conveyor which transports the aluminum, non-ferrous metal containers to a crusher. The materials so transported are crushed and weighed. After weighing, the crushed aluminum cans are conveyed by a pneumatic stacker conveyor and deposited into an inclined storage location at the top of the apparatus.

The apparatus of Miller is provided with a compensation dispenser which dispenses or disperses coins, tokens and other symbols of value, the amount of which is determined by the weight of the non-ferrous materials that pass through the crusher and are weighed by the weighing means during operation of the collection apparatus. This type of apparatus is designed to be used in an unattended mode and is frequently placed in parking lots or shopping centers, shopping malls, and the like where it is easy for persons, customers and consumers who patronize the retail stores to dispose of their collected aluminum cans while being paid therefor.

The recovered aluminum from this source saves energy and raw materials, while simultaneously reducing the problems associated with the disposing of such cans after their contents have been consumed and greatly alleviating the litter problem. While the present price of tin-plated steel cans makes it almost impossible to compensate for them, their collection is of some intrinsic value insofar as cleaning up the environment is concerned. Notwithstanding, a depositor is notified that he will not be compensated for a tin-plated steel can, at least at the present time.

The next step in the evolution of selective scrap metal collection systems is set forth in application Ser. No. 211,739 filed Dec. 1, 1980, now U.S. Pat. No. 4,402,391, by the present inventors which describes an improved method and apparatus for metal collection and particularly for collecting selective metals such as aluminum. The apparatus includes means for performing diagnostics through the use of a smart digital controller. The teachings of this application are hereby incorporated by reference herein. Unfortunately, the apparatus disclosed therein had several drawbacks. First, field results have indicated that the apparatus does not adequately weigh the deposited material under all conditions. It is been shown that under the best conditions, the apparatus set forth in application Ser. No. 211,739, now U.S. Pat. No. 4,402,391, will weight to an accuracy of no greater than 95-percent; however, many weights and measure codes require a greater accuracy such as at least 98-percent. Furthermore, field failure of the scale dump solenoid has resulted in a failure to compensate a depositor for cans deposited in some instances. The existing system requires a great deal of service and maintenance and throughout was somewhat limited. Furthermore, the existing systems do not permit the addition of new features without relatively complex changes in the components within the existing controllers.

Untrained service personnel tended to operate the system in such a manner as to damage the solid state relays and there is a tendency on the part of maintenance personnel to calibrate the system even when calibration is not required. Furthermore, the system has no mechanism for ensuring that the payout was equal to the advertised price per pound and an additional problem, detrimental to the total operation of the system, was that it would accept non-metallic objects which are lighter than cans or within the general weight-size profile of an aluminum can, such as milk cartons, small plastic bottles and the like which would be readily processed and payed for by the present apparatus.

The next step in the evolution of selective scrap metal collection systems is disclosed in U.S. Ser. No. 211,739, filed Dec. 1, 1980, now U.S. Pat. No. 4,402,391, by the present inventors and assigned to the Assignee of the present invention. This patent teaches an improved metal collection apparatus for collecting selective melt such as aluminum primarily in the form of used aluminum cans and for compensating depositors of such metal cans based on the weight of the selected metal collected. The collecting apparatus is free-standing and is designed to function unattended. The apparatus is provided with a hopper into which depositors place material, including aluminum cans, which the machine is designed to collect, the depositor then pushes the start button in the vacinity of the hopper to initiate operation of the apparatus. The deposited materials are carried from the hopper to a classifier by means of an endless conveyor belt and the classifier segregates magnetic or ferrous material from the non-magnetic materials.

A pneumatic conveyor conveys aluminum cans to a crusher. The more dense non-magnetic materials collect in the bottom of the bin provided in the pneumatic conveyor and the aluminum material is conveyed by the conveyor of the classifier to the crusher where the material is crushed so as to be more compact and to occupy significantly less space when stored. After passing through the crusher, the crushed material is weighed and its weight noted. The crushed material is then dumped into a stacker conveyor which transports the crushed aluminum cans to a storage bin in which they are stored until forwarded to a recycling plant.

A digital electronic controller is provided to control the energization of the motors that drive the conveyors and the crusher and to provide power to the classifier. The weigher produces an analog signal that is digitized by an analog-to-digital converter. The controller, based on the difference in readings from the analog-to-digital converter, causes the compensation dispenser to dispense or disperse an appropriate amount of compensation in the form of coins or possibly even tokens. The apparatus is provided with motor alarm circuits which produce an alarm signal if any one of the motors is not running properly when energized, and the coin dispensing apparatus will produce an alarm signal if no coins or tokens are available to be dispensed.

A detector is provided which produces an alarm signal each time a piece of magnetic material, such as steel can or tin-plated steel can is segregated from the materials deposited. An alarm signal will also be produced when the container or receptacle, which receives these materials, is full. Another detector is provided which produces an alarm signal if a jam occurs in the classifier conveyor since such a jam will prevent aluminum cans from being fed to the crusher. The electronic controller also includes circuit means for automatic calibration of the weighing system which is used to measure the weight of the aluminum cans deposited therein to assure that it is accurately weighing the material dumped. The digital electronic controller adjusts the set gain of the system such that the output of the weighing system is well within the range of the analog-to-digital converter. The autocalibration is updated continuously between cycles which results in optimum performance of the weighing system. In addition to this calibration, the load cell is initialized with a load-to-voltage out reference resistor. Thus, replacement of the load cell or controller, changes in temperature, or variations in the power supply will not affect system is accuracy. In addition to these features, the system designed to reduce service in the field to an absolute mimimum and built-in test features allow for easy and rapid troubleshooting.

The invention has an improved cycle time which is accompanied by increasing the weight of the bucket before stopping from 0.75 pounds to 1.5 pounds. Thus, the throughput of the apparatus is increased from 150–200 pounds per hour to 300–400 pounds per hour. To facilitate service and operation, retest features are incorporated which periodically reject all failed conditions. This system is capable of detecting operation of the scale-dump solenoid and the controller uses its knowledge of weight to detect whether the scale door is open. Other features include apparatus relating to the security of the money pay out such that the compensation rate is not set as previously done, i.e. with thumb wheel switches, but in a non-volatile memory which provides an account of money and poundage and remembers the quantities even if power fails or is turned off. All solid state output devices are protected by short circuit protection circuitry to protect driver devices, and the error rate in weighing is less than one percent due to altering the sequence of operation and utilizing an improved bucket arrangement.

Many of the prior art systems, however, still suffer from one or more shortcomings. Some do not provide for collection of re-claimable material using an adjustable but accurate pay out means for compensation which includes a customer display of both the weight of the collected re-claimable material and the money payed out. Prior art systems do not generally provide a means for separating out ferrous materials magnetically and then separating heavy's, non-metals and non-ferrous metallic materials. Prior art systems still generally pay for small plastic bottles and many glass and paper products. Prior art systems do not generally display the weight of the contents of the material to the operator or depositor while he is putting the material into the apparatus and none appears to provide an accuracy good to 0.01 pounds. The prior art systems do not have internal counters or memories that keep track of the poundage and the compensation to the nearest hundredth of a pound and the nearest penny for compensation, and none of the systems of the prior art truly provide any real self-testing or auto test modes of operation to assist in troubleshooting and the like. Most do not have an error re-rest feature to minimize down time, and a second metal detector to determine the presence to non-ferrous metallic materials. Most do not alert the customer to the fact that he has put in ferrous material such as a tin-plated steel can, and none use a heavy detector whose operation depends on how far a door or platform is moved or displaced when material falls on it. None pays only in quarters or the largest coin denomination until the end of the operation when it pays the remaining compensation in smaller coins, as required. None has the ability to stop the crusher to prevent cans from coming into the bucket during the weighing operation and to provide an apparatus that has a continuous input feed. None of the present devices is self-adjusting so that the operator or depositor never has to make any adjustment such as zeroing, calibration or metal sensing.

None of the prior art devices teach a rapid emptying method using a blower in combination with at least one other feed mechanism to allow the removal of up to five thousand pounds of cans an hour from the storage bin. None of the prior art devices use a blower to remove cans from the storage area and none provides a control feed or metering device to prevent jams while unloading cans. None of the prior art systems can operate continuously even while cans are being unloaded and most cannot have the compensation ratio adjusted from one cent to $9.99 per pound. Most do not provide a system for eliminating blowing dust and debris by elimininating substantially all pneumatic devices such as fans and blowers during normal operation and none teach a truly accurate means for separating lightweight objects from non-ferrous material objects. Furthermore, none provide a means for even further increasing weighing accuracy by the use of support straps and a universal joint in the bucket system to guarantee uniform weighing, and no one shows the incorporation of flaps on each conveyor to eliminate jams and mercury switches on each flap to sense whether or not the conveyor is moving. None of the prior art patents show the use of a lighweight durable bucket door to reduce transient oscillations due to opening and closing the door or the use of a plastic such as polypropylene to eliminate oscillations and achieve a long-lasting extended life for the bucket door. Lastly, none teach a digital self-adjusting metal detector used (1) to detect and count steel cans; (2) to automatically start the system when cans are dropped in the input; and (3) to separate non-ferrous metallic objects from non-metals for the final separation operation. The extended use of a microprocessor-based control system to control the overall operation of the system, the display, the coin dispenser, and the various alarm systems is not taught.

The present invention eliminates substantially all of the deficiencies of the prior art and provides a substantially improved method and apparatus for selectively recovering or collecting scrap metal, and in particular aluminum cans, containers and the like and for compensating the depositors of the aluminum cans based upon the weight of the aluminum cans so collected.

SUMMARY OF THE INVENTION

It is an object of this invention to provide an improved selective scrap metal apparatus and particularly an improved apparatus for separating out and collecting aluminum cans from an assortment of refuse or the like, which also includes tin-plated steel cans, paper, plastic, glass, and the like.

It is a further object of this invention to provide a continuous feed apparatus in a collection system for improving the overall throughput of the system.

It is another object of the present invention to improve the weighing accuracy of the can collection system and provide a more accurate monetary compensation based upon the actual weight of aluminum cans fed into the system.

It is another object of the present invention to provide a system which initializes itself and performs all self-calibration of the apparatus without human intervention.

It is still a further object of the present invention to provide a display means to guarantee that the customer or depositor knows the exact amount of material weighed to the nearest one-hundredth of a pound and the compensation for such weight.

It is yet a further object of the present invention to provide a reliable maintenance-free way of detecting aluminum cans and to provide diagnostic aids to reduce down time due to equipment failures and the like.

It is still a further object of the present invention to provide a collecting apparatus that is easily kept clean, has reduced noise, and has reduced blowing dust and the like.

It is yet another object of the present invention to provide a system for reliably separating ferrous materials from non-ferrous materials.

It is still another object to assure accurate separation of heavy objects, whether ferrous or non-ferrous.

It is yet a further object of the present invention to employ a second metal detector to separate out non-metals from non-ferrous metals and to deposit the non-metals and the heavys into a trash bin.

It is yet a further object to reclaim only non-ferrous metals such as aluminum, and in particular aluminum cans or containers.

It is yet a further object to eliminate system pneumatics to reduce blowing dust associated with pneumatic conveyors.

It is still a further object to achieve an accurate accounting system that records compensation to the nearest penny and weight to the nearest one-hundredth pound and which is highly accurate over compensation rates over the range of one cent to two dollars and adjustable over the range of one cent to nine dollars and ninety-nine cents.

It is still a further object of the present invention to display, on a periodic basis during the weighing operations, increments of weight presently being weighed and increments of compensation as multiples of the highest denomination coin in the coin dispenser.

It is still a further object of the present invention to stop the crusher to prevent the flow of crushed aluminum cans into the weighing bucket during calibration and weighing operations, even though a continuous feed operation is being used.

It is yet a further object of the present invention to provide an apparatus that needs substantially no operator adjustments and relatively infrequent maintenance.

It is yet a further object of the present invention to provide a blower means for pneumatically emptying the storage bin into a transport device for carrying the crushed aluminum containers from the storage bin to a recycling center or the like.

It is still a further object to provide such a system with a metering device for controlling the rate at which cans are dropped into the air stream to prevent jams and enable the crushed aluminum cans to be emptied at a variable rate of approximately 5,000 pounds per hour without human intervention.

The present invention provides an improved metal collection apparatus for collecting selective metals such as aluminum, primarily in the form of used aluminum cans or containers, and for compensating depositors of such metal cans based upon the weight of the selected metal collected. The collecting apparatus is a free-standing unit and is designed to function unattended. The apparatus is provided with a hopper into which depositors place material such as aluminum cans, which the machine is designed to collect. The depositor then pushes a start button in the vicinity of the input or alternatively, a first digital metal detector at the input will sense a metal input to initiate operation of the apparatus, and the deposited material is carried from the hopper to a metal separator by means of an endless conveyor belt which is operated on a continuous basis. As the material is dumped from the input conveyor belt, steel or ferrous material, such as tin-plated steel cans, are stripped off using a magnetic pulley at the top of the conveyor, and the ferrous materials are dropped into a ferrous material receptacle. Another or third digital metal detector means is provided for indicating that a steel can has been dropped into the receptacle, and the operator display provides a similar indication. Furthermore, the digital metal detector or an optical detector indicates when the receptacle is full.

Non-ferrous material is then fed into the separator, where it is separated. Heavys are detected and then a normally open trapdoor allows the heavys and non-ferrous material transported on the separator conveyor to be further separated by a second digital metal detector for distinguishing between non-ferrous metals and non-metals. A trapdoor is normally open to allow the heavys and the non-metals, including such items as plastic, glass, paper, and the like, into a trash receptacle and a detector can be used to tell when the trash receptacle is full, and means are provided for closing the trapdoor each time an aluminum can is sensed for passing the aluminum can to the input hopper of a crusher. The state of the trapdoor can be determined by detecting solenoid position or by a mercury switch on the trapdoor bottom. The output of the crusher drops the aluminum cans into a weighing bucket and the weight is noted and the customer compensated for the weight. Detectors tell whether a crusher input jam exists or if the crusher input bin is full. The material is then conveyed to a storage bin where it remains until a sufficient amount of material is available for transfer to a recycling center. Means sense when the bin is full and the storage bin is unloaded using a blower system to move the material out of the storage bin directly into a truck, trailer or the like, without human intervention.

A digital electronic controller, including a microprocessor means, is provided to control the motors that drive the conveyors, the crusher, and the blower system. The weigher produces an analog signal digitized by an analog-to-digital converter and a controller, based on the difference in reading from an analog-to-digital converter, causes the compensation dispenser to dispense or disburse the appropriate amount of compensation in the form of coins or tokens. The apparatus is provided with a motor alarm circuit which produces an alarm signal if any of the motors is not running properly when energized, and the coin dispensing apparatus will produce alarm signals if no coins or tokens are available to be dispensed or if a jam occurs.

The controller includes circuit means for automatic calibration of the weighing system which is used to measure the weight of the aluminum cans deposited, and it guarantees an accurate weighing of the material to be compensated for. The digital controller adjusts the reference of the system such that the output of the weighing system is well within the range of the analog-to-digital converter. The auto-calibration is updated before the start of each new cycle, which results in optimum performance of the weighing system. In addition to this calibration, the load cell is initialized or calibrated with a load-to-voltage out reference resistor. Thus, replacement of the load cell or the controller, changes in temperature, or variations in the power supply will not affect system accuracy. The system also includes means for monitoring or determining when the weighing bucket dump door is open, for determining when the scale dump solenoid is operated, for detecting when the storage bin is full, for detecting jams on any of the conveyors for detecting that a conveyor has stopped, the second metal detector generating a signal each time an aluminum can is detected, and the control system determining when no can has been detected for a predetermined period of time to indicate that the transaction is complete and the depositor is through placing cans into the input and for detecting whenever aluminum cans from the separator do not reach the weighing bucket. Furthermore, detectors in the input hopper of the crusher detect jams and further detect when the hopper is full to allow the control means to terminate the continuous operation of the conveyors until crusher operation is restored at the end of the weighing cycle.

The present system has an improved cycle time accomplished through the use of the metal detector to re-initialize the cycle timer, by having a continuous feed system, and by stopping the apparatus at the end of a time out cycle or time out state. To facilitate service and operation, periodic retesting of all alarm conditions is included and the system will automatically be placed back into operation if an alarm is cleared.

The system further includes presetting the compensation rate into a non-volatile memory to prevent tampering and the like. Furthermore, means are provided for sensing an impending power failure and commanding the non-volatile memory to transfer all active data in the RAM memory into the non-volatile memory for storage therein until power is returned. All solid state devices are protected by short circuit protection means to prevent destruction of the driver devices. The improved design of the weighing bucket, the use of a lightweight durable plastic door, such as polypropylene, to reduce or eliminate transient oscillations associated with opening and closing the door, a unique suspension system for the weighing bucket, including straps and a universal joint, collectively aid in providing an extremely accurate system.

A novel heavys detector includes an impact platform for operatively receiving the objects dropped from the discharge station of the input conveyor. A cantilever beam having an elongated end portion and an opposite end portion is pivotally attached to the impact platform, and a counterweight is positioned on the elongated beam member for setting a threshold for determining when a heavy exists. The displacement of the impact platform and the opposite end of the cantilever beam when a given object falls upon the impact platform is then a function of the weight, and when a heavy is detected, the displacement is such that the opposite end portion of the beam contacts a microswitch and generates a heavys detect signal. Means are also provided to insure that the trapdoor stays open to dump the heavy into the trash bin even if it contains ferrous or non-ferrous metal material.

Furthermore, the invention contemplates the use of at least two metal detectors, one being a digital self-adjusting metal detector for detecting ferrous metallic objects such as tin-plated steel cans, and at least one other being used to detect and separate non-ferrous metals such as aluminum cans from non-metals. Yet further, the present invention contemplates the use of a third digital metal detector proximate the input chute for detecting metal cans and generating a signal indicative thereof which the microprocessor can use in place of a start signal thereby eliminating the need for an externally exposed start button currently subject to vandalism and the like.

Furthermore, in addition to jam detection means associated with each of the conveyors, each of the conveyors includes a flap assembly for preventing the build-up of cans on top of the lugs and for further preventing jams. Each flap can, in the preferred embodiment, include a conventional mercury switch on the non-can or lug contacting side thereof which can be monitored to see if each of the three conveyors are operating. Similarly, the mercury switches can be mounted to the outside surface of doors, trap doors, chute doors, and the like for determining opened or closed status and/or for counting. Stripper means may also be included in the input conveyor for preventing jams by stripping off or eliminating bulky items such as paper bags, and the like.

Other advantages and meritorious features of the present invention will be more fully understood from the following description of the drawings and the preferred embodiment, the appended claims and the drawings which are described briefly hereinbelow:

BRIEF DESCRIPTION OF THE DRAWINGS

FIG. 26 is a flow diagram of the Zero routine SELFC of the present invention;

FIG. 28 is a flow diagram of the PRICE routine of the present invention;

FIG. 29 is a flow diagram of the weight Measurement routine MEASUR of the present invention;

FIG. 30 is a flow diagram of the Owed sub-routine PXC of the present invention;

FIG. 31 is a flow diagram of the Quarter sub-routine PAYQTR of the present invention;

FIG. 32 is a flow diagram of the Total Weight sub-routine TOTWT of the present invention;

FIG. 33 is a flow diagram of the routine PAYALL of the present invention;

FIG. 34 is a flow diagram of the PAYOUT sub-routine of the present invention;

FIG. 35 is a flow diagram of the Penny sub-routine DIVDC of the present invention;

FIG. 40 is a flow diagram of the Standby sub-routine STNBY2 of the program STRCYC;

FIG. 41 is a flow diagram of the DELAY routines of the present invention;

FIG. 42 is a flow diagram of the sub-routine READCL of the present invention;

FIG. 43 is a flow diagram of the Multiply sub-routine MULPY of the present invention;

FIG. 44 is a flow diagram of the Read A/D Converter sub-routine READ A/D of the present invention;

FIG. 45 is a flow diagram of the Find sub-routine FIGURE of the present invention;

DESCRIPTION OF THE PREFERRED EMBODIMENT

Figure 1:
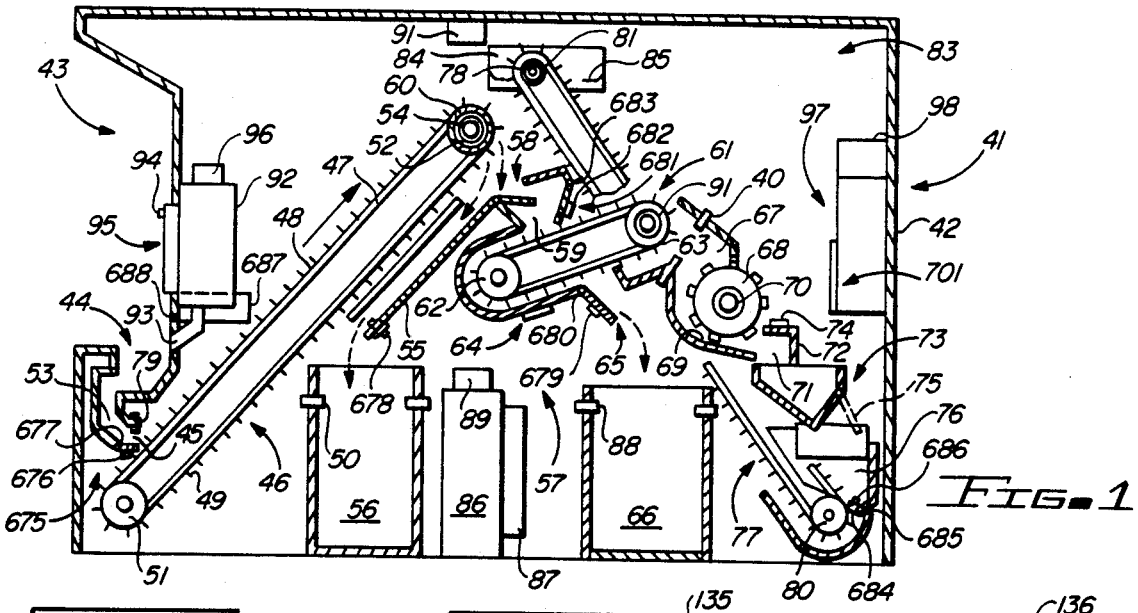
FIG. 1 is a cross-sectional view of the collecting apparatus of the present invention.

The can cashier or collection apparatus 41 is shown in FIG. 1. The can collection apparatus 41 is designed to be a free-standing unit, which is self-contained and able to be operated unattended. Such apparatus are frequently located in convenient, easy-to-reach public places such as the parking lots of shopping centers, shopping malls, and the like. The apparatus 41 for selectively recoving containers of a certain type from a collection or assortment of trash or refuse including containers of various types such as steel, aluminum, plastic, paper, glass and the like is shown as being housed or contained within a generally rectangular frame or housing 42 having a front portion 43. A consumer of beverages or depositor who has collected a supply of used aluminum cans, and/or some aluminum scrap, particularly of a gauge not significantly thicker then that of aluminum cans, takes his collected supply to the front 43 of the housing 42 and deposits the cans into the input hopper 44. The cans pass through the curved chute or passage of the input hopper 44 before passing out of the hopper exit 45 onto the first or pick-up station of an input conveyor assembly 46. The curvature of the chute or neck between the hooper input 44 and the hopper output 45 is to prevent a depositor or other person from inserting his arm or the like into the hopper 44 which could result in physical damage or injury and to prevent vandalism and the like. At the output of the input hopper 44, proximate hopper exit 45, is disposed a digital metal detector responsive to the detection of metal cans or trash dropped into the input hopper 44 by the depositor for generating a start-type signal thereby enabling the start button 94 to be eliminated, if desired.

The input conveyor assembly 46 includes a conventional conveyor belt 47; the top surface 48 of which carries the cans or refuse fed into the input hopper 44 and out hopper exit 45 to the magnetic separator at the second or delivery station 54 of conveyor 46. A plurality of evenly spaced, substantially parallel, transverse flights or conveyor lugs 49 are operably disposed along the entire outer or upper surface 48 of the belt 47 and at a substantially right angle to the belt 47 for preventing the cans and the like received from the hopper output 45 from rolling back down the conveyor assembly 47 as they are carried from the first station or input 45 to the second station 54 which also serves as the magnetic separator 60. The conveyor assembly 46 is driven by a motor 52 which is operably connected to the upper or station two drive pulley or driven drum 54. At the opposite end of the in conveyor 46 or the first conveyor station is an idler pulley or idler conveyor drum 51. The driven drum 54 is generally cylindrical and has a body of non-ferrous material such as wood, plastic, non-ferrous or non-magnetic metal. A series of axially positioned magnetic bars or devices 60 or the like are operably disposed around and over at least spaced apart portions of the exterior of the generally cylindrical drum body 54 to form strips of or a complete covering over a magnetic jacket 60 over the outer peripheral surface of the idler drum 54. Proximate the bottom input chute of hopper 44 near the output 45, a flapper 675 is pivotally connected to the chute bottom at pivot 677 such that the flapper 675 rides over the belt lugs 49 to insure cans do not become stuck or lodged thereon for preventing jams and for preventing cans and trash from falling or sliding down the conveyor belt 47. Additionally, a mercury switch 676 or the like may be attached, affixed or otherwise secured to the non-can contacting surface of the flapper 675 to sense or detect when the conveyor 47 is not moving and generating a signal indicative thereof.

The magnetic separator assembly, in addition to the magnets 60, further includes a separation plate or a plastic slide or chute 55 for receiving separated ferrous material such as tin-plated steel cans and the like and conveying or directing the steel cans down the plastic chute 55 and into the ferrous metal collection container or steel can collection or receptacle bin 56.

The output of the chute 55 includes a digital metal detector for detecting and counting steel cans entering the steel can receptacle 56. The MPU can use this data to display a steel can light or display message for the depositor. A detector at the drum or receptacle can also be a photo-optical can full detector or the MPU can calculate a can full condition based on the counts.

The metal separator or metal detection system comprising the upper driven conveyor drum 54 with magnets 60 and the ferrous metal chute 55 operates as follows. As the assorted trash or refuse including aluminum cans, metal cans, glass, plastic, paper and the like travel up the surface 48 of the input conveyor 46, they ultimately reach the upper end portion or discharge station and must rotate with the conveyor belt 47 on the outside of the idler drum 54. Any ferrous objects or tin-plated steel cans will be magnetically adherred or attracted to the outer surface 48 of the conveyor belt 47 since the underlying magnets 60 produce a magnetic field which is effective through the conveyor belt 47 while all remaining non-ferrous material and heavys will drop off the end off the conveyor at the discharge station onto a heavy's door or impact platform 58 as hereinafter described. The ferrous metal material and objects will continue to be adherred to or retained on the surface 48 of the conveyor belt 47 for at least 180 degrees around the driven drum 54 and as soon as the portion of the conveyor belt 47 containing the attracted steel cans and the like passes off of the drum 54 and hence the magnets 60, the magnetic attraction will gradually weaken until it is insufficient to retain the cans and ferrous materials against the conveyor belt 47 due to the weight thereof. At this time, all ferrous materials including tin-plated metal cans and the like will drop off of the outer surface 48 of the conveyor belt 47 and fall onto the plastic chute or deflection plate 55 rather than the heavy's door 58 and hence be directed downward into the steel can collection bin 56 for later disposition. The actual construction and operation of the magnetic separator comprising the drum 54 and magnets 60 is more fully described in U.S. Pat. No. 4,179,018 which is incorporated by reference herein.

As previously stated, all input material received into the input hopper 44 and conveyed past the magnetic separator comprising driven drum 54 and magnets 60 which is non-ferrous, for example, aluminum, paper, glass, and heavy's fall off the end of conveyor assembly 46 and fall onto the heavy's door or impact platform assembly 58. The door 58 is set up to detect heavy objects based on a preselected weight limit and the weight limit for the heavy detector is selectively adjustable as hereinafter described with reference to FIG. 19. When the material slides off the heavy plate or door 58 into the separator assembly 57 through the separator input 59 a second, classifier or separator conveyor 61 including a motor driven drum 63 driven by a separator motor 90 drives a conveyor belt 99 having one end operably disposed over the driven drum 63 of the second or discharge station and the opposite end operably connected over the idler drum 62 at the first or input station. The motor 90 drives the drum 63 counter-clockwise to carry the materials entering through the heavys door 58 and the separator input 59 around the end of the idler conveyor drum 63 to another digital metal detector assembly 64 which controls the operation of trap door or dump door 65 as hereinafter described through a door operating solenoid. The metal detector 64 is set to detect non-ferrous metallic objects such as aluminum cans and when this type of material is present, the trap door 65 is closed to allow good material such as aluminum cans and the like to be transferred to the crusher input 67. However, since only non-ferrous material is present coming into the separator input 59, and since the trap door or dump door 65 will remain closed to pass detected non-ferrous metallic objects such as aluminum cans, the trap door 65 will remain open so that heavys and non-metals such as glass, plastic, and paper fall through the door and into the non-metals and heavys collection bin or trash container 66. The door position of trap door 65 can be determined by knowing the position of the solenoid armature, but alternatively and/or simultaneously, a mercury switch operably disposed, affixed, or secured to the lower surface of the trap door, could also output a signal to tell whether the door is opened or closed. Even if heavys approaching the trap door are or include some ferrous or non-ferrous metals, the metal detector signal is over-ridden by the MPU known approach of a heavy such that the trap door 65 remains open to drop the heavy into the trash bin 66. Therefore, only the non-ferrous metals such as aluminum cans are passed to the input 67 of the crusher 68. The crusher 68 is driven by a crusher motor 70 and the cans entering the input 67 are crushed against the bottom crushing surface in the crushing zone 69. The crushed cans exit the crushing zone 69 to the crusher exit 71 which, in conjunction with deflector 72 direct all crushed aluminum cans from the crusher zone 69 into a weighing hopper or bucket 73. The weighing hopper or bucket, as known in the art, measures the weight of the material contained therein through the use of a load cell 74 or the like as hereinafter explained with reference to FIG. 20. A dump door or weight bucket door 75 may be operably opened to dump the contents of the weighing bucket 73 into a funneling device, chute or slide 76 which catches all crushed aluminum cans exiting the door 75 of the weight bucket 73 and transfers them laterally to the bottom or first station of a storage bin conveyor assembly 77 as hereinafter described.

The storage bin conveyor 77 is driven by a storage bin conveyor motor 78 operably connected to an upper conveyor drum 81. The conveyor belt 82 is operatively disposed over the driven conveyor belt drum 81 at the discharge or second station and an idler conveyor belt drum 80 at the conveyor input or first station, proximate the bottom of the housing 42. Drum 80 is disposed such that the storage bin conveyor 77 carries the crushed aluminum cans from the output door 75 of the weight bucket 73 via funneling chute 76 up the conveyor 77 and drops the cans into a storage bin lateral slide 85 which is operably disposed to receive all cans coming off of the upper end of the conveyor 77 and sliding or laterally transferring the crushed cans through a window 84 or the like formed in a partition 83 which separates the processing portion of the housing 42 from the relatively large storage bin area as hereinafter described.

At the rear of housing 42, FIG. 1 shows an electronics unit 97, a communicator 98, and an internal display 701 for maintenance personnel and the like. At the front of the housing is an external start button or switch 94, a display 95 including separate indicators such as "Out of Money" and the like, a coin chute 93 and a coupon slot 688. Inside the front is a coin dispenser assembly 92, an intrusion alarm 96 and a coupon dispenser 687. The coupon dispenser 687 may be, for example, a conventional dispenser such as used with tape, bills, tickets, and the like. Coupons may be dispensed free, at least one to each depositor, through slot 688.

FIG. 1 also shows a centrifugal fan or blower 86 operated by a fan motor 87. The blower output is coupled via conduit 89 for supplying a forceful stream of air laterally through the side partition 83 for use as hereinafter described. The return air stream carries a continuous metered supply of crushed aluminum cans therein for emptying the storage bin on the other side of the partition 83 as shown by conduit 91 and which moving laterally across the ceiling to an emptying point as hererinafter described. A vault 92 is operably disposed to the front inside wall of the housing 42 and the vault 92 includes a coin dispensing chute or outlet 93 through which the depositor receives his compensation. A starter button or switch 94 is disposed on the front panel 95 which also houses the displays and alarm indicators, the Out of Order indicator and a separate Out of Money warning light. An intrusion alarm 96 is operably disposed above the vault 92 and the electronics and control system housing is indicated by box 97 while an automatic signal transmission device is represented by reference numeral 98. An internal display may be used for diagnostics and the like by service personnel.

Briefly, and without specifically referring to the remainder of the Figures which will be hereinafter described, a brief operational description of the system of FIG. 1 will be given including portions of the hereinafter discussed drawings.

Whenever a depositor brings a collection of trash or refuse including aluminum cans, and possibly including any one or more of tin-plated steel cans, ferrous metal objects, glass bottles, containers and objects, paper bottles, containers, and objects plastic bottles, containers and objects, and the like, he approaches the front 43 of the can collection apparatus 41 and deposits his collection of refues into the input hopper 44. The refuse passes through the curved throat and exits and then through the hopper exit 45 onto the top carrying surface of the input conveyor 46. When the depositor presses the start button 94, or the detector 79 detects metal, the control system of the present invention will immediately power the input conveyor motor 52, the separator conveyor motor 90, and the storage bin conveyor motor 78. A control system automatically initializes the pounds display to all zeros and as refuse and cans are fed into the input hopper 44, they are conveyed by the input conveyor 46 to the magnetic separator comprising conveyor belt drum 54 and magnets 60. These perform a separation with the ferrous metal material including tin-plated steel cans and the like being carried past the normal drop point and dropped onto a separation plate or plastic slide or chute 55 from which they are directed and dropped into a ferrous metal collection container 56. Therefore, the remaining material which drops off the end of the conveyor 46 at the normal drop point fall onto a heavys door 58 contains only non-ferrous materials. These non-ferrous materials are carried by the separator conveyor 61 to a second digital metal detector 64. The second metal detector 64 operates a solenoid for the the positioning of a trap door 65 so that the non-ferrous metallic material and other non-metallic material which will be allowed to drop through the heavys door 58 will be separated by the second metal detector with non-metals and heavys falling through the open trap door 65 and metallic options such as aluminum cans causing the door to close and the aluminum can to be moved by the separator conveyor 61 over the closed trap door 65 and into the crusher input 67. The non-metals and heavys falling out the trap door 65 are collected in the non-metals and heavys collection bin 66 for disposal as required. The crusher 68 was turned on immediately after the auto zero calibration of the scale was completed, as hereinafter described, and the aluminum cans from the conveyor 61 are deposited into the mouth or input hopper 67 of the crusher 68 with the crushed metal cans passing out the exit 71 and dropping into the weight bucket 73. As metal is being deposited into the weight bucket 73, the weight of the material is being continuously monitored and when the weight reaches, for example, one or two pounds, or when an elapsed time of, for example, 20 seconds, has occured since the last metal passed the second digital metal detector 64, a time out state is entered, the crusher 68, stops and processing of the weight in the bucket 73 and its contents is made. The contents of the weight bucket 73 is then dumped and after a suitable stabilizing delay, the empty bucket 73 is again weighed. The controller, as hereinafter described, then processes the difference to determine the exact weight of the material to be compensated for and at no time during the process of accepting cans does the input conveyor 46 stop. However, the crusher 68 is stopped during the weight cycle to prevent cans from going into the weight bucket 73 while the exact weight of the contents of the bucket 73 is being computed. During thay time the crusher 68 is stopped and incoming cans are temporarily stored in the crusher input hopper 67. When the crusher 68 again starts, it immediately crushes these cans in the input hopper 67 and dumps them into the bucket 73 for future weighing. This process continues as long as cans are being fed into the collecting apparatus thereby greatly increasing system throughput 41.

When the activity ceases, the final payout sequence is initiated. All motors shut off at the same time the final payout begins or occurs. Each time a predetermined weight, for example, a pound of cans is processed, the front display panel 95 will display or show the new weight to the customer or depositor. Throughout the cycle, the weight in some predetermined increment, will periodically update the display each time said increment of weight is added to the weight bucket 73. Similarly, each time the greatest value or denomination of coin or token in the dispenser has a weight value equivalent thereof added to the weight bucket, the greatest denomination coin, for example a quarter, is dispensed to the depositor and the display of compensation is incremented by that amount. However, at the end of the cycle, tenths and hundreths of pounds will be displayed. The final payout occurs at the end of the cycle also. The final weight reading times the current compensation rate will equal the total compensation which is displayed to the nearest penny. Simultaneously, the coin dispenser will dispense less valued coins to arrive at the exact total to be paid. During the processing cycle, the payout and the weight will not necessarily correspond. However, at final payout, the weight received times the rate to be compensated per pound will agree with the payout amount on the display, except the payout is always rounded up. If only one can is deposited, the amount due is counted down. The entire sequence is controlled by the control system as hereinafter described which includes a sophisticated electronic module comprising input-output circuitry (I/O), decoding, random access memory (RAM), programmable read only memory (PROM), an analog-to-digital converter (A/D); and a microprocessor unit (MPU).

Once the collector apparatus 41 is turned on it initially starts to look for the start switch 94. When a start switch signal is received, first the display panel 95 is cleared and then the conveyor motors are turned on while new values are set for the digital metal detectors. When material is being conveyed to the separator, the control system auto zeros itself into optimum operating range after which a reference sample is taken which equals exactly two pounds. After calibration (sampling), the crusher 68 is turned on and material from the crusher out is allowed to fall into the weight bucket 73. Now the search process begins. When either a time out or a desired bucket rate is reached, the crusher 68 is turned off and the material is processed. During processing, the exact weight is calculated, the amount owed is calculated, and weight and money accumulated is updated. Should a quarter be owed, or if a pound of material has been processed, then the pound display or money display or both will be updated and if necessary compensation will be paid. Once processing is completed, the controller tests to see if it is done. When more materials to be processed, the crusher 68 is turned back on and more material is processed to complete a cycle.

Portions of the assembly 41 of FIG. 1 will now be described in slightly more detail extracted primarily from hereinafter described figures. When the non-magnetic or non-ferrous materials fall off the end of the input conveyor 46 onto the heavys door 58, a microswitch in combination with a cantilevered door is used to detect heavys, as further described with reference to FIG. 19. Activation of the mircroswitch, signals to the controller that a heavy has been detected. The cantilever action is set by a counter weight and as the cans fall off the upper end of the input conveyor 46 onto the heavy door 58 and off of the heavy door into the entrance 59 of the separator 57 they are allowed to freely fall into the separator or classifier conveyor 61 that conveys or transports the material through the separator 57. An anti-jam flapper 681 is used in conjunction with the belt lugs to prevent material from being caught on top of the belt lugs thus allowing the material to flow freely into the slots between the belt lugs. Similar flappers are disposed on each conveyor and each, such as flapper 681, attached at pivot 683 may have a mercury switch 682 on the side of the flapper 681 not contacting cans for detecting whether the conveyor is working. The material is then conveyed around the end of the conveyor 61 down to the second digital metal detector 64. Detection of signals from this metal detector means that a metallic object is present and that the object is not steel, because steel has already been separated out. When detection occurs, the dump or trap door closes and remains closed until the metal passes the dump door. When no metal is detected, the dump door remains opened and trash such as paper, milk cartons, plastic bottles, glass and the like freely fall out the open dump door 65. During a heavy detection and after a suitable delay that assumes the heavy to be in the vicinity of the dump door 65, the metal detector is over-ridden to drop the heavy through the dump or trap door 65 even if metal is detected. Therefore, only good material such as aluminum cans, aluminum scrap and the like are allowed to pass through the separator 57 and into the input hopper 67 of the crusher 68. The trap door 65 may also include a mercury switch 679 to indicate an opened or closed position, if desired.

Throughout the system, special flaps have been incorporated to eliminate jams. A flap 681 such as like the one described in the separator 57 is used as the material exits the input hopper and falls on the first conveyor to prevent material from getting on top of the lugs of the conveyor belt and for preventing cans from sliding back from the belts. Two braces may be placed across at least the input conveyor, just above the height of the standard material, and these braces are used to strip off objects such as paper bags which may be too large to go through the separator 57. An anti-jam flapper 684 pivoted at 685 is also used with the third conveyor or storage bin conveyor 77 to prevent cans from jamming against the belt lugs and the like and from falling back down the belt. The flapper 684 may also include a mercury switch 686 to detect belt operation.

Further, to guarantee the uniformity of bucket weight, the the universal joint 523 is used along with three straps so that any weight placed anywhere in the bucket will be uniformly read by the load cell 74. The bucket door 75 has been made using a plastic material that is lightweight and rigid and which prevents transient oscillations of the bucket when the door is opened and closed. In addition to the MPU's knowledge of bucket weight, a mercury switch could be mounted on the outside of the bucket door 75 to determine an open or closed position. A blower system including centrifugal fan 86 and motor 87 is used to empty the cans stored in the storage bin on the other side of the partition 83 as hereinafter described. The blower system includes a blower motor 87 and a feed motor 121. The feed motor is a gear motor 121 or the like that drives a feeder mechanism 114 to meter cans into the air stream of the blower and the motors are electrically interlocked so that the blower motor 87 must be on for the feed motor 121 to be on. This will be described in more detail hereinafter.

Figure 2:
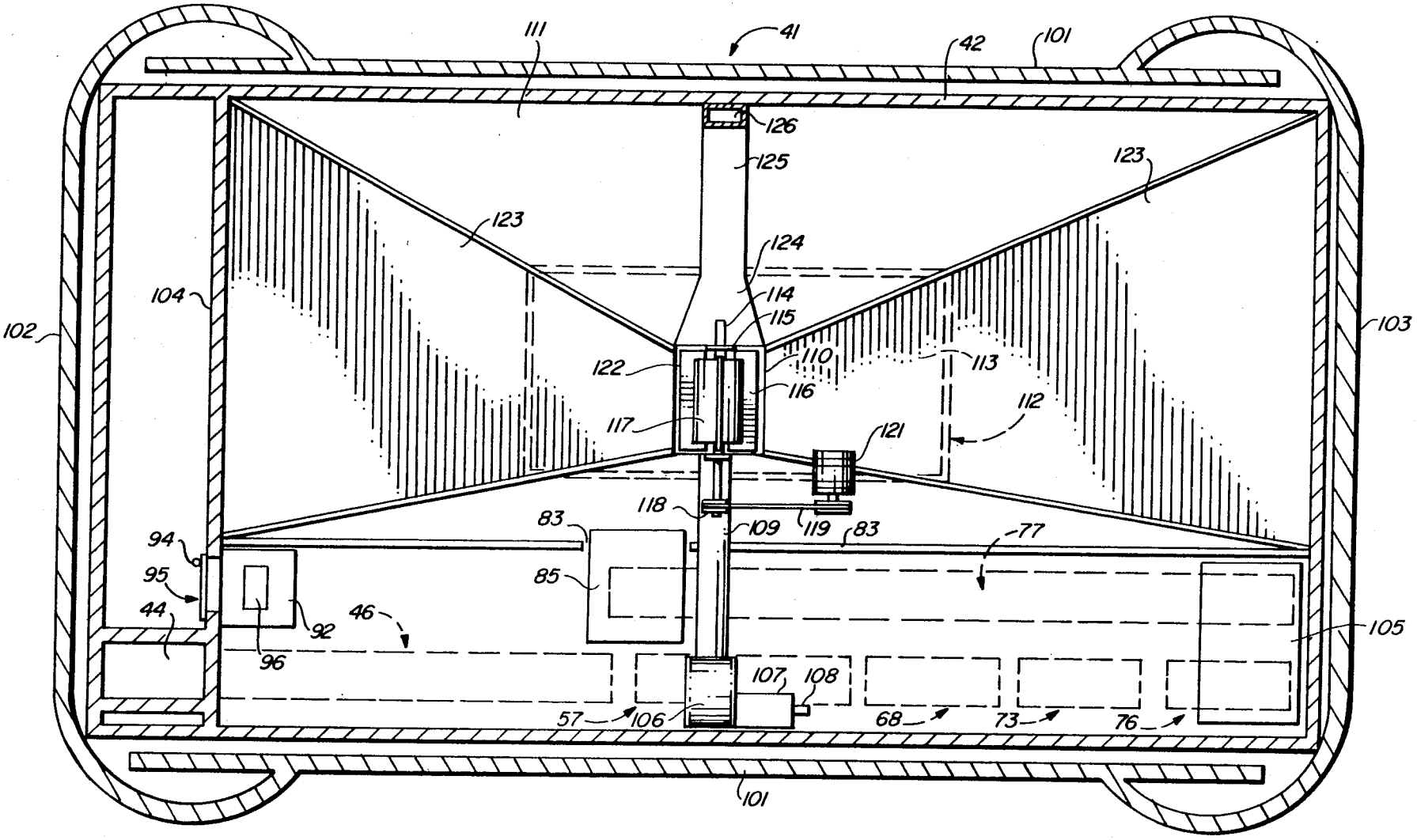
FIG. 2 is a top sectional view of the collector apparatus of FIG. 1 showing the storage bin section.

FIG. 2 represents a sectional top view of the collector apparatus 41 of the present invention. In addition to the housing 42, an outer shell portion is disposed about the housing 42 for decorative purposes. The decorative shell includes a pair of elongated side panels 101, a front panel 102, and a rear panel 103. A partition 104 divides the outside front portion from the remaining area and the elongated longitudinal partition 83 separates the conveying, separating, crushing and weighing sections from the storage bin portion 111. As shown in FIG. 1, the system includes an interior vault 92 with an intrusion alarm 96 and a display panel 95 extending outward of the wall or partition 104 for viewing by the depositor. Likewise, pushbutton 94 is located outside the partition 104 as is the input hopper 44. Input hopper 44 feeds the cans to the input conveyor 46 which supplies them through the first metal separator and into the separator assembly 57. The cans and other material then pass from the separator assembly 57 to the crusher 68 and from the crusher 68 to the weight bucket 73. The weight bucket 73 empties into a funneling device 76 which passes the cans laterally via chute 105 to the storage bin feed conveyor 77. At the top of the conveyor 77, a lateral chute 85 supplies the cans through an opening 84 in the partition 83 and dumps them into the storage bin 111 which comprises approximately ⅔ of the interior space of the housing 42.

The centrifugal fan or blower 106 (86 in FIG. 1) is driven by fan motor 107 (87 in FIG. 1) and the jet of air provided thereby is supplied through an air input conduit 109 through an aperture in the partition 83 into the directing and metering apparatus 112 driven by a moter 121 and chain-like drive 119. The apparatus 112 is better seen in FIG. 3, as hereinafter described, but the interior 113 houses a metering structure or housing 110 which is closed on all sides but the top which includes a generally rectangular aperture or opening. Shaft 114 is extended longitudinally across the top opening of the metering structure 110 and fastened thereto for rotation via fastening means 115. Disposed within the opening or inlet 122 to the metering structure 110 are four or more paddle members 116 disposed at approximately 90 degrees to one another and attached to the shaft or axle 114 via paddle attachment means 117. As the shaft 114 rotates, the four paddles 116 rotate within the generally cylindrical metering structure housing 110 and the paddles are disposed in the aperture or inlet 122 of the housing 110 so that crushed metal cans and the like can not fit in except as they are collected between adjacent paddles 116 and dropped into the housing as the paddle rotates into the opening 122 so as to control, meter, or direct the general number or amount of cans disposed into metering housing 110 at any given time. Since the opposite end of the inlet air conduit 109 connects to the back inlet of the housing 110, and since the force of the air generated by the centrifugal fan 106 and carried by the conduit 109 is relatively strong, all crushed aluminum cans deposited through the opening 122 by the rotating paddles 116 and into the generally cylindrical interior of the metering structure 110 are blown out of the metering structure space 110 through the funneled outlet 124 into a generally cylindrical or rectangular outlet pipe 125. The portion 126 indicates that the pipe rises vertically toward the ceiling of the housing 42 to return along the ceiling to the opposite side as illustrated by outlet 91 of FIG. 1 and as hereinafter described with reference to FIG. 3. In this manner, the cans metered into the device 110 will be blown out and through the conduit 125, 126 for emptying the storage bin 111 pneumatically and blowing all the cans stored therein into a waiting truck or the like for carrying the crushed aluminum cans to a recycling center or the like. The rate is adjustable by varying the speed of metering device motor and/or by varying size of housing, aperature, paddle height and length and spacing, etc. The blower 106 and metering device 112 of the present system is capable of emptying or blowing out approximately 5,000 pounds of crushed aluminum cans per hour without human intervention. Further, to ensure that all crushed aluminum cans deposited via the side conveyor chute 85 through aperture 84 of partition 83 into the storage bin 111 reach the metering device 112, rapidly sloping walls formed a predetermined distance down from the ceiling to the metering device input 122 are provided so that all cans falling onto the chute are dirrected between the paddles 116 of the metering device 112 for controlled metered output thereof. The slides 123 have raised side portions or portions rising to just under the slide and adjacent to the ceiling on the opposite side as well as to the longitudinal front and back ends as shown in FIG. 2.

Figure 3:
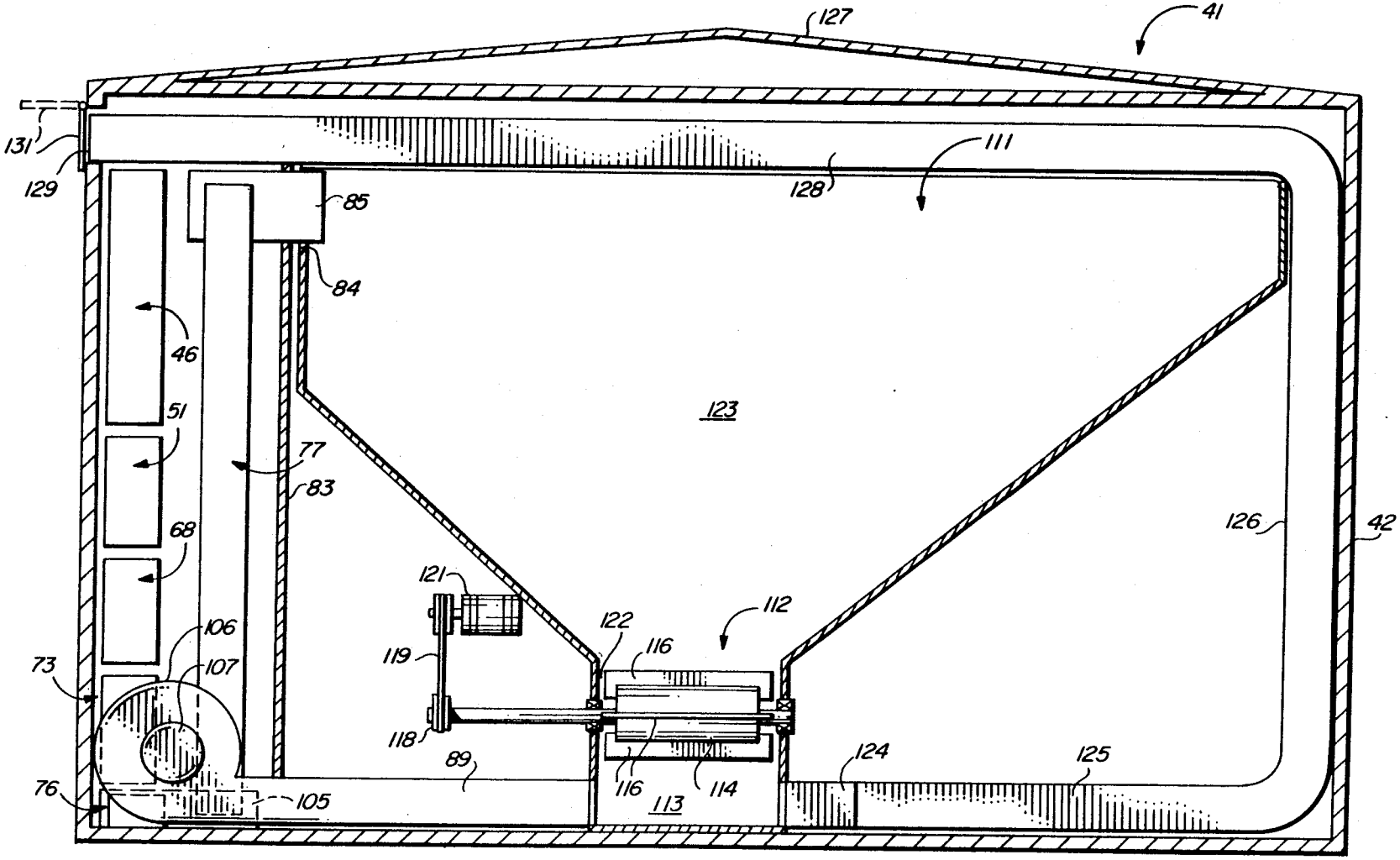
FIG. 3 is an end sectional view of the apparatus of FIG. 2.

FIG. 3 shows a representative end view of the metering system of FIG. 2. In FIG. 3, the partition 83 divides the portion including the input conveyor 46, the separator 57, the crusher 68, the weigher 73, and the output funneling device 76 which funnels the crushed cans via lateral slide 105 to the storage bin input conveyor 77 whose opposite end supplies the cans through an aperture or window 84 in the partition 83 via slide 85 to empty all processed crushed aluminum cans into the rather large storage bin portion 111 of the housing 42. The housing 42 is shown as including a decorative roof portion 127. Further, a conventional blower or centrifugal fan 106 powered by a motor 107 supplies a stream of high pressure air through a duct, conduit, or passage 89 which passes through the partition 83 and enters the metering or housing enclosure 113 of the metering apparatus 112 of FIG. 3. The metering enclosure 113 is closed on all sides except for the open top portion 122. Centered on the open portion 122 is an elongated longitudinal shaft 114 operably disposed across the center of the lateral ends of the metering housing 113 and extending longitudinally thereacross. Opposite end portions of the shaft 114 are secured for rotation against the ends of the enclosure 113 and a motor drive 121 operably rotates a fixed pulley or sprocket gear assembly 118 operatively secured to one end portion of the shaft 114 via drive chain or sprocket chain 119 or the like. Operatively secured to the axle or shaft 114 are at least four paddle members 116 each operably disposed and secured to the shaft 114 at an angle of approximately 90 degress to one another depending upon the size of the opening 122, a larger number of paddles could be used. The function of the paddles 116 is to close the opening 122 so that none of the crushed aluminum cans in the storage bin 111 can pass into the opening 122 without first being operably disposed on one of the paddles 116. As the paddle 116 rotates into the enclosure 113, the metered number of cans or amount of crushed aluminum cans between paddles adjacent 116 will be dropped into the interior of the enclosure 113 and the stream of air from input duct 89 will blow the dropped or deposited aluminum cans through the enclosure 113 out the funneled exit portion 124 and through the horizontal floor pipe 125, the vertical duct 126, and the horizontal ceiling duct 128. The duct 128 is operably disposed so that its opened end portion 129 is proximate a gate or door 131 which can be opened when the storage bin 111 is to be emptied so that the cans within the bin 111 are fed into the metering device 112 and blown via ducts or tubes 125, 126, 128 and out the exit port 129 directly into the back of a truck or the like. The entire bin 111 can be emptied quickly and easily without the need for raking cans down a gravity slide or the like so as to reduce the cost of the operation and improve system efficiency.

The intermediate connecting portion 117 of the metering device shown in FIG. 2 is not visible FIG. 3 and may be part of the paddles themselves or an option to aid in fastening the paddles 116 to the shaft 114, as required. Further, the side funnel portions 123 are shown as extending from the ceiling and along the sides including a portion directly under the supply bin output conveyor 77 and its lateral exit chute 85 for receiving all of the crushed aluminum cans processed by the equipment on the other side of partition 83 and for sliding all deposited cans in the storage bin 111 toward the entrance 122 of the metering apparatus 112 to ensure that all cans are properly emptied when desired. Much shorter funneling side portions 123 emptying into the metering device 112 could also be used as long as gravity will feed the stored cans into the metering device 112.

Figure 4:
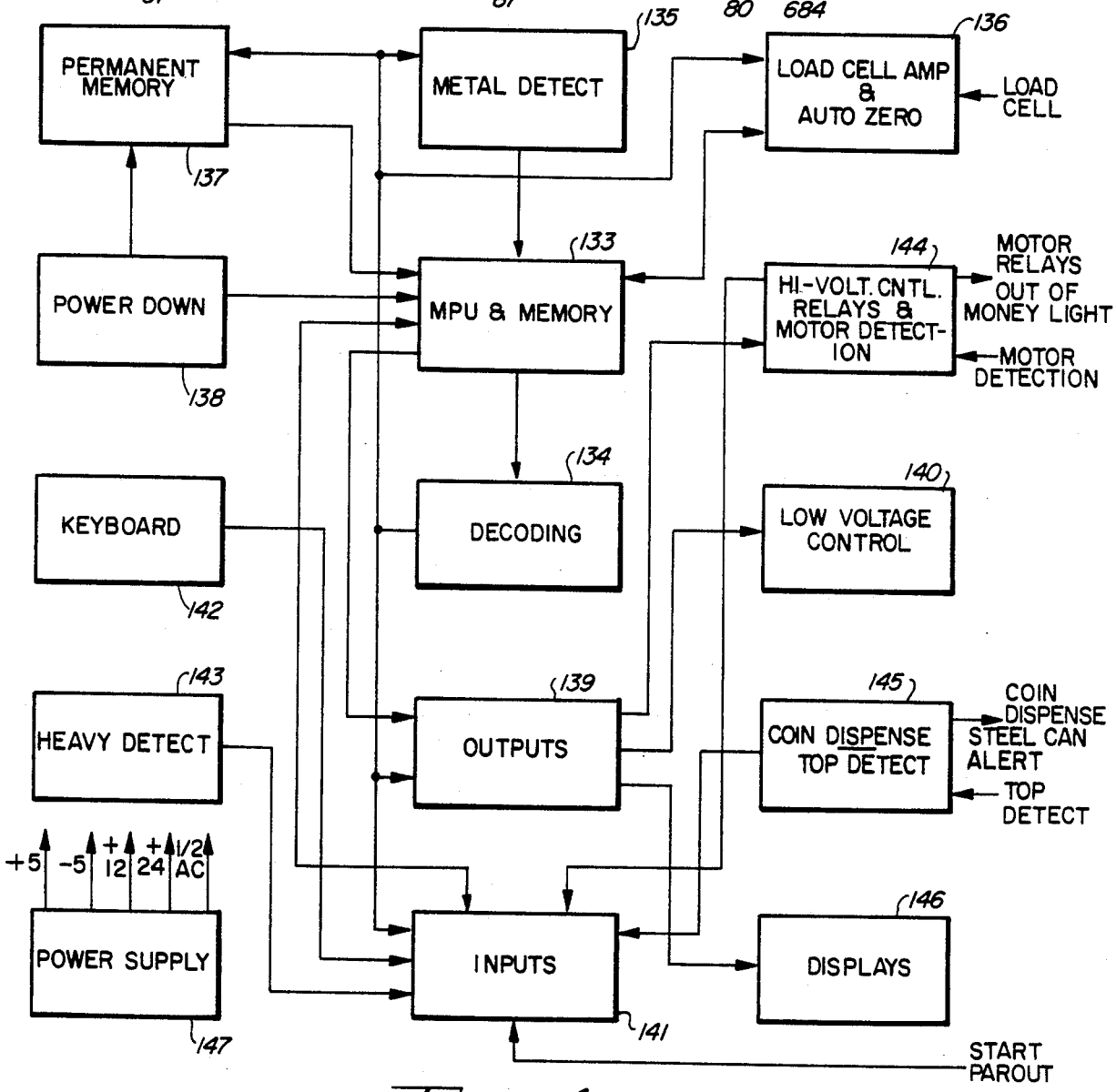
FIG. 4 is a block diagram of the major control functions of the collector system of the present invention.
Figure 14:
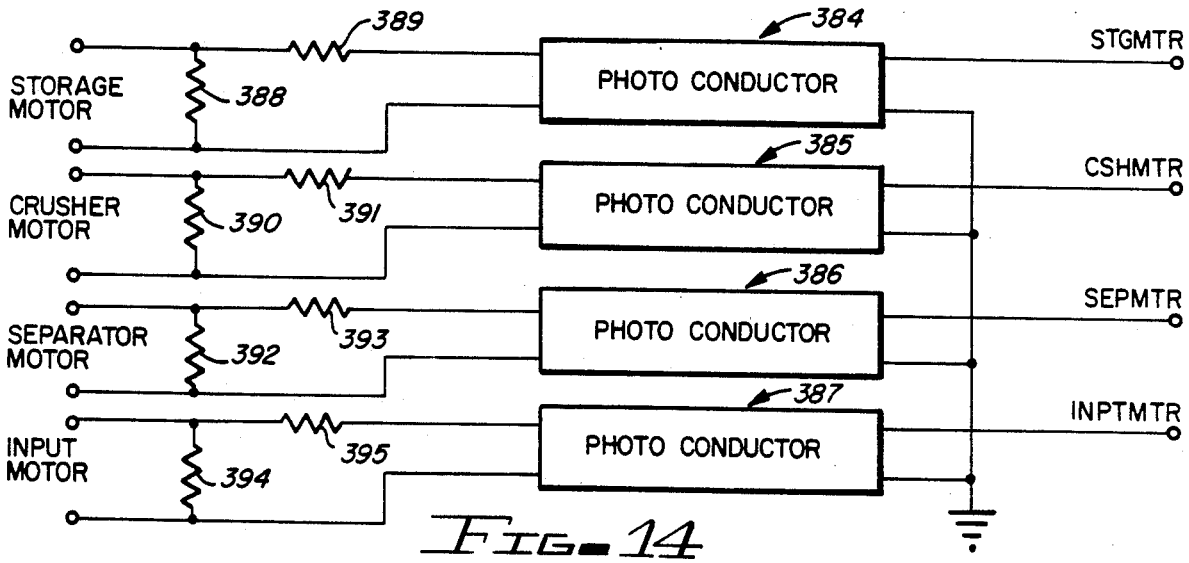
FIG. 14 is a block diagram of the interface circuitry between the high voltage motor circuits and the feedback control circuits of the present invention.
Figure 11:
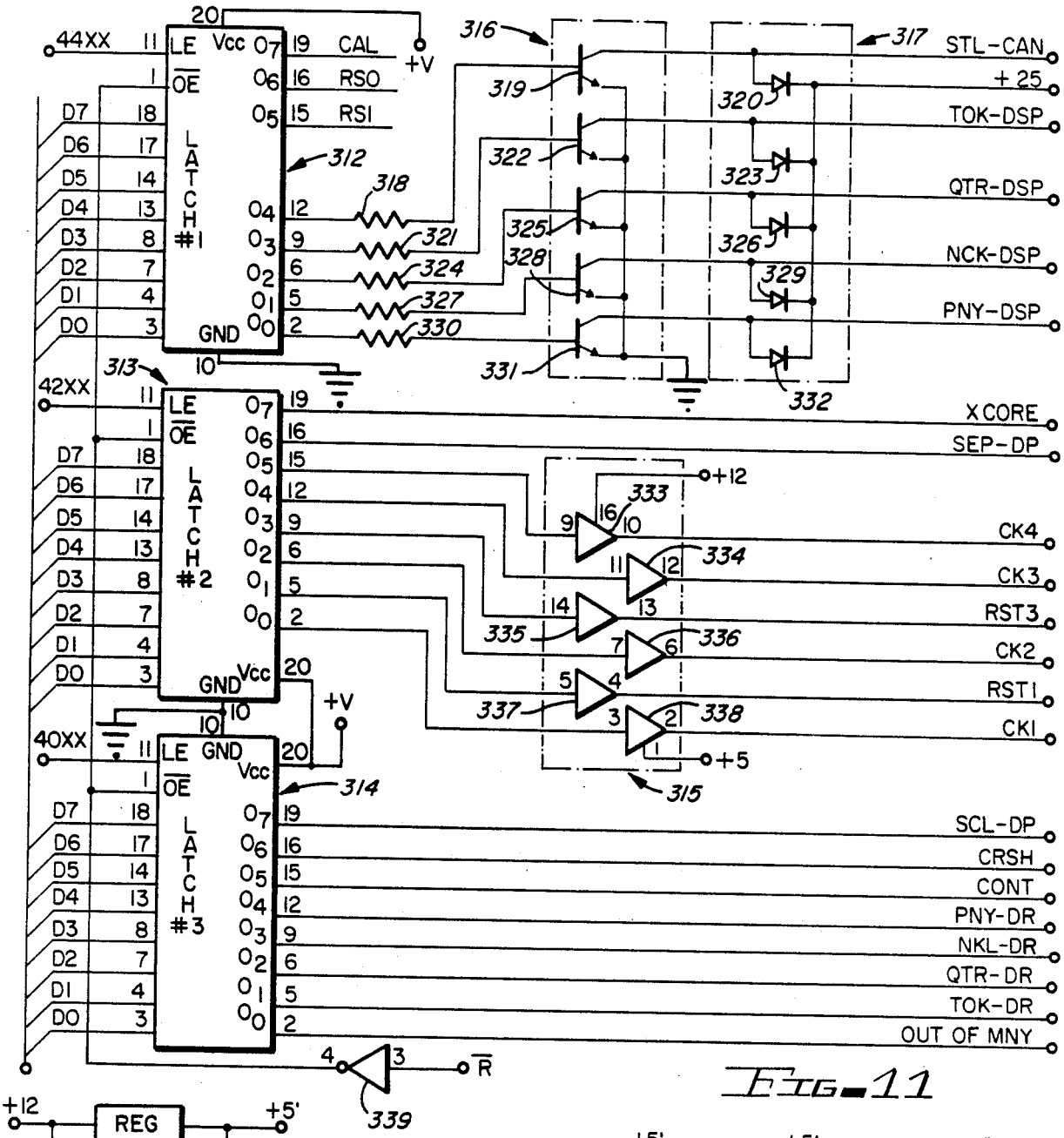
FIG. 11 is a partially schematic, partially block diagrammatic of the output circuitry for low voltage control purposes.
Figure 9:
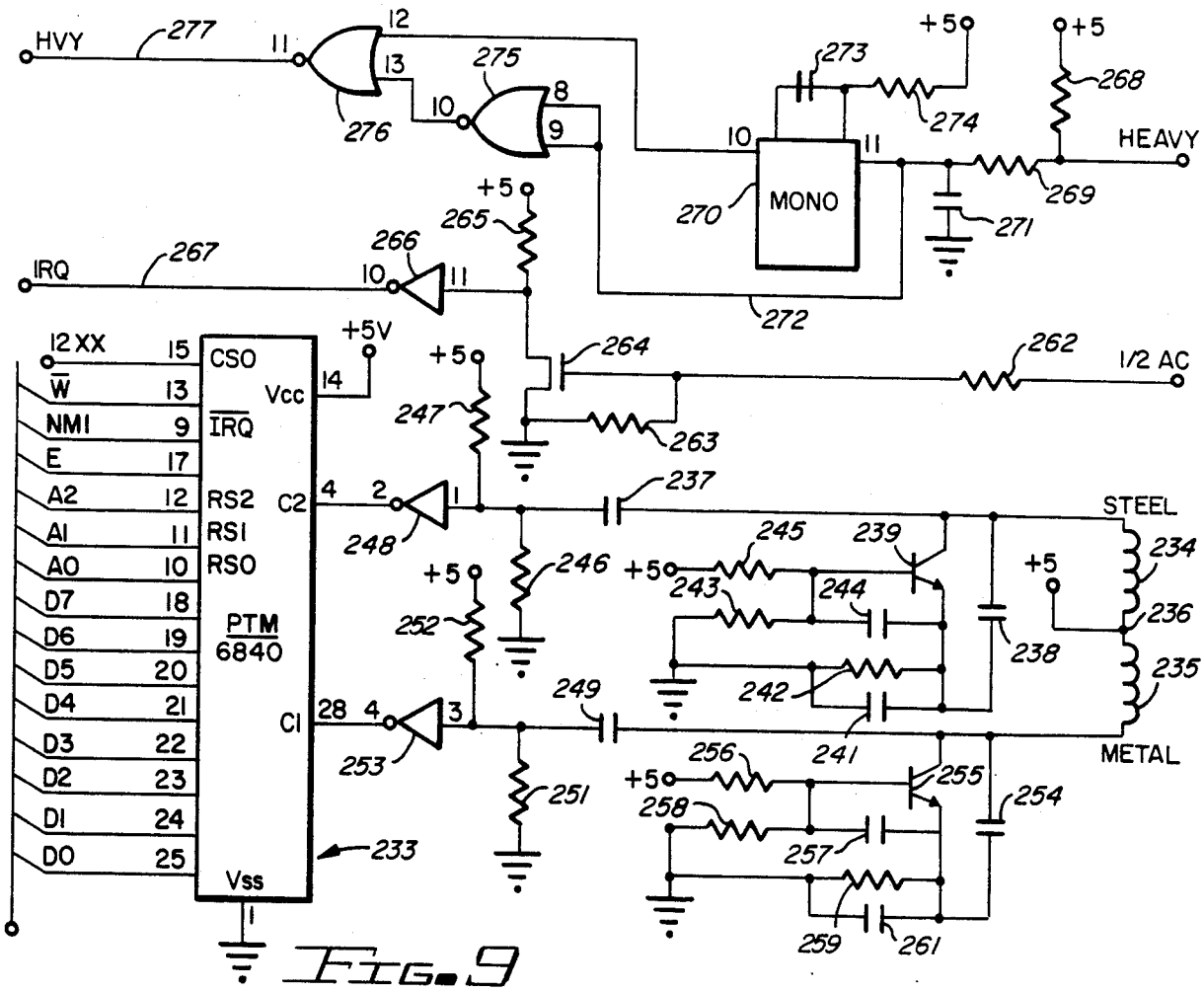
FIG. 9 is a partially electrical schematic, partially block diagrammatic representation of the metal detectors of the present invention and associated circuitry of interfacing to the MPU of the control system thereof.
Figure 21:
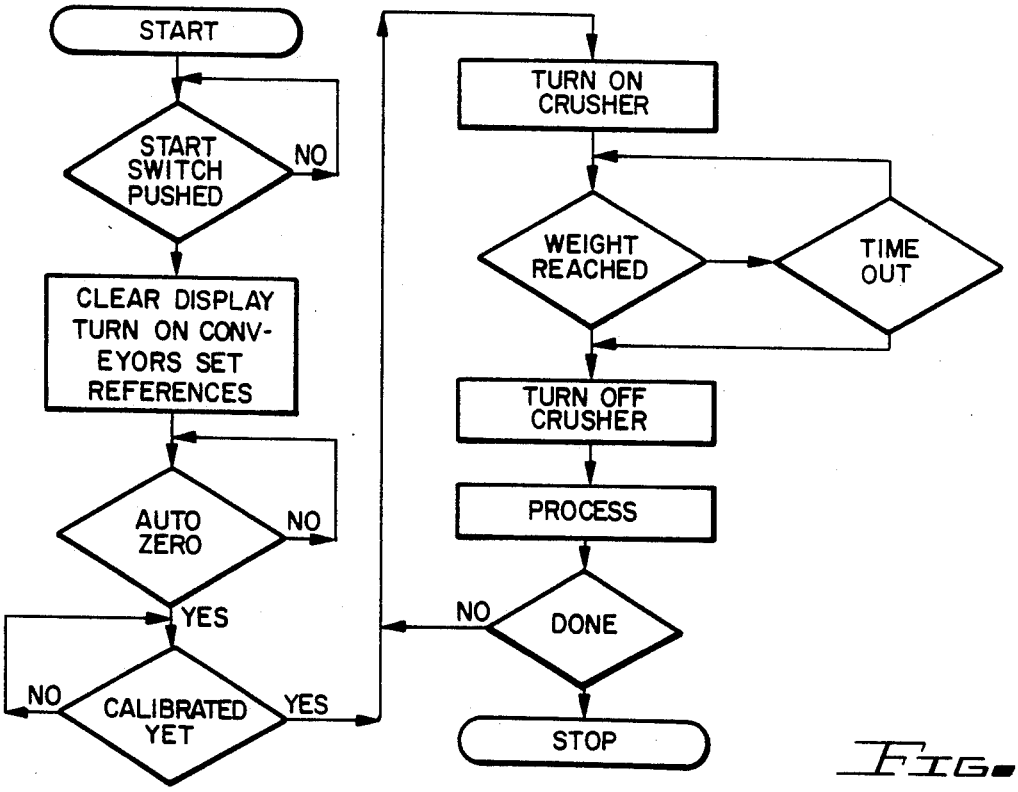
FIG. 21 is a simplified flow diagram of the overall system operation of the present invention.
Figure 10:
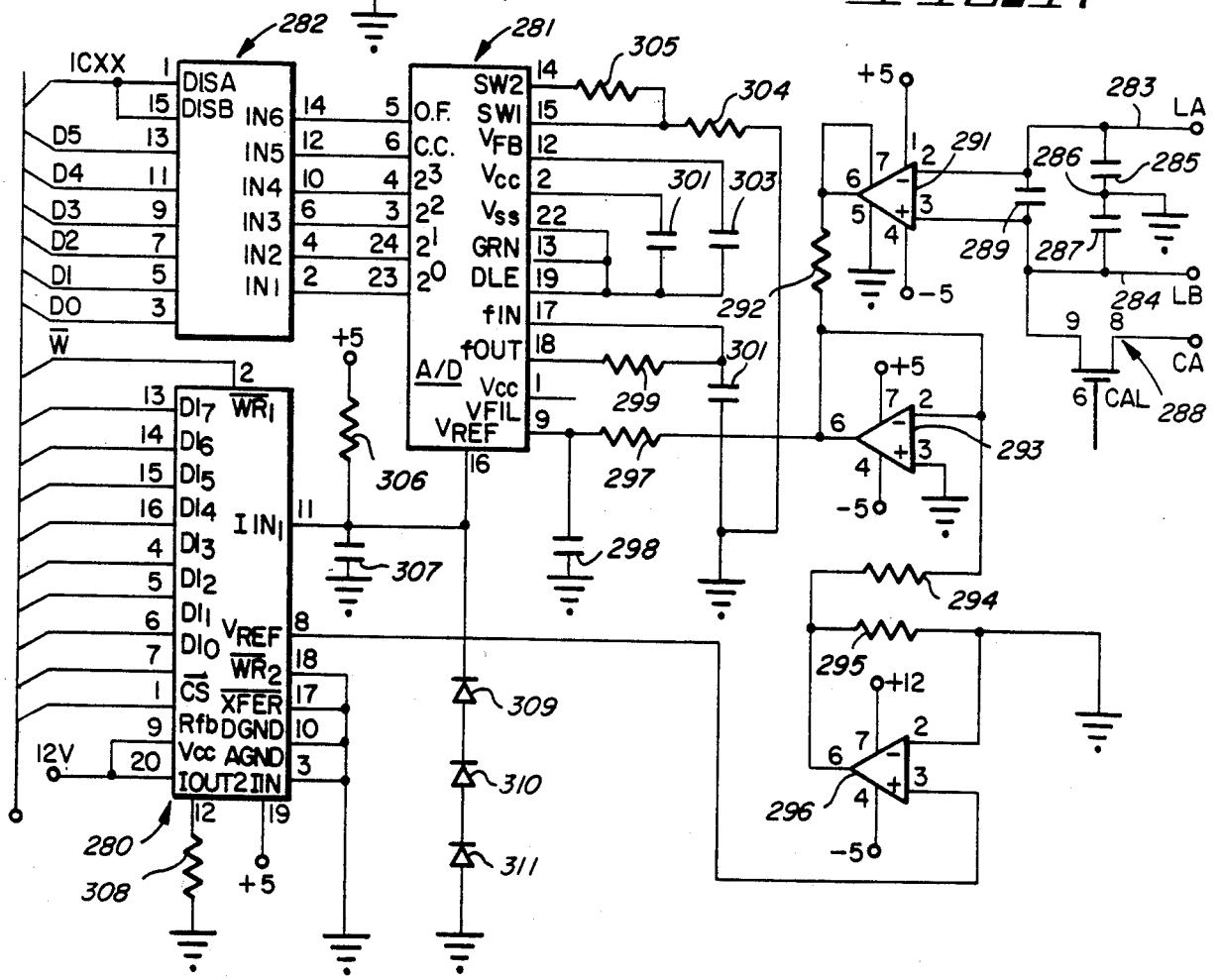
FIG. 10 shows the analog-to-digital converter system with auto-zero capability of the present invention.

FIG. 4 is a block diagram of the major control functions of the can cashier or collector system 41 of the present invention showing the interrelation between the various functions. In FIG. 4, block 133 represents the microprocessor unit or MPU and memory of the circuit of FIG. 6 while block 134 represents the decoding network of FIG. 7. The output of the decoding network of block 134 is used to provide unique addresses to the metal detection circuitry of block 135 as shown in FIG. 9; the load cell amplifier and auto zero network of block 136 as illustrated in FIG. 10; the permanent memory of block 137 which is further illustrated in FIG. 8; the output circuitry of block 139 as further shown in FIG. 11; and the input circuitry 141 as further described in FIG. 12. The power down circuitry of block 138 is associated with the permanent memory of block 137 and both are later described with reference to FIG. 8. The keyboard of block 142 is better described in FIG. 13 and supplies the keyboard output to the input circuitry of block 141 of FIG. 12. The heavy detect circuitry of block 143, as shown in FIG. 9, supplies a heavy detect signal to the input circuitry of block 141 as well. One output of the output circuitry of block 139 is supplied to the low voltage control of circuitry of block 140 and both are illustrated in FIG. 11. Another output is supplied from block 139 to the high voltage control, relays and motor detection circuitry of block 144, as illustrated in FIG. 14 while yet another output from block 139 is connected to the display panels of block 146 as shown in FIG. 16. The coin dispense and top detect circuitry of block 145 provides an input to the input circuitry of block 141 and the start of Parout signals are also supplied as an inlet to the circuit of block 141 as shwon in FIG. 15. The output of the load cell circuit of FIG. 18 is supplied as an input to the circuitry of block 136 and the power supply circuit for the system is represented by block 147 as further described with reference to FIG. 17.

The various functional blocks of the overall control system block diagram of FIG. 4 will each be described with respect to the structurre of specific circuits as set forth above and the structure and operation of the circuits will further describe and more carefully explain the structure and operation of the system of the present invention in terms of the circuitry and functional blocks represented in FIG. 4. The optical detectors or electromagnetic infrared radiation emitters/detectors of block 150, represented simply by optical detectors 40, 50 and 88 in FIG. 1, provide another input to the master control circuit of FIG. 151 and since they are conventionally known in the art, particular circuits are not provided for describing same, but they are described in copending application; Ser. No. 211,739, filed Dec. 1, 1980, by the present inventors and which is incorporated by reference herein.

A brief description of the control circuitry of FIG. 5 will now be given. A master controller represented by block 151 receives input signals from the load cell circuitry of block 152, the start button circuitry of block 153, the metal detector coils of block 154, the heavy detector of block 155, the keyboard of 156, the optical detectors of block 150, and the motor failure circuits of block 171. The outputs of the master controller 151 include outputs to a scale dump solenoid block 158, the separator dump solenoid 159, the out of money light 160, the penny meter and dispenser 161, the nickel meter and dispenser 162, and a quarter meter and dispener 163, and a token meter and dispenser 164. The master controller 151 also controls the operation of six motors including the crusher motor of block 165, the separator conveyor motor of block 166, the storage conveyor motor of block 167, the input conveyor motor of block 168, the centrifugal fan or blower motor of block 169, and the metering device motor of block 170. The the master controller 151 also outputs the signal to the separator trap door block 172 and to the scale dump door 74.

Figure 5:
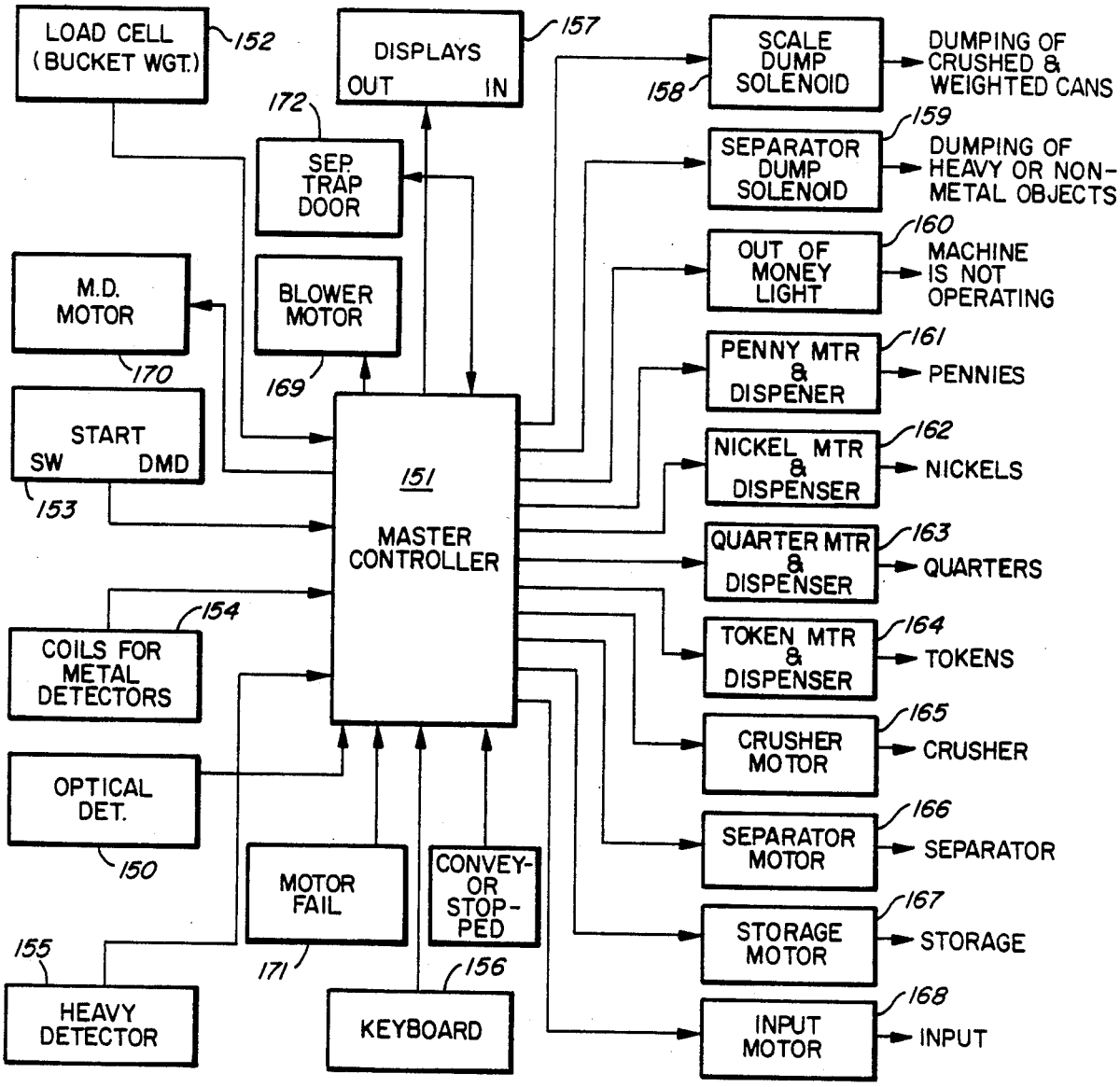
FIG. 5 is a system block diagram of the collection system of the present invention.

In the system of FIG. 5, the master controller of block 151 is, in actuality, the control system of FIG. 2. The basic operation of the present system will be discussed with reference to FIGS. 1, 2, 3, 4 and 5 and, as previously indicated, the circuits within the individual blocks of FIG. 4 will be hereinafter described in detail. The master controller of block 151 controls the energization of from four to six motors including the crusher motor of block 165, the separator conveyor motor of block 166, the storage conveyor motor of block 167, the input conveyor motor of block 168, the centrifugal fan or blower motor of block 169, and the interlocked metering device motor of block 170. In the preferred embodiment, the fan motor and metering motor may be manually controlled by service personnel or a key switch or the like could tell the MPU that the operators are in position to unload the storage bin, thereby opening the outlet, and energizing the fan and metereing device. Furthermore, the master controller or block 151 produces various control signals which cause the compensation dispenser associated with the vault 92 to dispense quarters, nickels, pennies, and tokens if desired, in the preferred embodiment. These coins or tokens pass from the vault 92 under control of the dispenser, not shown, and out of the coin or compensation slot 93. The coin dispenser may be, for example, a multi-hopper dispenser such as the one designated as Model 33-22-000, which is manufactured by National Rejectors, Inc., a division of UMC Industries, Inc., of St. Louis, Mo., and such dispensers incorporated by reference herein. Included within the displaces of block 157 is an out-of-order display which designate the function that is out of order as sensed by the controller 151 and provides the necessary display indication on display 95 for viewing by the depositor.

The master controller 151 is provided with a calibration circuit to calibrate the load cell of block 152 to make certain that it is properly calibrated such that it will accurately measure the weight of material deposited in the weighing hopper 73 and dumped via dumped or 75 into the funneling device 76. The master controller 151 senses various alarm signals produces as a result of any given mode or failure and the coin dispenser is provided with means for producing alarm signals if no coins are available to be dispensed and it could generate an alarm signal if the dispenser is jammed. In addition, one of the problems encountered in the prior art is that the ferrous metal receptacle or tin-coated steel can collection bin 56 or the non-metals and heavys collection bin or container 66 become filled which can create a jam and render the collection system 41 inoperative. Preferably, a self-adjusting digital metal detector can be mounted or operatively disposed in the plastic chute 55 proximate the outlet thereof which detects a steel can and generates a signal each time one is detected. This signal can be used by the controller to count steel cans and display the fact that a steel can was deposited to the depositor. This same signal could be used to tell when the steel can bin 56 is nearly full by the MPU counting cans going in or estimating weight going in, using a stored weight or number for the given sized can in use and signaling an alarm condition when the steel can receptical is full. Alternatively, a conventional electromagnetic infrared radiation detector or optical detector 88 is disposed proximate the input of the non-metal or heavys receptacle 66. Yet another electromagnetic infrared radiation detector or optical detector 40 is disposed proximate the entrance of the crusher input 67 to detect a jam or full hopper at the input of the crusher 68 and the detection signals from these optical detectors of block 150 are supplied back to the master controller 151 for further processing. When enough cans of ferrous metal falls into receptacle 56, it will break or interrupt the light beam across the entrance to the receptacle 46 generated by light detector 50. If the signal is continuous, meaning that the beam of electromagnetic energy at the entrance to receptacle 56 or 66 or crusher input 67 remains broken for a substantial period of time measured in fractions of a second, such a condition indicates to the master controller 151 that the given receptacle is full which is cause for a second alarm condition which will occur approximately thirty seconds later.

The electromagnetic or optical detector 40 mounted at the entrance to the crusher 68 will sense if a jam has occured. If a jam is sensed by the detector 40, the controller 151 prevents additional cans from being fed into the crusher 68 and the master controller 151 also produces a control signal to energize the solenoid which is not shown in FIG. 1 but which can be energized to open the door 75 of the weight bucket 73 after the contents of the bucket 73 have been weighed for emptying same knowledge of bucket weight, solenoid status, or a mercury switch may be used to detect whether the door is open or closed. The master controller 151 calculates the weight of the material dumped into the weighing bucket 73 from a continuous output of the digitized voltages across the load cell 74 of block 152 by comparing the weight of the weighing buckets 73 after dumping its contents by means of the open door 75 and the weight of the weighing bucket 73 with its contents immediately prior to its being dumped. Based upon the weight of material dumped from the bucket 73, the master controller 151 calculates the compensation to be payed to the depositor and energizes the appropriate coin dispensers of blocks 161, 162, 163, and 164 to provide the computed amount of compensation.

The system is provided with means for generating alarm signals which are fed back or supplied to the master controller 151 to enable the controller 151 to light the appropriate signal light or display on the external display 95 for viewing by the depositor so as to identify on the out-of-order or out-of-money display the particular cause of the present failure. For certain types of failures, the master controller 151 is programmed to respond by reenergizing the component which was the source of the alarm signal either on a one time basis or periodically, to see if the problem can be cleared or corrected or has been cleared or corrected, and if the problem is not solved, the master controller 151 will deenergize all of the motors and provide a signal at the display panel 95 which identifies to would-be depositors that the apparatus 41 is non-operational. The signaling device 98 in FIG. 1 may include, for example, a conventional direct-dialing telephonic device coupled to a leased line going to a remote monitoring station which dispatches maintenance men, trucks for hauling cans, and the like. The master controller 151 can send a digital message over the direct leased line once the remote dialer has dialed the preselected remote location number and trigger a particular one of several recorded messages, either audio or digital, advising the operator at the remote location, or the remote computer, if digital data is used, that one or more of the receptacles are full and need emptied, that a jam is present which cannot be cleared, that one or more motors have failed, that the main storage bin is full of crushed aluminum cans and needs emptied, and the like. Similarly, a radio-type transmitter or any communications device could send a signal directly to the remote location if it is not too far or to a nearby digital dialing arrangement which would function as described above. In any event, once the signal is sent to the remote location, a maintenance man or serviceman could come out to correct the motor failures, jams and the like or a truck could be dispatched to empty full receptacles or to empty the storage bin, as required. In fact, a commercially-available communications equipment device including telephonic, telex, fax, telegraphic, teletype, twixt, radio including AM, FM, PSK, FSK, PWM, voice or digital, microwave transmissions, laser and the like may be used in the present invention, limited primarily by cost considerations.

The hardware coupled to the master controller 151 is broken down in the block diagram of FIG. 5 and the individual circuits of the various blocks will be further described with reference to the remaining hardware circuits of the present application.

The start signal from block 153 advises the master controller 151 that a depositor has pressed the start button 94 on the front panel 43 of the collector assembly 41 or that metal detector 676 has detected cans being deposited and the master controller 151 reacts by starting the motors 165–168 and initializing, zeroing, the various counters and/or autocalibrating, weighing circuits, and the like used in the weight calculations. Additionally, signals from the heavy detector 155, the keyboard 156, the motor failure detector 171, the optical detectors 150, and the load cell 152 are fed to the master controller of block 151 for processing and appropriate action. Any input signal requiring a status display will appear via display block 157 and appear on the panel 95 of FIG. 1 to be viewed by the depositor. A separator trap door 172 responsive to a signal from the second digital metal detector of block 154 closes the trap door 65 of FIG. 1 whenever an aluminum can or the like has been detected and for opening the trap door 65 to drop or deposit heavys and non-metals into the trash receptacle 66. When an appropriate command is given from service personnel with a truck for carrying the stored aluminum cans to a recycling center or the like, the master controller and/or an operator starts both the blower motor 169 and the interlocked metering device motor 170 for pneumatically pumping or blowing all stored crushed aluminum cans out of the storage bin 111 and into the back of a truck or the like. The speed of rotation of the paddles of the metering means, as well as the size of the housing opening, size of paddles, space between paddles and strength of fan can be adjusted to selectively increase or decrease the rate at which the storage bin is emptied. When the master controller 151 operates the scale dump solenoid 158, the bucket door 75 opens to dump the weighed crushed alumium containers from the bucket into the funneling device 76 which, in turn, laterally transfers, conveys or slides the crushed aluminum cans onto the laterally positioned storage bin conveyor 77 for further transport to a point proximate the ceiling of the housing 42 for dumping the cans through a window 84 in the partition 83 and into the storage bin area 111. The individual circuits comprising the various blocks of the master controller 151 and, therefore, the blocks of the overall functional block diagram of FIG. 4, will now be described.

Figure 6:
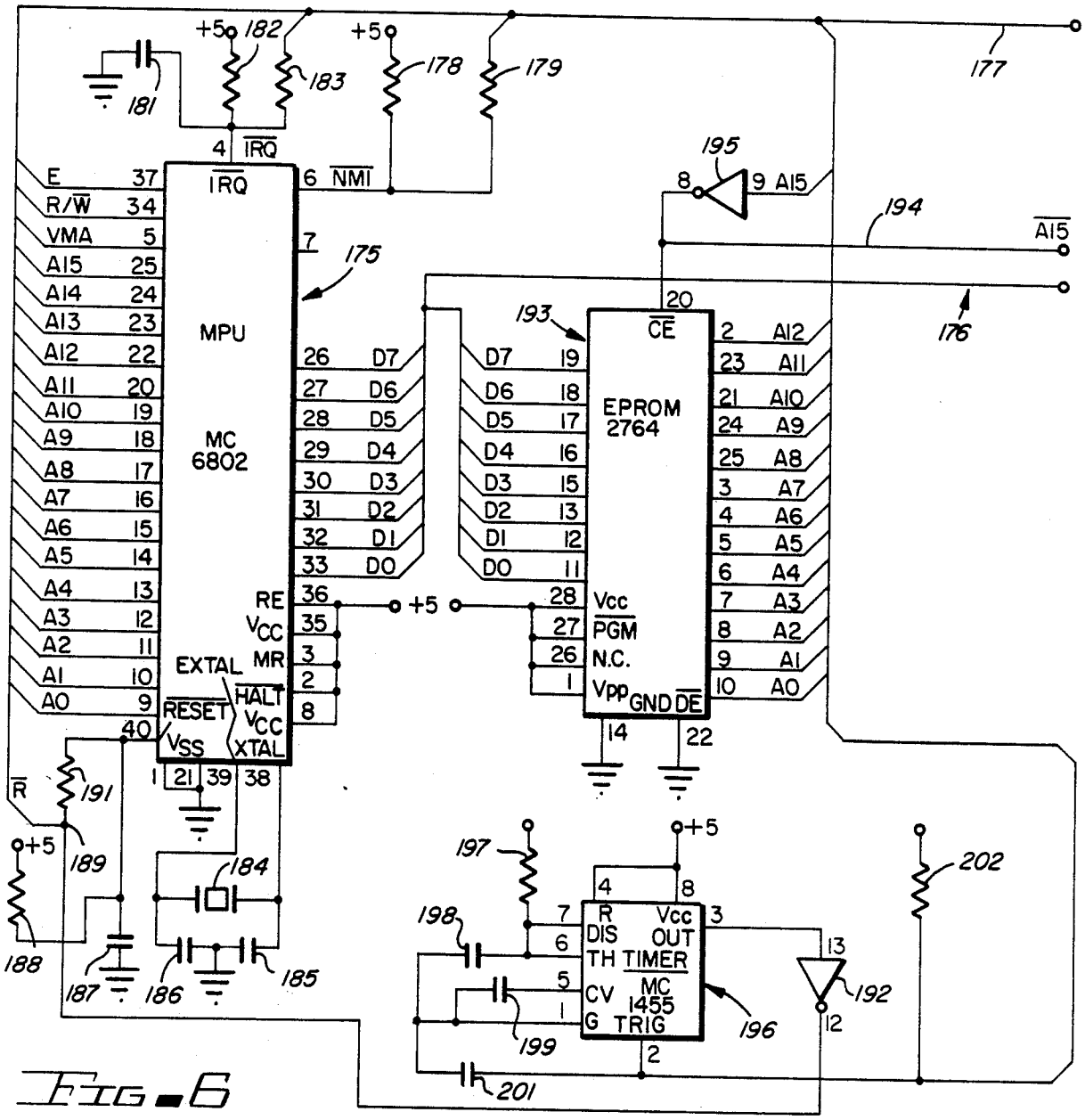
FIG. 6 is a block diagram of the MPU and associated memory of the control system of the present invention.

FIG. 6 shows the MPU and memory circuitry of block 133 of FIG. 4. The microprocessor or MPU 175 may be any commercially available microprocessor and in the preferred embodiment of the present invention, the MPU 175 is a standard microprocessor with internal clock and RAM such as a MC 6802 Manufactured by Motorola, Inc. The MPU 175 is a monolithic 8-BIT microprocessor that contains all the registers and accumulators of the standard Motorola MC-6800 plus an internal clock oscillator and driver on the same chip. Additionally, the 6802 has 128 bytes of RAM onboard and the first 32 bytes of RAM, which may be retained in the low power mode by utilizing the $V_{CC}$ standby input thus facilitating memory retention during a power down situation. The MPU 175 is completely software compatible with the entire M6800 family parts and is memory expandable.

As conventionally known, the internal structure of the MPU 175, not shown, but known in the art, includes address output buffers, data buffers, a program counter, a stack pointer, an index register, an "A" and "B" accumulator, a condition code register, an arithmetic logic unit (ALU), an instruction register, and an instruction decode and control unit. The inputs and outputs of MPU 175 will now be briefly described. The output pins P33, P32, P31, P30, P29, P28, P27 and P26 serve as the data inputs and outputs D0, D1, D2, D3, D4, D5, D6 and D7, respectively. These eight data pins are used for the data bus included in 176 which is bidirectional and used to transfer data to and from the MPU 175, the memories and the peripheral devices. The data bus has three state output buffers capable of driving one standard TTL load and it is placed in the three state mode when not active is low. Output pins P9 through P25 output the 16 address bits A0 through A15, is respectively, to the address bus included in 177. The outputs to the address bus are also 3-state bus drivers capable of driving one TTL load. The bus available signal at pin P7 is normally in the low state and is not connected in the present application. The power input $V_{CC}$ is taken at pin P8, the $\overline{HALT}$ input at pin P2, the Memory Ready input MR is taken from pin P3, the input power standby $V_{CC}$ STBY is taken from pin P35, and the RAM enable RE input at pin P36. Each of these five pins P8, P2, P3, P35 and P36 are connected directly to a plus five volt source of potential. With the signal at P2 maintained high, the $\overline{HALT}$ input remains high which prevents the machine from being halted. This input is normally tied high when it is not used to avoid improper operation of the MPU 175. The RAM ENABLE signal RE is a TTL-compatible RAM ENABLE input which controls the on-chip RAM of the microprocessor 175. When placed in the high state, the on-chip memory is enabled to respond to the MPU controls. In the low state, the RAM is disabled and hence pin P36 is used to disable reading and writing out of and into the on-chip RAM such as during a power-down situation. The RAM ENABLE signal RE must be low at least three cycles before $V_{CC}$ goes below 4.75 volts during a power down situation. If RE is tied to the high state when not in use, improper operation of the MPU 175 due to RE is avoided. Lastly, the memory ready signal MR at pin P3 is a TTL-compatible input control signal which enables the stretching of the ENABLE signal E on pin P37. When MR is tied high, E will be in normal operation but when MR is tied low, E will be stretched by integral multiples of half periods thus allowing the interface to slow memories and the like. The MR is tied high, as presently done, when not used to avoid improper operation of the MPU 175.

The non-maskable interrupt $\overline{NMI}$ at pin P6 is a low-going signal edge on which the input requests that a non-maskable interrupt sequence be generated within the microprocessor 175. The processor will complete the current instruction that is being executed before it recognizes the $\overline{NMI}$ signal and the interrupt mask bit in the condition code register has no effect on NMI. The index contents of the register, program counter, accumulators and condition code register within the MPU 175 are stored away on the memory stack and at the end of the cycle, a sixteen bit address will be loaded that points to a vectoring address which is located in specific memory locations. An address loaded at these locations cause the MPU to branch to a non-maskable interrupt routine in memory. $\overline{NMI}$ has a high impedance pull-up resistor internal to the chip and both are hardware interrupt lines that are sampled when E is high and will start the interrupt routine on a low E following the completion of an instruction. $\overline{NMI}$ should be tied high if not used but since it is used in the present invention, it is connected to a +5 volt source of potential through a resistor 178 and to the address bus 177 through a resistor 179.

The interrupt request input $\overline{IRQ}$ is at pin P4 and this is a level sensitive input which requests that an interrupt sequence be generated within the microprocessor 175. The processor will wait until it completes the current instruction that is being executed before it recognizes the request and at that time, if the interrupt mask bit in the condition code register is not set, the microprocessor 175 will begin the interrupt sequence. The contents of the index register, program counter, accumulators and condtion code register are again stored away on the stack and the MPU 175 will respond to the interrupt request by setting the interrupt mask bit high so that no further interrupts may occur while the present interrupt is being processed. At the end of the cycle, a sixteen bit address will be loaded onto the address bus 177 and the 16-bit address will point to a vectoring address located in specific memory locations. The address located at these memory locations causes the microprocessor 175 to execute an interrupt routine stored in memory. The $\overline{HALT}$ line must be placed in a high state for interrupts to be serviced but since the $\overline{HALT}$ input is tied high in the present apparatus, interrupt servicing is not inhibited. The $\overline{IRQ}$ has a high impedance pull-up resistor device internal to the chip but external resistors are also provided. The $\overline{IRQ}$ at pin P4 is connected through a capacitor 181 to ground, through a resistor 182 to a +5 volt source of potential, and through a resistor 183 to the address bus 177.

The enable signal E on pin P37 supplies the clock form the microprocessor 175 and for the rest of the system. This is a single phase TTL compatible clock which may be conditioned by a memory ready signal MR which is equivalent to the second phase input on some microprocessors. The read/write R/$\overline{W}$ signal is on pin P34 and this is a TTL compatible output signal to the peripheral and the memory devices to advise whether or not the microprocessor 175 is in a Read (high) or a Write (low) state. The normal standby state of the signal is Read (high) and when the processor is halted, it will be in the logical one state. The valid memory address VMA signal is on pin P5 and this output signal indicates to the peripheral devices and memories that there is a valid address on the address bus. During normal operation, this signal should be utilized for enabling peripheral interfaces. This is not a three-state signal and one standard TTL load may be driven directly by this active high signal.

The reset signal $\overline{RESET}$ is an input on pin P40 which is used to reset and start the MPU 175 from a power-down condition, resulting from a power failure or an initial start-up of the processor. When this line is low, the MPU 175 is inactive and the information in the registers will be lost. If a high level is detected on this input, this will signal to the MPU 175 to begin the restart sequence. This will start execution of a routine to initialize the processor from its reset condition and all the higher order address lines will be forced high. For the restart, the last two locations in memory will be used to load the program that is addressed by the program counter and during the restart routine, the interrupt mask bit is set and must be reset before the MPU 175 can be interrupted by $\overline{IRQ}$. When the reset is brought low, it must be held low for at least three clock cycles to allow the microprocessor 175 adequate time to respond internally to the reset. This is independent of the time required for the initial power-up reset. When the reset is released, it must go through the low-to-high threshold without bouncing, oscillating or otherwise causing erroneous reset signals which could cause improper MPU operations.

The microprocessor 175 also has an internal oscillator that may be crystal controlled. The EXTAL signal on pin P39 and the XTAL signal on PIN P38 are inputs to the internal oscillator. Pin P39 is externally driven by a TTL input signal if a separate clock is required and P38 is left open. An RC network is not directly usable as a frequency source but an RC network or CMOS oscillator will work as long as the TTL or CMOS drives the microprocessor 175. In the preferred embodiment disclosed herein, P1 and P21 are commonly coupled to ground. The XTAL signal on P38 is connected to one terminal of a crystal oscillator 184 and to one plate of a capacitor 185 whose opposite plate is connected to ground. The EXTAL signal on P39 is connected to the opposite terminal of the crystal 184 and to one plate of a capacitor 186 whose opposite plate is connected to ground. The reset at pin P40 is connected to ground through a capacitor 187 and to a +5 volt source of potential through a resistor 188. Furthermore, P40 is connected through a resistor 191 to a node 189. Node 189 supplies the signal R to the address bus 177 and node 189 is also connected to the output of an inverter 192.

FIG. 6 also shows a 64K (8K×8) ultraviolet erasable PROM 193. The EPROM 193 is an erasable programmable, read only memory such as an INTEL 2764 or the like. This is a system which operates on five volts, and contains 65,536 bits of ultraviolet erasable and electrically programmable READ ONLY MEMORY (ROM). An important feature of the EPROM 193 is the separate output control from the chip enable control $\overline{CE}$. The EPROM 193 has a standby mode to reduce power consumption without increasing access time. The data lines D0–D7 are taken from pins P11 through P19, respectively, and coupled to the data BUS 176. Pins P10, P9, P8, P7, P6, P5, P4, P3, P25, P24, P21, P23, and P2 correspond to the address inputs A0 through A12, respectively, which are coupled to the address BUS 177. The ground output P14 is connected to ground and the output enable $\overline{OE}$ PIN P22 is also connected to ground. The supply input $V_{CC}$ from pin P28, the program input $\overline{PGM}$, the no connection NC input P26, and the voltage input $V_{pp}$ at P1 are all commonly coupled together and to a +5 volt source of potential. Lastly, the $\overline{CE}$ or chip enable input at pin P20 is connected via lead 194 to receive the address signal $\overline{A15}$ and is also connected to the output of an inverter 195 whose input receives the address signal $\overline{A15}$ from the address bus 177.

The last portion of FIG. 6 includes the timing circuit or timer 196. In the preferred embodiment, the timer 196 may be, for example, a conventional MC 1455 monolithic timing circuit such as that manufactured by Motorola, Inc. The timer 196 is a highly stable controller capable of producing accurate time delays or oscillations. Additional terminals are provided for triggering or resetting, if desired, and in the time delay mode of operation, the time is precisely controlled by only one external resistor and capacitor. For astable operation as an oscillator, the free-running frequency and the duty cycle are accurately controlled by two external resistors and a single capacitor. This circuit may be triggered and reset on falling waveforms. The timing can be set from microseconds through hours; it can operate in both astable and monostable modes; it has an adjustable duty cycle, it is a high current output; it is temperature stable; and it has a normally-on and a normally-off output. Inside the timer 196 is a first comparator, a second comparator, a flip-flop and an output buffer. The voltage supply input $V_{CC}$ of pin 8 and the reset input R of P4 are commonly coupled together and to a +5 volt source of potential. The discharge signal at PIN P7 and the threshold signal TH at pin P6 are commonly coupled to one terminal of a resistor 197 whose opposite terminal connected to a source of potential +V. Pins P6 and P7 are also commonly connected to one plate of a capacitor 198 whose opposite plate is connected to one plate of a capacitor 201. The control voltage CV at P5 is connected to one plate of a capacitor 199 whose opposite plate is connected both to the ground input pin P1 and to the first plate of the capacitor 201. The second plate of capacitor 201 is conected to the trigger input of the timer 196 at P2 and is also connected through a resistor 202 to a source of potential V. Lastly, the opposite plate of capacitor 201 and the trigger input P2 is connected to the address bus 177. The output is taken from P3 and supplied to an input of an inverter 192 whose output is connected back to node 189 as previously described.

Briefly, FIG. 6 shows a microprocessor 175 including an internal RAM, an EPROM 193 and a timer 196. Some of the inputs provided to the MPU 175 include the inputs from the crystal 184, the RESET signal from the output P3 of the timer 196 and the inverting driver buffer 192, and the conventional interrupt request $\overline{IRQ}$ and non-maskable interrupt $\overline{NMI}$ as hereinafter described. The various programs for implementing the operation of the system of the present invention are stored in the EPROM 193 which also houses all of the vectors for system operation. Whenever the address line $\overline{A15}$ becomes high or true, the EPROM 193 is enabled by the inverting driver buffer 195 which supplies the signal to the chip enable $\overline{CE}$ input of the EPROM 193, as conventionally known.

Figure 7:
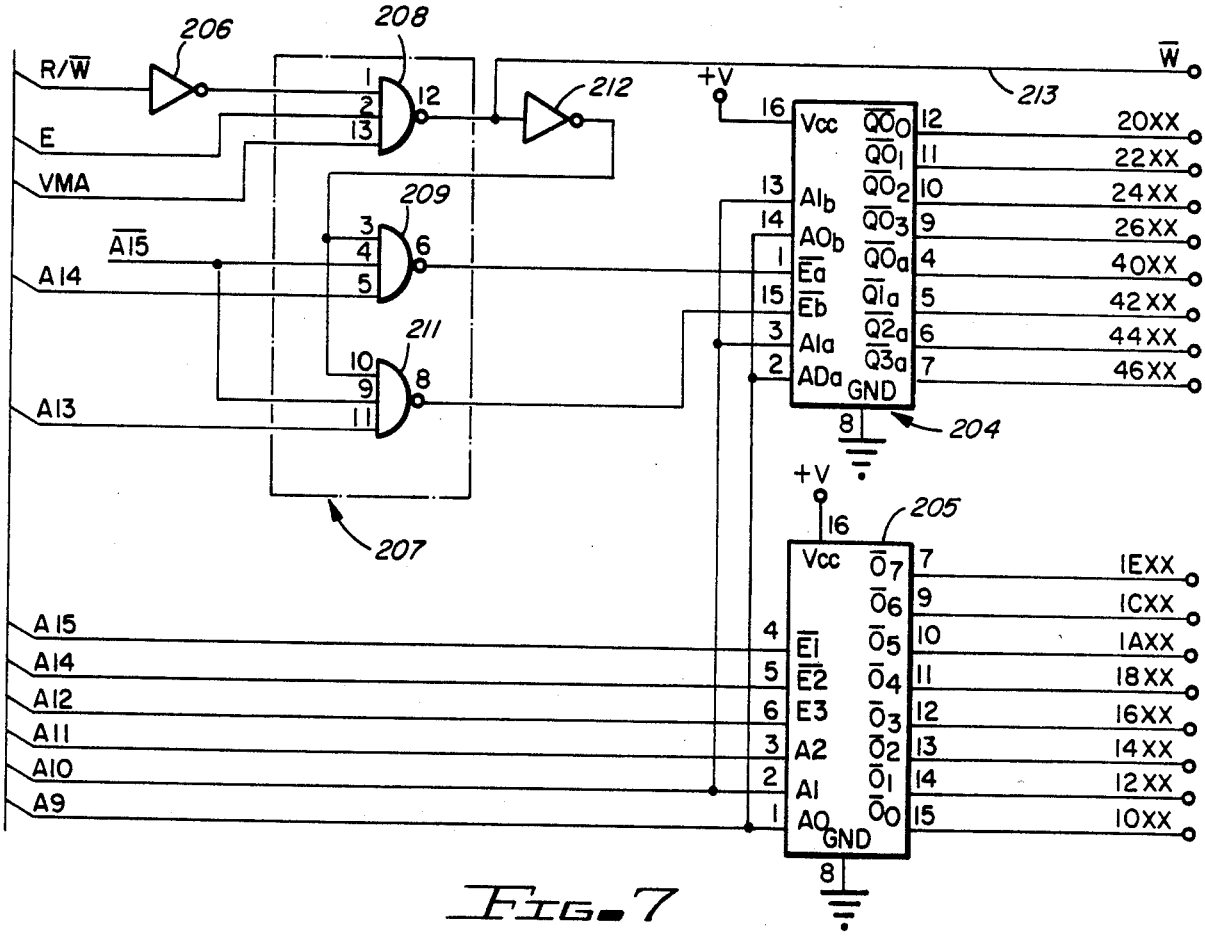
FIG. 7 is a logical block diagram of the decoding network of the control system of the present invention.

The decoder circuitry of block 134 of FIG. 4 will now be described with reference to FIG. 7. FIG. 7 shows a first decoder 204 and a second decoder 205. The first decoder 204 may be, for example, a SN74 LS139 such as that manufactured by Motorola, Inc. The decoder 204 is a high speed, dual one-of-four decoder/-multiplexer. The device has two independent internal decoders each accepting two inputs and providing four mutually exclusive, active low outputs. Each decoder has an active low enable input $\overline{E_a}$ and $\overline{E_b}$ which can be used as the data input for a four output demultiplexer and each half of the device can be used as a function generator. The address inputs for the first half of the decoder 204 are the signals $A0_a$ and $A1_a$ to pins P2 and P3, respectively, while the address inputs for the second half or second portion of decoder 204 are $A0_b$ and $A1_b$ to pins P14 and P13, respectively. The enable signal for the first decoder portion is represented by $\overline{E_a}$ at pin P1 and $\overline{E_b}$ at P15 is the enable signal for the second decoder portion of the decoder 204. The four active low outputs for the first half of the decoder 204 are given by $\overline{Q0_a}$ $\overline{Q1_a}$ $\overline{Q2_a}$ and $\overline{Q3_a}$ which are output from pins P4, P5, P6, and P7, respectively. Similarly, the four outputs for the second decoder portion of decoder 204 are represented by $\overline{Q0_b}$ $\overline{Q1_b}$ $\overline{Q2_b}$ $\overline{Q3_b}$ which are output from pins P12, P11, P10, and P9, respectively. A source of potential +V is coupled to the $V_{CC}$ input at P16 and the P8 ground output is connected directly to ground.

The second decoder 205 may be, for example, a SN74 LS138 manufactured by Motorola, Inc. This device is a high speed one-of-eight decoder/multiplexer which is ideally suited for high speed bipolar memory chip select address decoding. The multiple input enables allow parallel expansion to a one-of-twenty-four decoder using just three inverters. The $V_{CC}$ power input is connected to a source of potential +V through pin P16 while ground pin P8 is connected directly to ground. The active low enable inputs $\overline{E1}$ and $\overline{E2}$ are supplied at P4 and P5, respectively while the active high input E3 is at pin P6. The three address inputs A0, A1, and A2 are supplied to pins P1, P2, and P3, respectively. The eight active low outputs designated $\overline{O_o}$ through $\overline{O_7}$ are taken from pins P15, P14, P13, P12, P11, P10, P9, and P7, respectively. Associated with the decoders 204 and 205 is a gating network 207. The read/write signal R/$\overline{W}$ is taken from the address bus and supplied to the input of an inverter buffer 206 whose output is connected to a first input of a three input logical NAND gate 208 whose output is connected to the input of an inverter 212. The write signal $\overline{W}$ is also supplied via lead 213 to the input of inverter buffer 212 and the output of inverter buffer 212 supplies the first input of a second logical NAND gate 209 and a first input of a third logical NAND gate 211. The second input of NAND gate 208 is the enable signal E while the third input of NAND gate 208 is the VMA command from the microprocessor 175. The second input of the second NAND gate 209 is the address signal A15 which is also connected as a second input to the third logical NAND gate 211. The third and last logical input to NAND gate 209 is the address signal A14 while the third and last input of logical NAND gate 211 is the address signal A13. The output of the second logical NAND gate 209 is connected to $\overline{E_a}$ at P1 of the first decoder 204 for enabling the first decoder portion thereof while the output of the third logical NAND gate 211 is supplied to $\overline{E_b}$ at P15 to enable the second decoder portion of decoder 204. The particular output address from the second decoder 205 is determined by the three binary address signals A0, A1, and A2 and the system is enabled by the A1, A2, or A3 commands in response to the address signals $\overline{A15}$, A14, and A12, respectively.

The purpose of the decoding system of FIG. 7 is to achieve unique addresses for each of the desired functions with the exception of the EPROM 193. The unique addresses are taken from the outputs of the decoders 204 and 205 as described above, and the coding requires both decoders. Additional selective decoding is accomplished with the set of triple input NAND gate 207 and the valid memory address VMA signal from the processor 175. The combination of the write signal R/$\overline{W}$, the enable signal E and VMA is used as an input to the second and third NAND gate 209, 211 to assure A15 and A14 are not present when the function is activated. The other NAND gate 208 is activated when A13 is true with $\overline{A15}$ and the combined right, enable and VMA signal. Decoder 205 is active with $\overline{A15}$ true, A14 not true, but A12 true with selection on A11, A10 and A9. The decoded output signals are used throughout the system to guarantee that only the desired function is activated.

Figure 8:
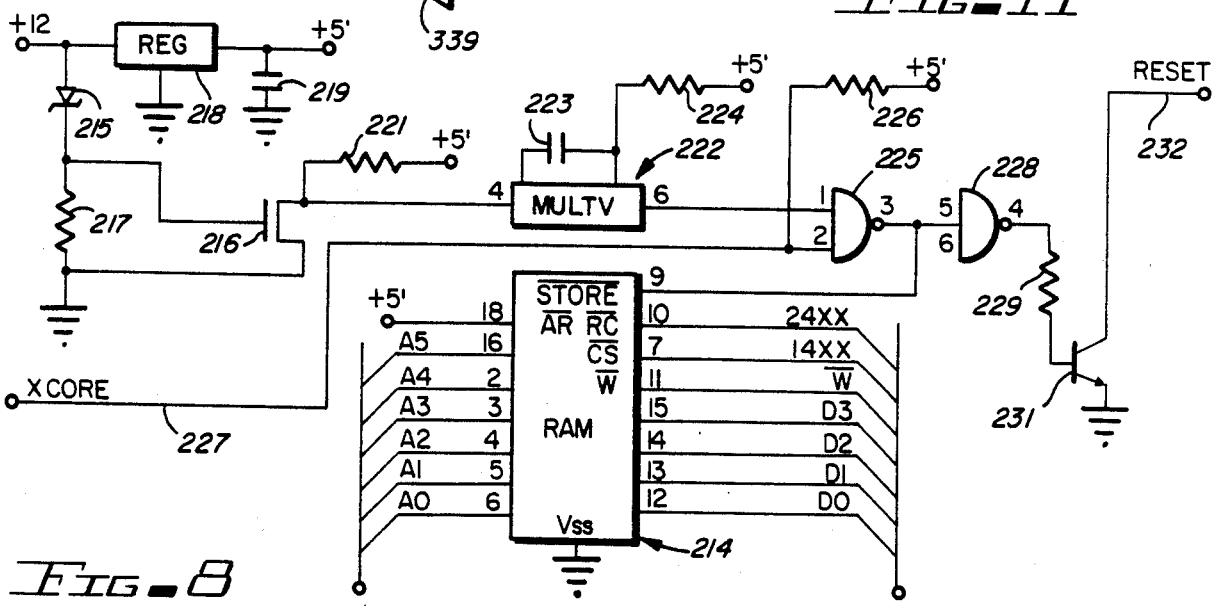
FIG. 8 is a block diagram of the permanent memory and power-down control circuit of the present invention.

FIG. 8 shows the circuitry represented by the permanent memory block 137 and power down block 138 of the master control sytem of FIG. 4. In FIG. 8, the permanent memory 137 includes 64×4 bit non-volatile static RAM 214. In the preferred embodiment of the present invention, the RAM 214 is a conventional non-volatile static RAM such as an X2210-30 manufactured by Xicor, Inc. The RAM 214 contains 512 bytes of memory organized as a conventional 256 bits static RAM overlayed bit-for-bit with a non-volatile 256 bit electrically erasable PROM. Non-volatile data can be stored in the $E^2$PROM and at the same time independent data can be accessed in the RAM memory. At any time data can be transferred back and forth between the RAM and the $E^2$PROM by single store and array recall signals. A single five volt supply is the only power required and it is fed to the RAM 214 via pin P18. One simple TTL signal saves the entire RAM data base. A snap-shot non-volatile copy of all RAM data is internally stored safe in the non-volatile static RAM portion of memory without power and can be recalled to the RAM when power is returned. No battery back-up is required. The address bus supplies the address bits A0 through A5 to the memory input pins P6, P5, P4, P3, P2, and P16, respectively, and the four data bits are read into the memory and out of the memory to the data bus as data bits D0, D1, D2, and D3 on pins P12, P13, P14, and P15, respectively. The write signal $\overline{W}$ is supplied to input P11 and the store output signal $\overline{STORE}$ from P9 will be used as hereinafter described. The $\overline{CS}$ or chip select input is taken to P7 and the array recall signal $\overline{AR}$ $\overline{RC}$ is taken to P10. Therefore, the RAM 214 can be addressed by the six address bits A0–A5 and data read into or out of the RAM portion and/or non-volatile static RAM portion of memory 214, as desired.

A +12 volt source of potential is coupled to the anode of a zener diode 215 whose cathode is connected directly to the gate electrode of an FET transistor 216. The cathode of zener diode 215 is also connected to one terminal of a resistor 217 whose opposite terminal is connected to ground. One current-carrying electrode of the FET 216 is also connected directly to ground and the opposite current-carrying electrode is connected to a +5 volt source of potential through a resistor 221. A +5 volt source of potential is also supplied to the input of a voltage regulator 218. Regulator 218 is, in the preferred embodiment of the present invention a conventional positive voltage regulator such as a MC7805 manufactured by Motorola, Inc. This is a three terminal positive voltage regulator which includes a monolithic integrated circuit designed as a fixed-voltage regulator for a wide variety of applications. Various applications enable the regulator to employ internal current-limiting, thermal shut down, and safe area compensation in order to make the regulator 218 essentially blow-out proof. The ground terminal of the regulator 218 is connected directly to ground and the third terminal is connected directly to a +5 volt source of potential and to ground through a capacitor 219.

The signal on the second current-carrying electrode of the FET transistor 216 is supplied to the trigger input of a conventional astable multivibrator 222. In the preferred embodiment of the present invention, the multivibrator 222 is a conventional MC 14538 device manufactured by Motorola, Inc. and having one terminal connected to another terminal through a capacitor 223 and the second terminal is connected to a +5 volt source of potential through a resistor 224. The output of the multivibrator 222 is supplied to one input of a two input logical NAND gate 225 whose opposite input is connected to a +5 volt source of potential through a resistor 226 and to receive the signal XCORE via lead 227. The output of NAND gate 225 supplies the $\overline{\text{STORE}}$ signal to P9 of the RAM 214 and is also supplied to the commonly coupled inputs of NAND gate 228 which functions as an inverter and supplies the output through a resistor 229 to the base of an NPN transistor 231. The emitter of transistor 231 is grounded and the collector is used to supply the reset signal via lead 232.

The power down memory 214 is a non-volatile static memory that stores away all working data each time the power goes off or the power fails or the like. A power failure or impending power failure is detected using the single zener diode 215 combined with the FET transistor 216. When the +12 volt power decreases or falls below approximately a power line voltage equivalent to about 90 VAC as input power, the output of the FET 216 goes high if it has been previously enabled by the MPU 175 causing the reset line of the MPU 175 to be pulled low and the Store signal STORE will be generated and sent to the permanent memory 214 causing the memory 214 to transfer the data in its working memory portion into its non-volatile static RAM portion for preservation during a power out period. When the zener diode 215 causes the FET transistor 216 to conduct, the monostable multivibrator 222 will shape the signal and apply it to one input of NAND gate 225 and when NAND gate 225 is enabled and, conducts, the output is transferred to P9 of the RAM 214 which is the STORE input causing the transfer from working memory to non-volatile static RAM while the second NAND gate 228 inverts the signal and causes transistor 221 to be switched on thereby pulling the reset line 232 low. The low reset signal is supplied back to the microprocessor 175 via lead 232 causing the processor to implement the reset cycle. It is important that the memory 214 save the data stored therein during a power failure, a power off situation, a power down situation, a low power situation, or in the event that any of the circuit boards are pulled out or unplugged with power on, so that the data will not be lost but will be retained within the non-volatile static memory portion of memory 214 until the system is again operational.

FIG. 9 represents the metal detection and heavys detection circuitry of block 135 of FIG. 4. At the heart of FIG. 9 is a programmable timer or PTM 233. In the preferred embodiment of the present invention, PTM 233 is a conventional programmable timer module such as an MC6840 manufactured by Motorola, Inc. The timer 233 is designed to provide variable system time intervals. It has three 16 bit binary counters, three corresponding control registers and a status register. These counters are all under software control and may be used to cause system interrupts and/or to generate output signals. The device may be used for frequency measurements, event counting, interval measuring, and similar tasks. It can also be used to generate square waves, gated delay signals, single pulses of a controlled duration and pulse width modulation signals as well as system interrupts. The eight data outputs D0–D7 are taken from pins P25–P18, respectively. Three address signals A0, A1, and A2 are supplied to pins P10, P11, and P12, respectively, which represent the RS0, RS1, and RS2 inputs of the timer 233. The inputs RS0, RS1, and RS2 are the register select lines and these inputs are used in conjunction with the Read/Write signal R/$\overline{\text{W}}$ to select specific internal registers, counters and latches. The timer 233 is accessed through the microprocessor 175 load and store operation in much the same manner as a memory device or the like. The enable signal E is applied to pin P17 and used to synchronize data transfer between the microprocessor unit 175 and the PTM timer 233. It also performs synchronization between the timer 233 and any external clock, reset, or gate input thereto. The $\overline{\text{IRQ}}$ input at pin P9 is such that an active low interrupt request signal is normally tied directly or through priority interrupt circuitry to the $\overline{\text{IRQ}}$ input of the microprocessor 175. Any of several interrupt requests can be used at this port such as NMI. In the present example, the NMI signal or non-maskable interrupt is supplied to the $\overline{\text{IRQ}}$ input at P9. The Write signal $\overline{\text{W}}$ is supplied to the P13 input and this signal generated by the microprocessor 175 to control the direction of data transfer on the data bus. With the timer 233 selected, a low state on the timer read/write line enables the input buffers and data is transferred from the MPU to the timer on the trailing edge of an enable E signal. Alternately, if $\overline{\text{W}}$ equals one and the enable signal is high, data is transferred from the timer 233 and read by the microprocessor 175. Pin P15 is coupled to the chip select input CSO and although the system has two different chip select inputs, only the one need be used due to the unique address from the output of the decoder circuit of FIG. 7. The power input Vcc at pin P14 is connected directly to a +5 volt source of potential and the ground output $V_{SS}$ is connected via P1 to ground. The first and second clock inputs C1 and C2 on pins P28 and P4, respectively, are asynchronous input lines to the timer 233. The signals coming in on C1 and C2 decrement the internal timers, timer number 1 and timer number 2, respectively and the high and low levels of the signals at the inputs must be stable for at least one system clock period plus the sum of the step up and hole times for the inputs. The asynchronous clock rate can vary from DC to the limit imposed by the enable E setup and hold time, as conventionally known. The external clock inputs C1 and C2 are clocked in by the Enable pulses with three Enable periods used to synchronize and process the external clock. The fourth enable pulse decrements the internal counter which does not effect the input frequency but merely creates a delay between the clock input transition and the internal recognition of that transition by the timer.

A better understanding of the use of the timer 233 of FIG. 9 will be hereinafter described with the brief operational description of the overall circuit of FIG. 9.

The metal detector system includes a first inductive coil or inductor 234, a second, separate, inductive coil or inductor portion 235, one terminal on each inductaor 234 and 235 is operatively coupled directly via node 236 to a +5 V source of potential. One terminal of the first inductive coil is coupled through node 236 and one terminal of the second inductive coil 235 is connected to node 236. Node 236 is connected to a +5 volt source of potential. The opposite terminal of inductor 234 is connected to one plate of a capacitor 237. The opposite terminal of coil 234 is also connected through a capacitor 238 to ground through the parallel combination of capacitor 241 and resistor 242. Further, the second terminal of the inductor 234 is connected to the collector of an NPN transistor 239 whose emitter is connected to ground through the parallel combination of capacitor 241 and resistor 242 and whose emitter is also connected to one plate of a capacitor 244 whose opposite plate is connected back to the base of transistor 239. A +5 volt source of potential is connected to the base of transistor 239 through a resistor 245 and the base of transistor 239 is connected to ground through a resistor 243. The opposite plate of capacitor 237 is connected to ground through a resistor 246, to a +5 volt source of potential through a resistor 247 and to the input of a schmitt trigger 248 whose output is connected directly to the C2 input of the timer 233 at P4.

The opposite terminal of the second inductor 235 is connected to one plate of a capacitor 249; to one plate of a capacitor 254, and to the collector of an NPN transistor 255. The opposite plate of capacitor 254 is connected to ground through the parallel combination of capacitor 261 and resistor 259. The base of transistor 255 is connected to a +5 volt source of potential through a resistor 256 and the emitter of transistor 255 is connected to ground through the parallel combination of resistor 259 and capacitor 261. The emitter of transistor 255 is also connected to one plate of a capacitor 257 whose opposite plate is connected (1) to ground through a resistor 258, (2) to the +5 volt source of potential through a resistor 245, and (3) directly to the base of transistor 255. The opposite plate of capacitor 249 is connected to ground through a resistor 251, to a +5 volt source of potential through a resistor 252, and to the input of a Schmitt trigger 253 whose output is connected directly to the C1 input of the timer 233 at P28.

A signal indicative of ½ AC is supplied through a resistor 262 to ground through a resistor 263 and to the gate electrode of an FET transistor 264. One current-carrying electrode of transistor 264 is connected to ground and the opposite current-carrying electrode is connected to a +5 volt source of potential through a resistor 265 and to the input of an inverting drive buffer 266 whose output supplies the interrupt request signal IRQ a zero-crossing on lead 267 to the microprocessor 175 as previously described. The heavy detection signal is supplied by an input lead which is connected to a +5 volt source of potential through a resistor 269 and through a resistor 269 to the trigger input of a monostable multivibrator 270. The trigger input of the monostable multivibrator 270 is taken at pin P11 and is connected to ground through a capacitor 271 and via lead 272 to both inputs of a logical NOR gate 275. A +5 volt source of potential is connected through a resistor 274 to one input to the monostable multivibrator 270 and a second input is connected to the first input through a capacitor 273. The monostable multivibrator output from pin P10 is connected directly to a first input of a second logical NOR gate 276 whose other input is taken from the output of logical NOR gate 275. The output of logical NOR gate 276 is supplied via lead 277 and is used to transmit the heavy indication signal HVY.

Very briefly the metal detector and heavy detector circuitry of FIG. 9 function follows: The metal detector circuitry uses the timer counter 233 and a modified Colpitts ocillator to detect changes in frequency or phase shift due to the presence of metal. Since the entire detector system of FIG. 9 is digital, phase shifts as small as 0.02 degrees are possible with reasonable sample times. Problems usually associated with drift and changes in frequency are totally eliminated by the continued monitoring of the nominal counts while the apparatus is not in cycle. The oscillator is very stable. The metal detector portion utilizes transistor-based circuits incorporating transistors 239 and 255 in combination with the coils 234 and 235 that provide a sine wave which is squared via schmitt trigger 248 and 253 to produce a level digital waveform which is supplied to the timer/counter 233. The output of the counter/timer 233 is interfaced directly to the MPU and memory systems. The heavy detector includes a monostable multivibrator 270 to make sure that the heavy special is present long enough to ensure that a valid heavy object has been encountered.

FIG. 10 represents the load cell amplifiers and auto zero system of block 136 of FIG. 4. The major components of FIG. 10 include a double-buffered D-to-A converter or Digital-to-Analog Converter 280; an Analog-to-Digital or A/D Converter 281; and a non-inverting three-state buffer 282. In the preferred embodiment, the D/A converter 280 is a conventional D/A converter such as a DAC 0832 manufactured by the National Semiconductor Corp. The eight data ports for passing data to and receiving data from the data bus represented by data signals DI0 through D17 and are taken from pins P7, P6, P5, P4, P16, P15, P14, and P13, respectively. The read/write signal $\overline{WR}_1$ is received on pin P2 and the signal Rfb and $V_{cc}$ are supplied into P9 and P20 which are commonly coupled to a +12 volt source of potential. The output $I_{out2}$ is taken from P12 and coupled to ground through a resistor 308. The chip select input $\overline{CS}$ at $P_1$ is coupled to the bus. The signal $I_{LE}$ is supplied to the input pin P19 from a +5 volt source of potential. The analog ground signal at P3, the digital ground signal at P10, and the signal XFER at P10, P17, and P18, respectively, which are commonly coupled to ground. The reference output $V_{ref}$ is taken from a pin P8 as hereinafter described and the signal $I_{out1}$ is taken from P11.

The analog-to-digital converter A/D 281 is a conventional analog-to-digital converter such as an ADC 3711 microprocessor compatible A/D converter as manufactured by the National Semiconductor Corp. The analog-to-digital converter 281 uses a pulse modulation analog-to-digital conversion technique which requires no external precision components and permits the use of a reference voltage of the same polarity as the input voltage. A single +5 volt power supply is required and isolating the supply allows conversion of both positive and negative voltages. The conversion rate is set by an internal oscillator and the frequency of the oscillator can be set by an external RC network or the oscillator can be driven from an external frequency source. When using the external RC network, a square wave output is also available. The A to D converter 281 uses BCD data and BCD digits are selected on demand by a two digit select D0, D1 inputs which are latched by a low-to-high transition on the digit latch enable DLE input P19 and which will remain latched as long as the DLE remains high. The powers of two including $2^0$, $2^1$, $2^2$, and $2^3$ are available on pins P23, P24, P3, P4, respectively. The conversion complete signal C.C is available on P6, the O.F overflow signal is available on P5, the switching signals SW1 and SW2 are available on pins P15 and P14, respectively. The feedback voltage $V_{FB}$ is available on pin P12, $V_{cc}$ is available on P2, $V_{ss}$ is available on P22, analog ground is available on P13, and DLE or digit latch enable is available on P19. P22, P13, and P19 are commony coupled together for use as hereinafter described. The input $f_{in}$ is supplied to P17 and the output $f_{out}$ is on P18. The secondary supply $V_{cc}$ is on P1 which is not used and $V_{fil}$ is on P9. Furthermore, the reference input $V_{REF}$ is provided at P16 hereinafter described.

The hex non-inverting three state buffer 282 of the present invention may be, for example, a conventional buffer such as a MC 14503B manufactured by Motorola, Inc. The buffer 282 is a hex non-inverting buffer with three state outputs and a high current source and sink capability. The three state output makes it useful in bussing applications. Two disable controls are provided. A high level on disable "A" input DISA causes the outputs of buffers 1–4 to go into a high impedance state and a high level on disable "B" input DISB causes the outputs of the buffers 5 and 6 to go into a high impedance state. The disable A input DISA is on P1 and the disable B input DISB is on P15 and both inputs are commonly coupled together to receive the special address code ICXX from the decoder circuitry of FIG. 7 via the bus structure. The data output signals D0–D5 are taken from pins P3, P5, P7, P9, P11, and P13, respectively. The buffer inputs IN1–IN6 are received at pins P2, P4, P6, P10, P12, and P14, respectively.

In the present invention, the input IN1 at P2 is directly connected to the P23 output $2^0$ of the A-D converter 281; the IN2 input at P4 of buffer 282 is connected directly to the P24 output $2^1$ of converter 281; the IN3 input at P6 of buffer 282 is connected directly to the P3 output $2^2$ of the A-D converter 281, and the IN4 input at P10 of buffer 282 is connected directly to the P4 output $2^3$ of the A-D converter 281. Therefore, the powers of two will be selectively transferred to the inputs of the buffer 282 from the outputs of the analog-to-digital converter 281. Additionally, the IN5 input at P12 of buffer 282 is connected to C.C output at P6 of the analog-to-digital converter 281 for receiving the conversion complete signal C.C. and the IN6 input at P14 of the buffer 282 is connected to P5 of the A-D converter 281 for receiving the overflow signal O.F.

The signal L,A, from the load cell is supplied via lead 283 to one plate of a capacitor 285 whose opposite plate is coupled to ground at node 286. Node 286 is also coupled to one plate of a capacitor 287 whose opposite plate is connected to lead 284 which receives the load cell signal LB as hereinafter described. The lead 284 is also connected to one current-carrying electrode of a FET transistor 288 whose opposite current-carrying electrode is coupled to receive the signal CA. The gate electrode of FET 288 is coupled to the signal CAL. The first current-carrying electrode of FET 288 is also connected to one plate of a capacitor 289 whose opposite plate is connected back to lead 283. The first plate of capacitor 289 supplies the inverting input to the amplifier 291 which, in the preferred embodiment of the present invention, may be a conventionally available amplifier such as a LM163 manufactured by the National Semiconductor Corp. The non-inverting input to amplifier 291 is taken from the opposite plate of capacitor 289. The negative power input to P4 is connected to a −5 volt source of potential while the positive supply input at P1 is connected to a +5 volt source of potential. The ground output is coupled from P5 directly to ground and the sense output at P7 is coupled back to the output from P6. The inverting input at P2 is connected directly to lead 283 at the opposite plate of capacitor 289 and the lead 284 is connected to the first plate of capacitor 289 and to the non-inverting input at P3. The output of the amplifier 291 from P6 is supplied through a resistor 292 to the output of a second amplifier 293 and to the inverting input at P2 of the amplifier 293. In the preferred embodiment, the amplifier 293 is a conventional low offset, low drift JFET input operational amplifier such as a LF411 manufactured by the National Semiconductor Corp. The non-inverting input at pin 3 of amplifier 293 is connected directly to ground, the power supply input is connected from P7 to the +5 volts source of potential and the negative supply from P4 to the −5 volts source of potential. The output is taken from P6 and supplied to one terminal of a resistor 297 whose opposite terminal is connected through P9 to the $V_{fil}$ input of the anlog to digital converter 281. P9 is also connected to ground through a capacitor 298.

The output $f_{out}$ from P18 is connected through a resistor 299 to one plate of a capacitor 301 and the signal $f_{in}$ is taken from P17 directly to the first plate of capacitor 301 and the opposite plate of capacitor 301 is grounded, is connected through resistor 299 to input fin at P17, and is also connected through a resistor 304 to the P15 or SW1 input of the analog-to-digital converter 281 and through a second resistor 305 to P14 or the SW2 input of the A-D converter 281. The outputs P22, P13, and P19 are commonly coupled through a first capacitor 302 back to P2 and input $V_{cc}$ and through a second capacitor 303 to P12 and the $V_{FB}$ input. The inverting input of the operational amplifier 293 is also connected through a resistor 294 to the output P6 of a third amplifier 296 which, in the preferred embodiment of the present invention, is identical to the operational amplifier 293. The signal at the output of amplifier 296 is connected back through a feedback resistor 295 to ground and to the inverting input at P2 of the amplifier 296. The positive voltage input is connected from P7 to a +12 volt source of potential and the negative input from P4 to a minus 5 volt source of potential. The P6 output of the operational amplifier 296, as previously described, is connected back up to the feedback resistor 295 to the inverting input P2 and through a resistor 294 back to the inverting input P2 of amplifier 293. The non-inverting input of amplifier 296 is connected directly to the P8 pin of the digital-to-analog converter 280 reference for the voltage signal $V_{ref}$. P9 and P20 of the digital-to-analog converter 280 are commonly coupled together to a plus 12 volt source of potential while P19 is connected to a plus 5 volt source of potential and P12 is connected to ground through a resistor 308. P3, P10, P17, and P18 are connected commonly to ground and P11, as previously described is connected to the junction of the resistor 306 and capacitor 307 whwich is then connected directly to the $V_{REF}$ input at P16 of A/D 281. $V_{REF}$ at P16 is also connected to the cathode of a first diode 309 whose anode is connected to the cathode of a second diode 310 whose anode is connected to the cathode of a third diode 311 whose anode is grounded.

FIG. 10 generally shows the load cell amplifiers and the auto zero circuitry or system together with the analog-to-digital converter of block 136 of FIG. 4. The signals LA and LB as well as the signals CA and CAL from the load cell are applied to the input of the instrument amplifier 291 which amplifies the input signal by a factor of approximately 100. This signal is summed or added with the output of the operational amplifiers 293 and 296. The output of the analog-to-digital converter 281 is interfaced to the microprocessor unit 175 through the buffer 282. Adjustments to auto zero in order to put it into the proper range is accomplished through using the digital-to-analog converter 280 and latching the digital-to-analog converter 280. The output of the digital-to-analog converter 280 is amplified by amplifier 296 to provide a resulting voltage between 50 and 150 millivolts. The reference setting for the analog-to-digital converter 281 and the digital-to-analog converter 280 is set using the diode array comprising diodes 309, 310, and 311. The full input voltage range for the analog-to-digital converter 281 is set to be about 400 millivolts while the corresponding output digital value of the analog-to-digital converter is four thousand. Thus, at its input, each millivolt is represented by ten counts and one pound is represented by approximately six hundred counts. This means that the potential accuracy of this system is one/six hundredth of a pound. Since one can represents an input voltage change of about 25 microvolts, it produces 2.5 millivolts at the input of the analog-to-digital converter 281 and the resulting digital change is a count of 25. The over voltage range of the analog to digital converter 281 is four hundred millivolts so that when the zero adjust is at 150 millivolts, four pounds can be placed in the bucket before overflow of the analog to digital converter 281 occurs. When the adjustment is at the low end, nearly six pounds can be placed in the bucket without overflow of the analog to digital converter 281 occuring. In addition, for accurate weighing for a wide range of variables, a sample or reference resistor that has a voltage displacement value exactly equivalent to a strain on the load cell of two pounds is switched in and the resulting voltage measured. This voltage is used to establish the weight of two pounds under the present set of variable conditions. Should the variable change such that one pound is represented by forty-five millivolts or seventy-five millivolts rather than the normal sixty-millivolts, the accuracy of measurement would still be within the total accuracy requirements of the can cashier or collector 41 of the present invention. Under normal conditions, 60 millivolts equal one pound of one part out of 600 of the accuracy possibility is 0.001666 pounds per count. At one part out of 450, the accuracy possibility is per pound. The desired system accuracy is 0.01 pounds, at the worst condition of 45 millivolts equal the one pound, a margin of 4.5 to 1 is maintained thus assuring a highly accurate weighing under all possible conditions.

FIG. 11 represents the output circuitry and low voltage control circuitry of boxes 139 and 140 of FIG. 4. The major components of the circuit of FIG. 11 include the first, second and third latch 312, 313, and 314, the level translation network 315, the coin dispenser drive transistors 316, and the protective diode network 317. Each of the three latches 312, 313, and 314 are identical and, in the preferred embodiment of the present invention, each is a 74HC374 octal transparent latch with three state outputs such as that manufactured by Motorola, Inc. Each of the latches have a set of outputs $O_0$–$O_7$ which are sent via P2, P5, P6, P9, P15, P16, and P19, respectively. Each has a power supply input $V_{cc}$ directly coupled by a pin P20 to a source of potential +V. Similarly, each has a ground output at P10, which is directly coupled to ground. Lastly, each has an output enable input $\overline{OE}$ at P1.

Beginning with latch 312, the $O_7$ output supplies the signal CAL through P19; the $O_6$ output supplies the signal RSO from P16, and the $O_5$ output supplies the signal RSI from P15. The latch enable input LE at P11 for each of the latches is addressed by the unique address code generated by the decoder circuit of FIG. 7, as previously described. The $O_4$ output of latch 312 is taken from P12 and connected through a resistor 318 to the base of a first transistor driver 319 of the driver network 316. The collector of transistor 319 passes directly through the diode network 317 to output the signal STL-CAN on one lead and is directly coupled to the anode of a diode 320 whose cathode is connected to a +25 volt source of potential. The $O_3$ output from P9 is coupled through resistor 321 to the base of the second transistor driver 322 whose collector is connected to output the signal TOK-DSP and is also connected to the anode of a diode 323. The $O_2$ output on P6 is connected through resistor 324 to the base of a third drive transistor 325, whose collector is connected to supply the output QTR-DSP and to the anode of diode 326. $O_1$ is taken from P5 and connected through resistor 327 to the base of the fourth drive transistor 328, whose collector supplies the output signal NCK-DSP and is also connected to the anode of a diode 329. The output $O_0$ of the first latch 312 is taken from P2 and connected through resistor 330 to the base of drive transistor 331, whose collector is used to output the signal PNY-DSP and is also connected to the anode of a fifth diode 332. The collectors of each of the transistors 319, 322, 325, 328, and 331 are commonly coupled together and connected directly to ground, and the cathode of diodes 320, 323, 326, 329, and 332 are commonly coupled together and connected to the +25 volt source of potential.

The second latch 313 has its unique address code present input at P11 or LE and the $O_7$ output taken from P19 supplying the output signal XCORE, while the $O_6$ output at P16 supplies the output signal SEP-DP. The $O_5$ output from P15 is connected directly to the P9 input of a level translator 333, whose output supplies the signal CK4. The $O_4$ output from P12 connects to the input P11 of a second level translator 334, which supplies the signal CK3. The $O_3$ output from P9 is supplied to the input P14 of a third level translator 335, whose output generates the signal RST3, and the $O_2$ output from P6 is connected to the input P7 of the fourth level translator 336 for outputting the signal CK2. The $O_1$ output from P5 is connected to the input P5 of the fifth level translator 337, whose output supplies the signal RST1, and the $O_0$ output from P2 connects to the input P3 of the sixth and last level translator 338, which outputs the signal CK1. Each of the level translators within the block 315 receives the +5 volt source of potential and is illustrated going into P1 of the level translator 338, and each receives the +12 volt source of potential seen going into P16 of the first level translator 333.

P11 of the third latch 314 receives its unique address code from the decoder circuit of FIG. 7 as previously described, and the data outputs D0 through D7 are the same as with latches 312 and latch 313. The signal $\overline{R}$ is supplied to the input of an inverting driver buffer 339, whose output is connected directly to the $\overline{OE}$ input at P1 of each of the latches 312, 313, and 314. The $O_7$ output from P19 of latch 314 supplies the signal SCL-DP and the $O_6$ output from P16 supplies the signal CRSH. The $O_5$ output from P15 supplies the signal CONT and the $O_4$ output from P12 supplies the signal PNY-DR. The $O_3$ signal from P9 supplies the signal NKL-DR and the $O_2$ output signal from P6 supplies the signal QTR-DR. The $O_1$ output from P5 supplies the signal TOK-DR and the $O_0$ output from P2 supplies the separately illuminated OUT of MNY signal for use as hereinafter described. All of the outputs from the MPU 175 of FIG. 6, which are addressed as output functions, are first latched using the latches to 312, 313, and 314 of FIG. 11. The outputs are then applied as positive signal levels. Those outputs that are used for counting are converted to a +12 volt logic signal level, using the level translators of block 315. Those outputs used to dispense coins or manufacturers coupons are supplied to the drive transistors 316 to cause the appropriate dispenser to output a coin or token. The diode network 317 is configured to protect the drive transistors 316 against transients and the like. All of the output signals of FIG. 11 are used elsewhere in the system, as hereinafter described.

Figure 12:
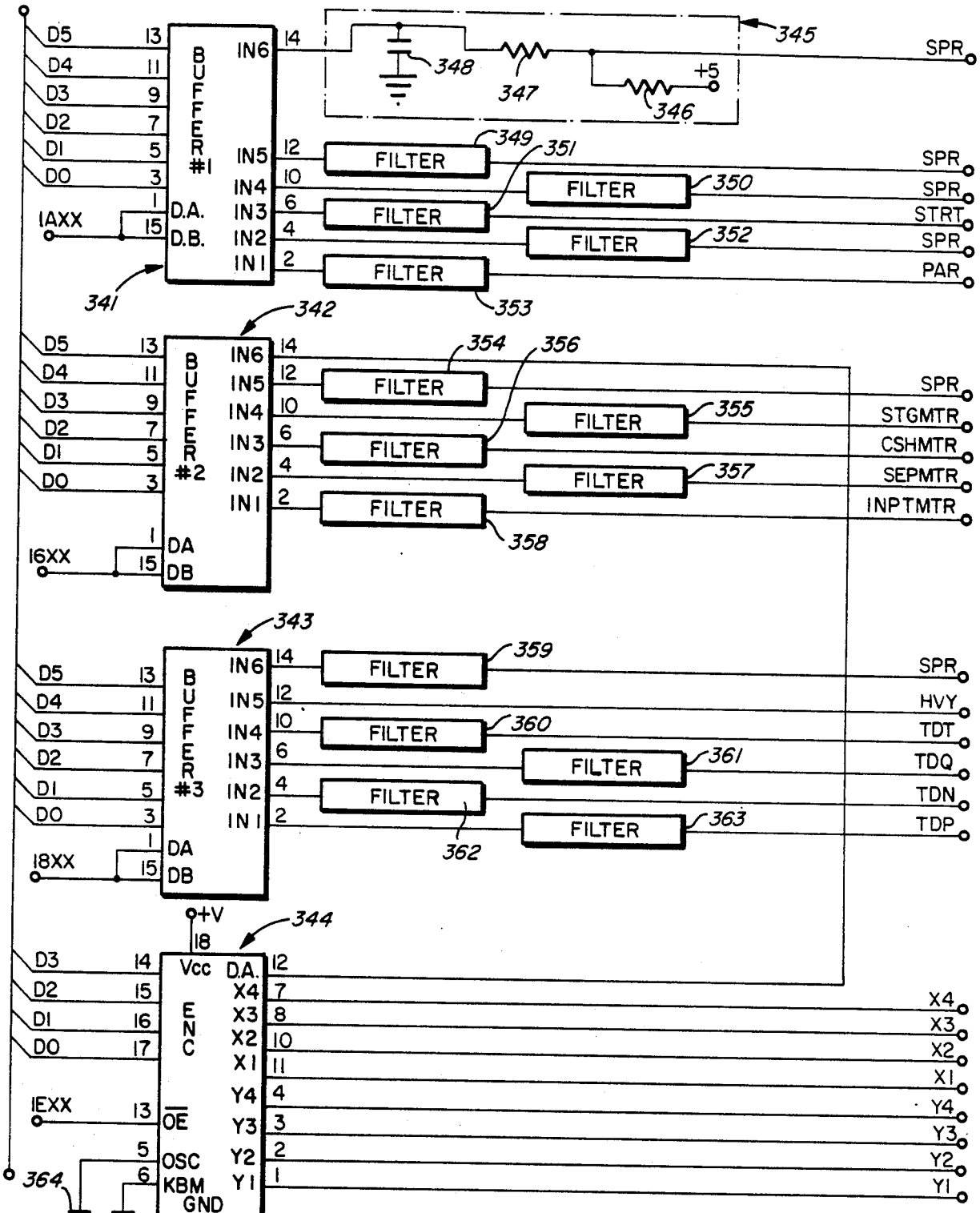
FIG. 12 is a block diagram of the low voltage input interface to the MPU of the control system of the present invention.

FIG. 12 illustrates the input circuitry of block 141 of FIG. 4, and includes, as its main components, a first buffer 341, a second buffer 342, a third buffer 343, a keyboard encoder 344, and a plurality of filter networks 345. The first, second and third buffers 341, 342, and 343, respectively, are, in the preferred embodiment of the present invention, hex non-inverting three state buffers such as MC14503B manufactured by Motorola, Inc. and previously described. Each of the buffers includes six data outputs D0–D5 taken from P3, P5, P7, P9, P11, and P13, respectively. The disable "A" input D.A. on P1 and the disable "B" input D.B. on P15 are each connected to a unique address generated by the decoder circuitry of FIG. 7 as previously described. Further, each of the buffers 341, 342, and 343 has six inputs designated IN1–IN6. Each of the signals coming into the inputs must first pass through a filter network similar to filter 345.

In 345, the input signal SPR comes in on the lead and is connected to a +5 volt source of potential through a resistor 346 and through a resistor 347 is connected to the IN6 input on P14 and simultaneously to ground through a capacitor 348. Each of the boxes identified as filters hereinafter, has a pair of resistors 346, 347 and capacitor 348 identical to that of block 345. The input SPR passes through filter 349 to P12 and the IN5 input. Another signal SPR passes through filter 350 to P10 and the IN4 input, while the signal STRT passes through filter 351 to P6 and the IN3 input. Yet another signal SPR passes through filter 352 to P4 to the input IN2, while the signal PAR passes through filter 353 to P2 and the IN1 input of buffer 341. The spare inputs SPR will have sdignal assignments at a later time to meet future system needs.

Buffer 342 has similar inputs. The signal SPR passes through filter 354 and P12 to the IN5 input, while STGMTR passes through filter 355 to P10 and the input IN4. The signal CSHMTR passes through filter 356 and P6 to the input IN3, while the signal SEPMTR passes through filter 357 and P4 to the input IN2. The input signal INPTMTR passes through filter 358 and P2 to the IN1 input of the buffer 342.

Associated with buffer 343 is a first input SPR passing through filter 359 and P14 to the IN6 input, while the signal HVY passes unfiltered directly to the P12 and the IN5 input. Four inputs TDT, TDG, TDN, and TDP, pass through the respective filters 360–363 and supply the inputs IN4–IN1 through P10, P6, P4, and P2 respectively.

The keyboard encoder 344 is, in the preferred embodiment of the present invention, a conventional MM74C922 16 key encoder such as that manufactured by the National Semiconductor Corporation. This is a key encoder, which provides all the necessary logic to fully encode an array of SPST switches. The keyboard scan can be implemented by either an external clock or an external capacitor, and this encoder also has pull-up devices which permit switches with significant resistance to be used. There are no diodes in the switch array, or at least none are needed, to eliminate ghost switches. The internal debounce circuit needs only a single external capacitor and can be defeated by omitting the capacitor. A data available DA output goes to a high level when a keyboard entry has been made, and a data available output returns to a low level when the entered key is released, even if another key is depressed. The data available signal will return high to indicate acceptance of the new key after a normal debounce period, so that two key rollover is provided between any two switches. An internal register remembers the last key pressed, even after the key is released, and tri-state outputs provide for easy implementation with conventional data buses and the like. The data outputs on the encoder 344 are the signals D0–D3 taken from pins P17, P16, P15, and P14, respectively. The output enable signal $\overline{OE}$ of P13 is taken from the unique address code generated by the decoder circuit of FIG. 7 as previously described. The oscillator input OSC at P5 is connected to ground through a capacitor 364 and the keyboard mask port KEM at P6 is connected to ground through a capacitor 365. P18 supplies a +V source of potential to the input $V_{cc}$, while the ground port GND of P9 is connected directly to ground. The data available output D.A. of P12 is connected directly to the P14 and the IN6 input of the buffer 342. The column input signals to be emcoded X1, X2, X3, and X4, are located at P11, P10, P8, and P7, respectively, and receive the keyboard input signals X1, X2, X3, and X4, respectively. Similarly, the keyboard row signals and encoder inputs Y1–Y4 are applied to P1–P4, respectively, with the row keyboard output signals Y1, Y2, Y3, and Y4, respectively.

In the circuit of FIG. 12, all external inputs are filtered using an RC network similar to filter 345 before being passed to buffers 341, 342, and 343. The buffers are used to prevent transients and noise which could affect the system, and all filter networks are connected to the inputs of the buffers 341, 342, and 343, and are selectively addressed onto the data bus using the decoded output signals from the circuit of FIG. 7, 1A*xx*, 16*xx*, 18*xx*, and 1E*xx*, respectively. When this occurs, the location 1*exx* is addressed and the keyboard data can be read. The operation of the keyboard encoder is conventional, and the four row signals and four column signals comprising the sixteen keys of the keyboard are described in FIG. 13.

Figure 13:
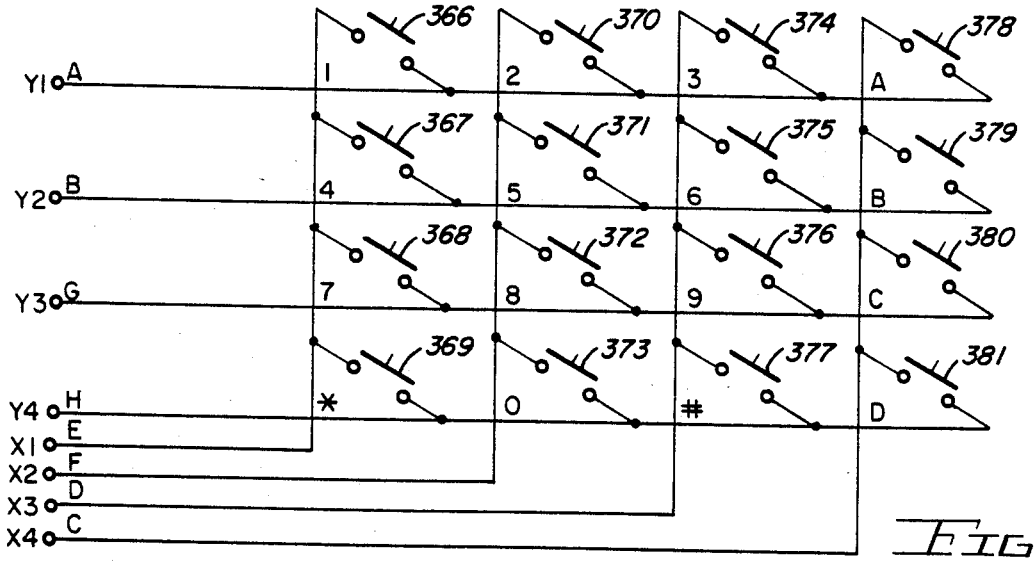
FIG. 13 is a schematic diagram of the keyboard of the present invention.

The keyboard of FIG. 13 represents the keyboard of block 142 of FIG. 4 and, in the preferred embodiment, is a conventional keyboard such as a 4×4 standard Dome keyboard, series 83, such as manufactured by Grayhill, Inc. The four rows and four columns of the keyboard of FIG. 13 make up a 4×4 switch matrix. The matrix will be explained with respect to the row and column associated with a given key or switch. Switch 366 defines the column 1, row 1 position X1Y1; switch 367 defines the column 1, row 2 position X1Y2; switch 368 defines the column 1, row 3 position X1Y3; and switch 369 defines the column 1, row 4 position X1Y4. Similarly, switch 370 defines the column 2, row 1 position X2Y1; switch 371 defines the column 2, row 2 position X2Y2; switch 372 defines the column 2, row 3 position X2Y3; and switch 373 defines the column 2, row 4 position X2Y4. Likewise, switch 374 defines the column 3, row 1 position X3Y1; switch 375 defines the column 3, row 2 position X3Y2; switch 376 defines the column 3, row 3 position X3Y3; and switch 377 defines the column 3, row 4 position X3Y4. Lastly, switch 378 defines the column 4, row 1 position X4Y1; switch 379 defines the column 4, row 2 position X4Y2; switch 380 defines the column 4, row 3 position X4Y3; and switch 381 defines the column 4, row 4 position X4Y4. Anytime one of the keys is depressed, one "X" line and one "Y" line will supply a signal to the keyboard encoder 344 of FIG. 12 and produce a four bit word which is transferred to the data bus for processing by the MPU 175 or the like.

FIG. 14 represents the circuit of block 144 of FIG. 4 illustrating the high voltage control relays and motor detection circuitry. Similar circuits, not shown, can be used for the blower motor and metering motor. The primary components of the circuit of FIG. 14 are the four photo-conductor/photo-coupler devices 384, 385, 386, and 387. In the preferred embodiment, the photo-conductor 384 is identical to the remaining photo-conductors, and each photo-conductor or photo-coupler includes a neon lamp portion proximate the monitoring or input end, and a ground output, each of which is commonly coupled together and connected to ground, and an output. In the preferred embodiment, the photo-conductor/photo-coupler 384–387 are conventional devices such as a VTL 3 Series photo-conductors manufactured by Vactec, Inc. but any suitable detector can be used. One input to the storage motor is connected to the opposite input through resistor 388 and is also connected through a resistor 389 to a lamp input of the photo-conductor 384. The other output from the storage motor is connected to the opposite terminal of resistor 388 into the remaining lamp input of the photo-conductor 384. The output of the photo-conductor 384 supplies the signal STGMTR for advising the microprocessor as to the status of the storage motor.

Likewise, the crusher motor has an output connected through resistor 391 to the lamp input of photo-conductor 385, and it is also connected through a resistor 390 to the opposite lead from the motor. The opposite lead from the motor is also connected to the other input of the photo-conductor 385, and the output thereof supplies the signal CSHMTR for advising the microprocessor as to the status of the crusher motor. The separator motor is monitored by a first lead which is connected through a resistor 393 to the lamp input of photo-conductor 386 and through a resistor 392 to a second lead from the separator motor. The second lead is also connected to the second input of photo-conductor 386, whose output supplies the signal SEPMTR. Lastly, the input conveyor motor is monitored with a first lead connected through a resistor 395 to the lamp input of photo-conductor 387, and its opposite lead connected to the other input of photo-conductor 387 with resistor 394 connecting the two input leads. The output of the photo-conductor 387 supplies the signal INPTMTR for advising the microprocessor as to the status of the input conveyor motor. Similar circuits may be provided for the fan motor and metering device motor.

In summary, the circuitry of FIG. 14 shows the detectors used for determining proper motor operation, and the photo-conductor devices have neon lights that are on whenever voltage is applied, and off whenever voltage goes away. The output from each of the photo-conductors is a low signal representing a true. The photo-detector is low when the neon light is on, and it is off, representing a high impedance state, whenever the neon light is off. The various other motors, including the metering motor 121 of FIG. 2, and the blower motor 107 of FIG. 2, may be similarly monitored by circuitry such as shown in FIG. 14. Alternatively, they can be operated manually by the vehicle operators bringing the truck for hauling the stored crushed aluminum cans to the recycling center, or the operators could turn a key or the like to signal the microprocessor to open the conduit door and energize fan and metering motors.

Figure 15:
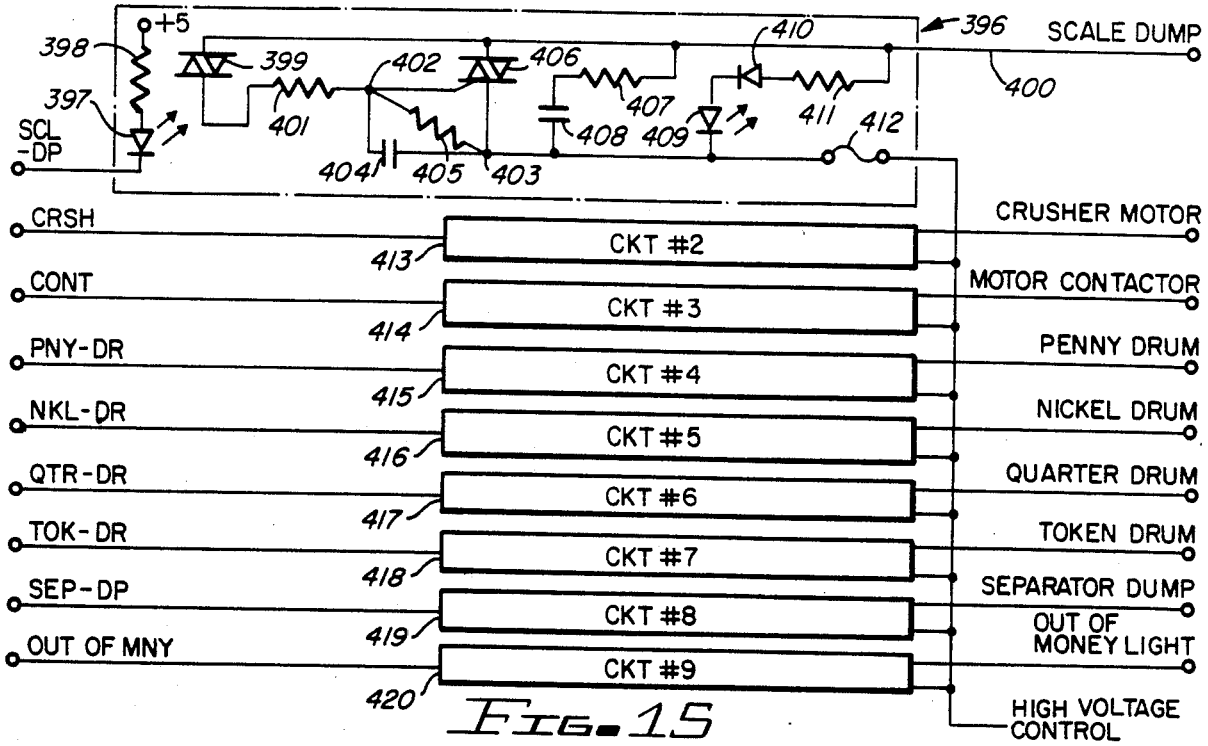
FIG. 15 is a partially schematic, partially block diagrammatic of the interface circuitry between the digital logic circuits and high voltage circuits of the present invention.
Figure 16:
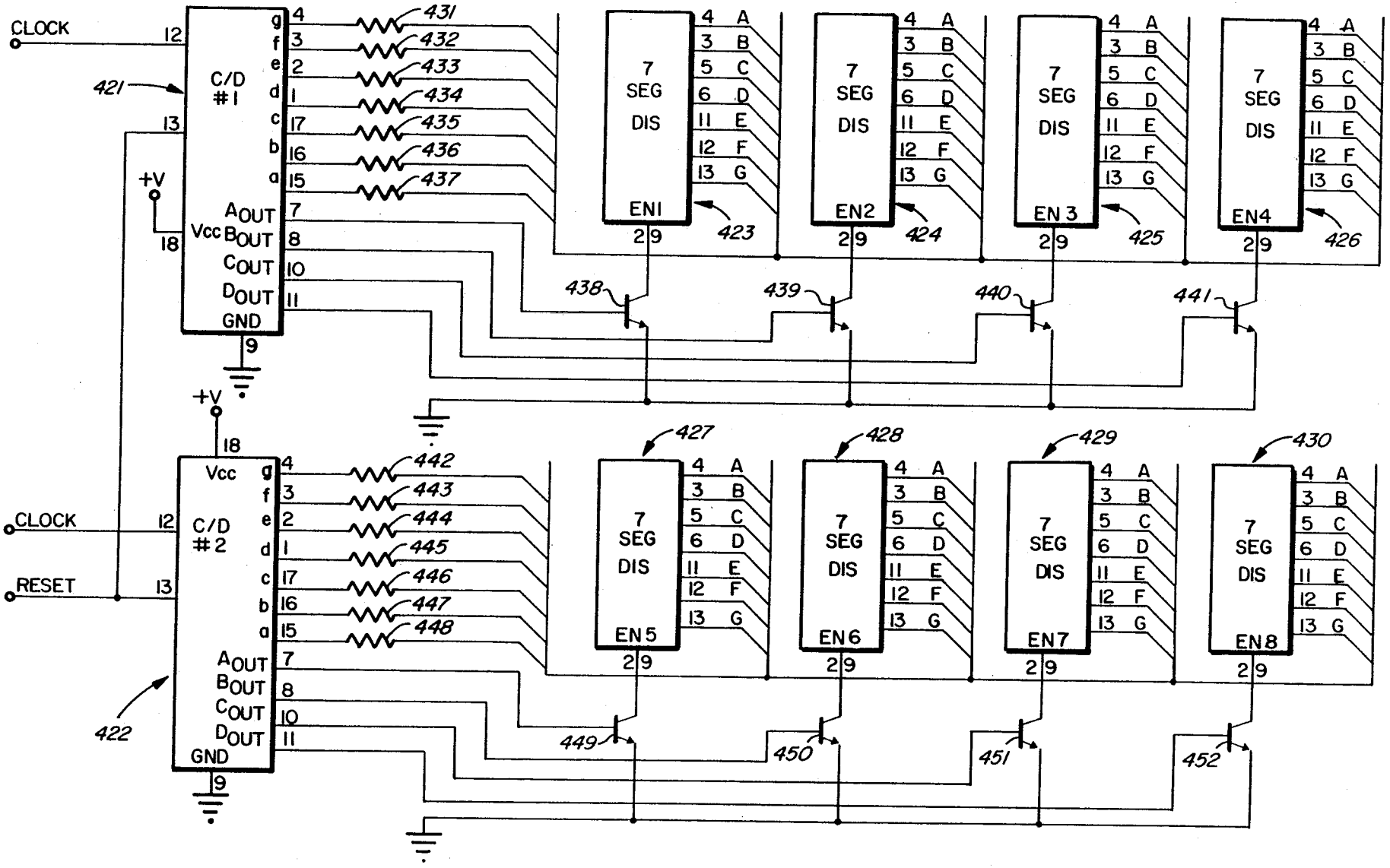
FIG. 16 is a block diagram of the display system and update counters of the present invention.

The circuit of FIG. 15 represents the coin dispense and top detect circuitry of block 145 of FIG. 4, and involves a plurality of unique circuits as shown in block 396. The input signal $\overline{\text{SCLDP}}$ is supplied to the cathode of the light-emitting diode LED 397, whose anode is connected through a resistor 398 to a +5 volt source of potential. The light from the light-emitting diode 397 controls the conduction of the light responsive triac 399 so that the pair forms an optical coupler. One terminal of the light responsive triac 399 is supplied by a lead 400 to output the signal SCALE DUMP. The opposite terminal is connected through a resistor 401 to a node 402. Node 402 is connected to node 403 through a capacitor 404, and a resistor 405. Node 402 is also connected directly to the gate electrode of a power triac 406, whose opposite current-carrying electrode is connected to the output lead 400. The output lead 400 is connected to node 403 through the series combination of a resistor 407 and capacitor 408. Similarly, lead 400 is connected to node 403 through the series combination of a resistor 411 having one terminal connected to lead 400 and the opposite terminal connected to the anode of a diode 410 whose cathode is connected to the anode of a light-emitting diode LED409, whose cathode is connected to node 403. Node 403 is further connected through a fuse 412 in common with all of the other fuses of the circuits of FIG. 15, as hereinafter described, to the high voltage control lead. In operation, the circuit 396 interfaces high voltage controls with the low voltage from the output circuits. The circuit of block 396 is specially designated to include a solid state relay which includes a zero-crossing detector triac 399, an optical coupler used to drive a 30 amp triac 406 which drives the load. The relay has a built-in monitor circuit to allow continuous monitoring of the fuse 412 which is in series with the power line. The fuse 412 will open when it experiences excessive current, and will therefore protect the solid state relay. When the fuse opens, the light-emitting diode 409 will go out. Circuit CKT#2–CKT#9, represented by reference numerals 413–420, respectively, are idential to the circuit described within block 396. The signal CRSH is supplied to the input of circuit 413, which supplies an output crusher motor to the crusher motor. The signal CONT is fed to the input of circuit 414 which supplies the output signal motor contactor. Input PNY-DR to circuit 415 supplies the output PENNY DRUM. The input NKL-DR to circuit 416 supplies the output NICKLE DRUM, while the input QTR-DR to circuit 417 supplies the output QUARTER DRUM. The input TOK-DR to circuit 418 supplies the output TOKEN DRUM; the input SEP-DP to circuit 419 supplies the output SEPARATOR DUMP, and the input OUT OF MNY to circuit 420 supplies the output OUT OF MONEY LIGHT. As previously stated, each of the circuits 413 through 420, as well as the circuit 396, has its fuse 412 connected together to the high voltage control lead. Similar circuitry would also be used for the coupon dispenser of the present invention among others.

FIG. 16 shows the display circuitry of block 146 of FIG. 4. In FIG. 16, a pair of counter/display drivers 421 and 422 are used. In the preferred embodiment, the counter/drivers 421, 422, are conventional, off-the-shelf 74C926 devices such as four digit counter with a multiplexed 7-segment output driver such as that manufactured by National Semiconductor Corporation. Each of the CMOS counters includes a 4-digit counter and internal latch output sourcing drivers for 7-segment display, and an internal multiplexing circuit which has its own free-running oscillator and requires no external clock. The counters advance on the negative edge of a clock, and a high signal on the reset input resets the counter to zero. A low signal on the latch enable LE input will latch the number in the counters into the internal output latches, and a high signal on the display select DS input will select the number in the counter to be displayed. A low level signal on display select will select the number in the output latch to be displayed. The power supply input $V_{cc}$ at P18 is connected directly to a source of potential, and the ground port GND at P9 is connected directly to ground. The seven outputs a, b, c, d, e, f, and g, are taken from P15, P16, P17, P1, P2, P3, and P4, respectively, and represent the information supplied to each of the seven segments of a seven-segment display for determining the particular number or character to be displayed thereon. The outputs $A_{out}$, $B_{out}$, $C_{out}$, and $D_{out}$, are taken from P7, P8, P10, and P11, respectively. The clock input is supplied to P12, and the reset input is supplied to P13.

The seven segment outputs a–g are supplied to a data bus through resistors 437–431, respectively, and each of the four seven segment displays 423, 424, 425, and 426 has access to the seven segment data on the data bus at any given time. Which of the four seven segment displays in enabled is determined by the outputs $A_{out}$, $B_{out}$, $C_{out}$, or $D_{out}$ of the counter/display driver 421. The $A_{out}$ signal from P7 is connected to the base of a first npn transistor 438, whose collector is connected directly to the enable 1 input EN1 at P29 of the seven segment display device 423. The $B_{out}$ signal from P8 is connected to the base of a second npn transistor 439, whose collector is connected to the enable input EN2 of the second seven segment display device 424. Likewise, the $C_{out}$ signal taken from P10 and supplied to the base of a third npn transistor 440, whose collector is connected to the enable input EN3 of a third seven segment display device 425, and $D_{out}$ is taken from P11 and coupled to the base of a fourth npn transistor 441, whose collector is connected to the enable input EN4 of a fourth seven segment display device 426 for enabling same. Depending upon which of the four display devices 423–426 are to be enabled, the signals $A_{out}$, $B_{out}$, $C_{out}$, and $D_{out}$, control the operation of the enabling transistors 438–441, respectively, to enable the particular display or displays to receive the seven segment data needed to display a particular number or character.

The second half of the circuit is identical with the counter/display driver 422 supplying the seven segment signals a–g through resistors 438–442, respectively, to a data bus coupled to each of the four seven segment display devices 427–430. Simultaneously, the four outputs $A_{out}$, $B_{out}$, $C_{out}$, and $D_{out}$, from P7, P8, P10, and P11, respectively, are connected to the respective bases of enabling npn transistors 449, 450, 451, and 452, whose collectors are connected to the enable inputs EN5 of the fifth seven segment display device 427, EN6 of the sixth seven segment display device 428, EN7 of the seventh seven segment display device 429, and EN8 of the eighth and last seven segment display device 430. Again, the particular character to be displayed on each of the seven segment display devices 427–430 are determined by the seven segment data a–g output from the counter/driver 422, and the output to the enabling transistors 449 through 452 will enable or disable each display as required. Since the counter/drivers 421, 422 may be commonly coupled together, the display of FIG. 16 may function as a single in-line eight bit display or as two separate four bit displays, as desired. The input to the display of FIG. 16 is in the form of clock pulses which are counted by the counter/driver circuits 421 and 422, and the multiplexed outputs of these devices are fed to the appropriate seven segment display devices as known in the art. The entire display may be reset using a single reset pulse on the reset line, and when reset, the displays will all read zeros. In the preferred embodiment, conventional Type 1738 seven segment LED displays are used which are highly visible even in bright sunlight, such as those manufactured by Hewlett Packard, Inc.

A similar 7-segment display is located inside the housing 41 as at 701 to display error messages and/or error codes to maintenance personnel. Alternatively, a panel of individual trouble or alarm lights could be used where each light corresponds to a particular alarm condition or the like.

Figure 17:
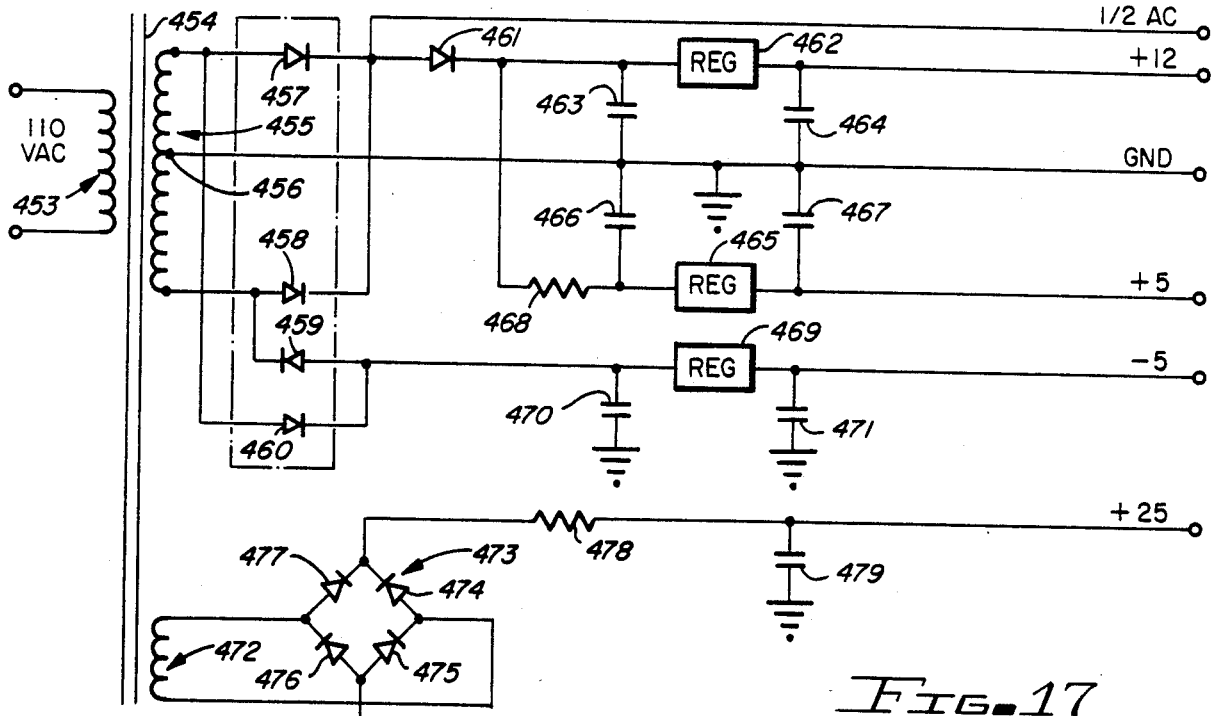
FIG. 17 is an electrical schematic diagram of the power supply of the present invention.
Figure 18:
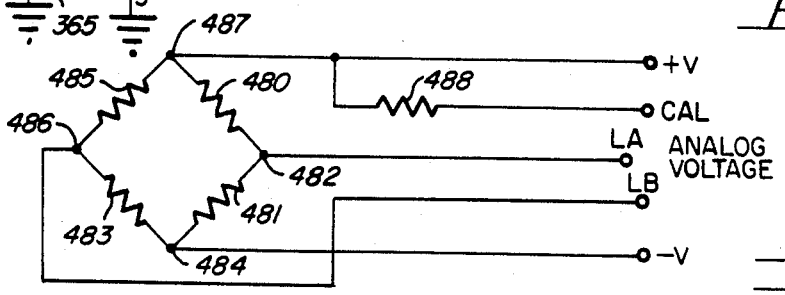
FIG. 18 is an electrical schematic diagram of a bridge circuit representing the weighing apparatus of FIG. 1 of the present invention.

FIG. 17 represents the power supply circuitry of block 147 of FIG. 4. This circuit is used to provide power, and in particular, regulated power to all of the devices of the present system. A 110 volt AC primary coil 453 is coupled through a core 454 to a secondary coil 455 having a tap 456 thereon. One end of the secondary coil 455 is connected to the anode of a diode 457 and to the anode of a diode 460. The opposite end of the secondary coil 455 is connected to the anode of a diode 458 and the cathode of a diode 459. The cathode of diode 460 is connected back to the anode of diode 459, and the cathode of diode 458 is connected to the cathode of diode 457 and supplies a one-half AC signal output on the lead as shown. The cathode of diode 457 is also connected to the anode of diode 461, and the cathode of diode 461 is connected to the input of a +12 volt regulator 462. The output of the regulator 462 supplies regulated +12 volt potential on the output lead as shown. The input of the regulator 462 is operatively filtered to ground through a capacitor 463 and the output is filtered to ground through a capacitor 464. The cathode of diode 461 is connected through a resistor 468 to the input of a +5 volt regulator 465, while the output of the regulator 465 supplies regulated +5 volt potential on the output lead as shown. The junction of the resistor 468 and the input of the regulator 465 is filtered to ground through a capacitor 466, while the output of the regulator 465 is filtered to ground through capacitor 467. The anode of diode 459 and the cathode of diode 460 are commonly filtered to ground through capcitor 470 and to the input of a −5 volt regulator 469, whose output supplies a regulated −5 volt potential on the lead, as shown, and whose output is filtered to ground through a capacitor 471. The tap 456 is also grounded.

A split secondary coil or separate secondary 472 is operatively coupled through the core 454 back to the primary coil 453, and opposite ends of the coil 472 are connected to a full wave bridge rectifier 473. The rectifier includes a first diode 474 having its cathode coupled to the cathode of a diode 477, and the anode of 477 is coupled to the cathode of diode 476. The anode of diode 476 is coupled to the anode of diode 475, and the cathode of diode 475 is coupled to the anode of diode 474. The junction of the cathode of diode 476 and the anode of diode 477 are operatively coupled to one end of the secondary coil 472, while the junction of the cathode of diode 475 and the anode of diode 474 are directly connected to the opposite end of the secondary coil 472. The junction of the anodes of diodes 475 and 476 are grounded, and the common connection of the cathodes of diodes 474 and 477 are connected to one terminal of a resistor 478, whose opposite terminal is connected to an output lead for supplying a +25 volt source of potential. The output lead at the second terminal of resistor 478 is also filtered to ground through a capacitor 479.

In the preferred embodiment of the present invention, the voltage regulator 462 is a conventional MC7812C device; the +5 volt regulator 465 is a conventional MC7805C device; and the −5 volt regular 469 is a conventional MC7905C device, such as those manufactured by the Motorola, Inc. In the power supply of FIG. 17, the transformer comprising the primary coil 453 and secondary coils 456 and 472, the bridge circuit comprising diodes 457–460, the bridge circuit 473, and the three regulators 462, 465, and 469, provide voltage for the remaining circuitry of the system. The input voltage is rectified to about 16 volts at the input of the regulators, where it is clamped to a constant +12 volt output at regulator 462. This voltage is also used as an input to the regulator 465, to produce a regulated +5 volt output. Similarly, a negative 16 volts is supplied to the input of the regulator 469, which clamps the output at a −5 volts, and the voltage used to dispense coins and the like is produced by the bridge rectifier 473 which is maintained at about 25 volts DC.

FIG. 18 represents the load cell used in the weighing operation of the present invention, and includes a resistor 480 having one end coupled to one end of a resistor 481 at node 482. The opposite end of resistor 481 is coupled to one end of resistor 483 at node 484, and the opposite end of resistor 483 is connected to one end of resistor 485 at node 486. The opposite end of resistor 485 is connected back to the first end of resistor 480 at node 487. The negative source of potential −V is supplied by one input lead to node 484, while a positive voltage +V is supplied directly to node 487. Node 487 is also connected through a precision sample or reference resistor 488 to supply the known two-pound calibration output signal CAL as previously described. The first load cell output is taken from node 482 which supplies the signal LA, while the second output is taken from node 486 to supply the output LB to the circuits previously described for determining the exact weight of the bucket plus cans, and of the bucket without cans, for computation purposes. The calibration resistor 488 is used for the auto-calibration at the beginning of each cycle to insure that the scale or weighing function has a high degree of accuracy built in. In the preferred embodiment, the load cell FIG. 18 may be, for example, a load cell such as a Model SM-100 manufactured by Interface, Inc.

Figure 19:
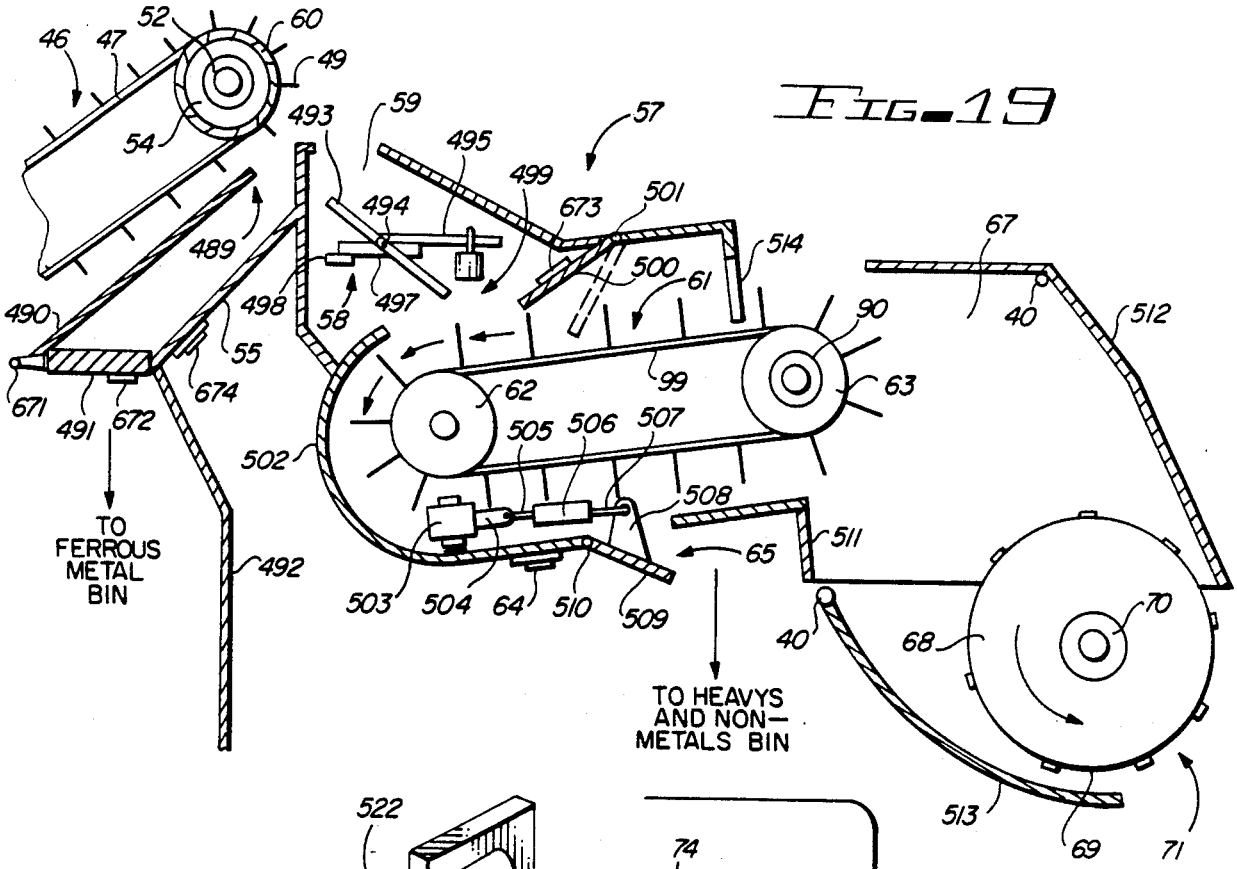
FIG. 19 is a more detailed cross-sectional, blown-up view of the separator of FIG. 1 of the present invention.

FIG. 19 illustrates the preferred embodiment of the separator assembly 61 and crusher 68 of FIG. 1. As indicated previously, the magnetic devices, covering layers, or strips 60 disposed on the driven conveyor drum 54, insure thatall ferrous materials (except possibly for some heavys), including tin-plated steel cans and the like, are adhered to or magnetically retained on or attracted to the outer surface of the input conveyor belt 47 as it rotates through the 180 degrees around the conveyor drum 54. As the belt 47 passes off of the drum 54 to begin its return path to the lower idler pulley, the ferrous material will be pulled further from the attraction of the magnets 60, causing it to fall off of the conveyor 47 and into the plastic chute formed by deflector chute or slide 55 and the top deflector shield 490. At the bottom of the chute a flapper valve or door 491 may be included, but not normally when a digital metal detector is used, as in the present embodiment, which responds to the weight of the ferrous material disposed thereon for opening about a pivot, not shown, but as known in the art, so as to be allowed to freely fall into the ferrous metal bin 56. Since the slide deflector 55 will initially receive the ferrous material and slow its travel, and the flapper door 491 will further slow the travel while deflector 490 dampens any bounces to insure that any material passing through the flapper 491 will fall in a relatively straight line into the storage bin 56, and any not falling into the bin will be caught by deflector shield 492 since the flapper 491 pivots on the opposite side and is directed to the bin by proper design and orientation. A mercury switch 672 operatively secured to the outer surface of the flapper 491 which is pivotally attached at pivot 671 could be used to count ferrous cans. A first digital metal detector 674 is preferably used proximate the mouth of the plastic chute 55 for detecting tin-plated steel cans and the like falling into the steel can receptacle 56 and sending signals indicative thereof to the microprocessor for counting and the like. These signals can display to the depositor each time a steel can is deposited and can also be used to generate an alarm when the steel can receptacle is full based on a count, estimated weight, or the like. Similarly, optical detectors can sense when the receptacle is full.

The input to the separator section 57 is designated 59 and within the input 59 is a heavy detector device 58. The heavy detector device 58 includes a heavy door or impact platform 493 pivotally attached at pivot 494 to a cantilever beam assembly 497. An elongated cantilever beam 495 forms the second end portion of the assembly and is coupled to the first end portion 497, and includes a counterweight 496 for obtaining the proper balance in setting the heavys weight threshhold. A microswitch 498 is disposed proximate the end portion of the beam 497 for use as hereinafter described. Once the material which has already been separated for ferrous material is passed through the input 58 and onto the heavys door 493, it enters the input 499 to the separator conveyor 61. The lugs of the conveyor receive the incoming material therebetween, and travel counterclockwise to take the material past a second metal detector 64. Associated with the second digital metal detector 64 is a solenoid 503 having a normally extended armature 504. The armature 504 is connected via a mechanical link or linkage at 505 to a member 506, and the member 506 is connected through a mechanical link or linkage 507 to an ear-like connector 508 securely fixed to the back of a trapdoor or dump door 509, which is pivotally attached to the frame 502 at pivot 510. The trapdoor 509 is maintained normally opened, so that any heavys and any non-metal material such as paper, plastic bottles, glass, and the like, are dropped through the open trapdoor 509 and into the heavys and non-metals trash bin 66 of FIG. 1. However, whenever the metal detector 64 detects a metallic object, indicating a non-ferrous metallic object such as an aluminum can, the solenoid 503 is actuated to retract the armature 504 which pulls the trapdoor 509 shut through the link 505, member 506, link 507, and ear-connector 508. With the door 509 shut, the detected aluminum can continues its travel over the input deflector 511 and enters the input 67 to the crusher 68. To prevent any cans or the like from being stuck in the lugs of the conveyor belt 99 of the separator conveyor 61, a flapper member 500 with a mercury switch 573 for motion sensing conveyor operations is connected at pivot 501 to drag over the lugs and prevent any cans or the like from being stuck thereon. Across the mouth or entrance or input 67 of the crusher 68, are an optical detector pair of another digital metal detector, or the like, designated by reference to numeral 40. This pair consists of a light source and a detector, as conventionally known, which react to the breaking of the beam for generating a control segment. Whenever the bin 67 is full to the point where the beam is continually broken for a pre-determined period of time, a jam alarm is sounded and the operation is stopped pending repair or clearing. The bottom slide deflector 513 allows the cans supplied into the input 67 to slide down into the crushing zone 69 to be crushed and/or shredded by the crusher 68 and then emptied through the output 71 into the weight hopper or weight bucket 73 of FIG. 1, as previously described.

The micro-switch 498 is used in combination with the cantilevered door to detect heavys, and the closure of the micro-switch signals the controller that a heavy has been detected. Similarly, a magnet could be used on the opposite end of the beam along with a reed switch, or a conventional limit switch or the like. The cantilever action is set by the position and weight of the counterweight 496, and as the cans falls into the separator and off of the heavys door or impact platform 493, they are allowed to freely fall into the conveyor that transfers the material through the separator. The weight equivalent on each object falling onto the door or impact platform is actually measured as a function of the displacement or distance the door and the first end portion of the cantilever beam is moved. When the first end moves a sufficient distance to contact the microswitch, against the heavys threshold set by the counterweight, the microswitch outputs a heavys detected signal. The anti-jam flapper 500 is used in conjunction with the belt lugs of the conveyor 99 to prevent material from being caught on top of the belt lugs so as to allow the material to flow freely into the slots between the lugs. The material is then conveyed around the end of the conveyor 61 and down to the second metal detector 64. The detection of signals from the second digital metal detector means that a metallic object is present and that the object is not steel, since steel has already been separated out by the ferrous metal separator comprising drum 54 and magnets 60. When detection occurs, the dumper or trapdoor 509 closes and remains closed until the metal passes the dump door. When no metal is detected, the dump door is opened and trash, such as paper, milk cartons, plastic bottles, and glass, freely fall out the open dump door. During heavy detection and after a suitable delay that assumes the heavy to be in the vicinity of the dump door, the metal detector is over-ridden to drop the heavy through the dump or trapdoor regardless of whether or not metal is detected by the detector 64. Therefore, only good material, normally non-ferrous, metallic objects such as aluminum cans, are allowed to pass through the separator and into the crusher hopper 67 to be compacted thereby.

The preferred embodiment of the weight bucket assembly 73 of FIG. 1, will now be described with reference to FIG. 20. The weighing bucket assembly 73 of FIG. 1 includes a weighing bucket or weighing bin or hopper body 515 having a flange portion 516 about the upper distal end thereof, surrounding the generally rectangular bin opening 526. Disposed at three positions about the flange 516 designed to share the load equally between the positions, are three hook members 517 rigidly secured to or through the flange 516. A strap or belt member having a loop portion at both ends thereof, each having one end retainably secured over the hook portion of the hook members 517 and its opposite end secured to a similar hook portion of connector members 519. The connector member 519 also includes a hook portion at its opposite end. A stabilizer or connector platform 520 is provided with three spaced apertures 521, designed to equally balance the load on the plate 520, and the hook end of the connecting member 519 is operatively received within the apertures 521 to couple the bucket body 515 to the platform 520 via belt means 518. A load cell 522 has one end portion operatively secured to the platform 20 through a universal joint 523.

The bucket body 515 also includes a bucket dump door 74. An aperture 528 is provided in the flange 516, while a corresponding aperture 529 is provided in the side portion of the door 74. A return spring 530 has one end operatively connected through the aperture 528 to the flange 516, and its opposite end connected through the aperture 529 to the door 74. A similar spring assembly may also be provided on the opposite side of the door, although none is shown in FIG. 20 for sake of clarity. The top central output portion of the door 74 has an outwardly extending ear connector 531 having an aperture through which a pivot means 532 is secured. The pivot means attaches to an elongated member 533 telescopically received within a cylindrical portion 534. A member 535 is integral with or connected to member 534, and the axis of members 533 and 534 is generally coaxial with the armature 536 having one end portion connected to member 535 and the opposite end portion normally disposed or retracted within the solenoid 537. Solenoid 537 is secured via mounting plate 538 to the front of the bucket body 515. Whenever the load cell 522 reads the weight of the bucket 73 with contents, the dump signal activates the solenoid 537, causing the armature 536 to be moved into the solenoid 537 or pulling, for causing the members 533 and 534 to pull upward on the ear 531 and open the door 74 against the bias of the spring 530 to permit the solenoid, plus the weight of the contents of the bucket 515, to open the door 74 sufficiently to dump the contents and allowing the spring 530 to return the door to the closed position, as armature 536 drops out of the solenoid 537. The weighing system uses its knowledge of bucket weight to detect when the door is opened, but a mercury switch 702 may be attached to the outer surface of the door to detect door open and door closed conditions.

Figure 20:
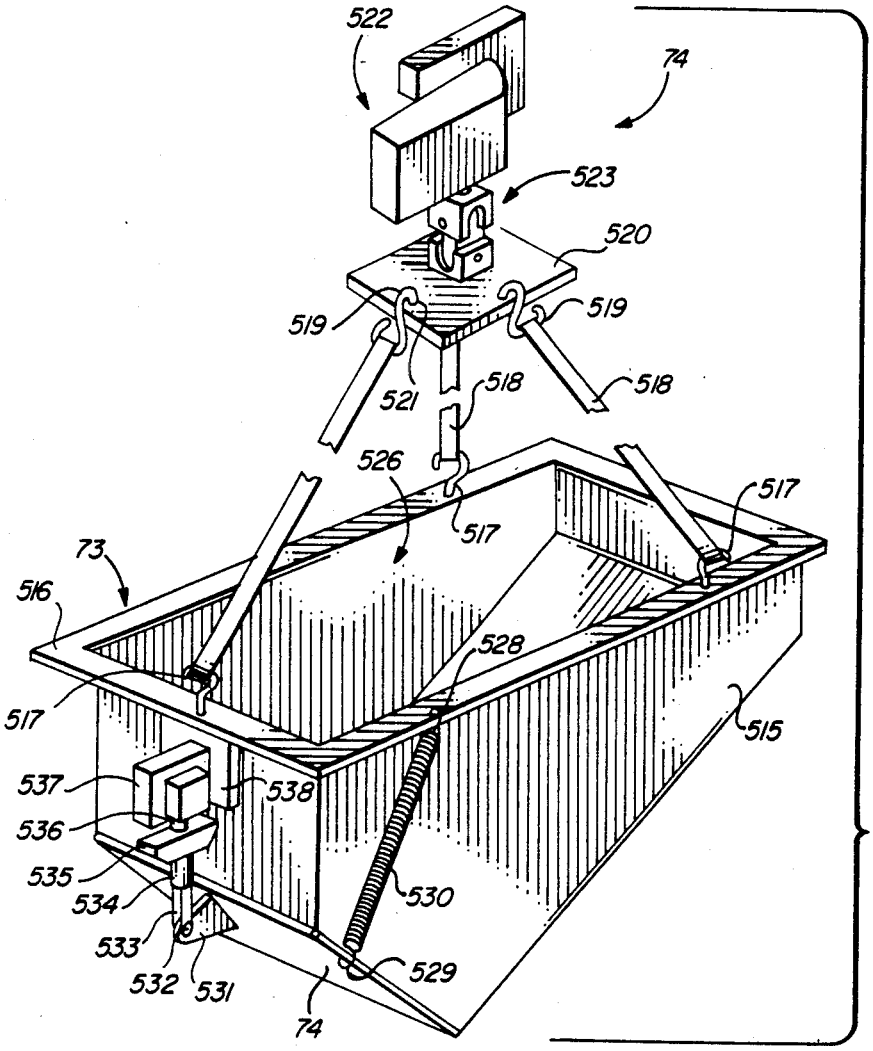
FIG. 20 is a perspective, blown-up view of the improved scale assembly or weighing system of FIG. 1 of the present invention.

To guarantee the uniformity of bucket weight, the bucket arrangement shown in FIG. 20 is used. In this arrangement, the universal joint 533, together with the three properly spaced straps 518, ensure that any weight placed in or on the bucket 73 will be uniformly read by the load cell 522. The bucket door 74 has been replaced with a bucket door using a plastic material such as polypropylene that is lightweight and rugged, to prevent transient oscillations of the bucket as the door 74 is opened and closed, since the transient oscillations can interfere with the weighing procedure and lead to false, or at least less accurate, readings. The software for the system is programmed into a 2764, 8K by 8, Programmable Read Only Memory or PROM. A brief description of each of the more important routines will follow.

Figure 22:
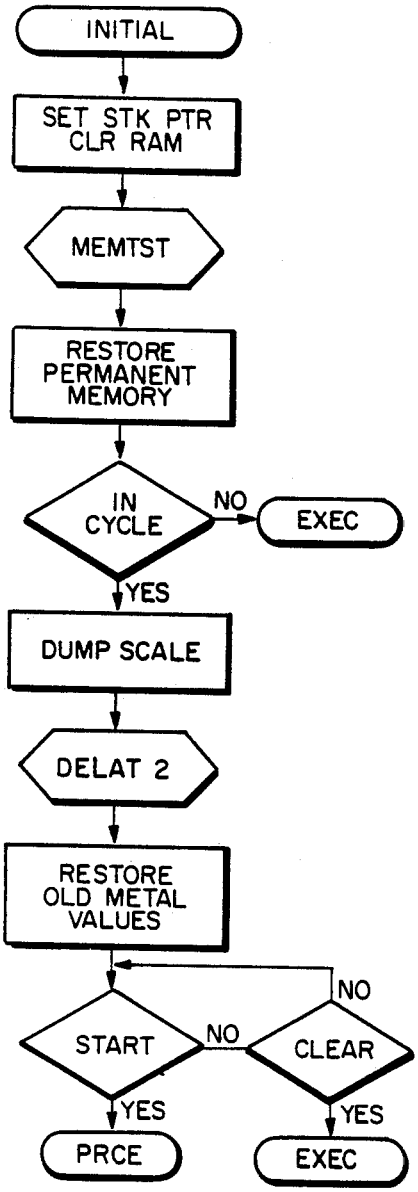
FIG. 22 is a flow diagram of the Initialization subroutine INITIAL of the present invention.
Figure 27:
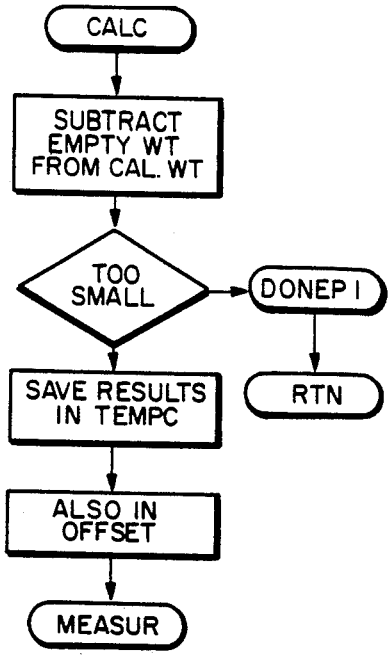
FIG. 27 is a flow diagram of the Calculation routine CALC of the present invention.
Figure 23:
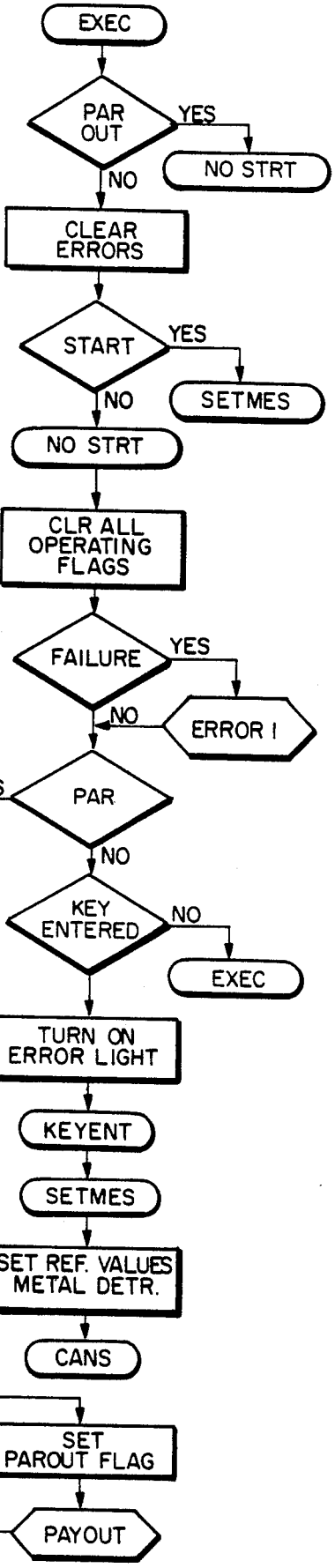
FIG. 23 is a flow diagram of the Execution routine EXEC of the present invention.
Figure 39:
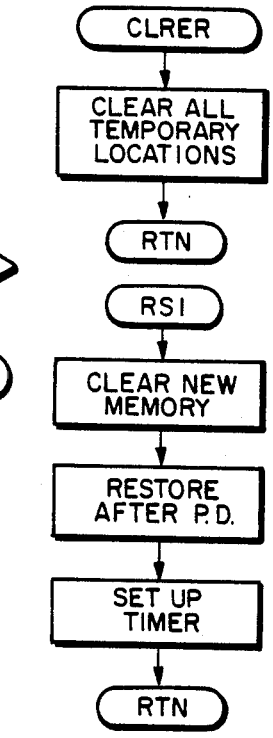
FIG. 39 is a flow diagram of the Clear sub-routine RS1.
Figure 38:
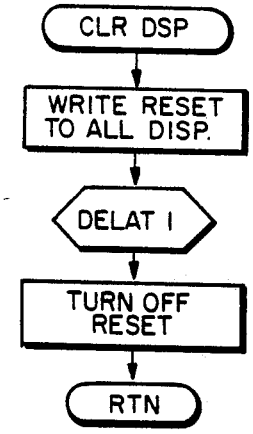
FIG. 38 is a flow diagram of the Clear Display sub-routine CLRDSP of the present invention.
Figure 24:
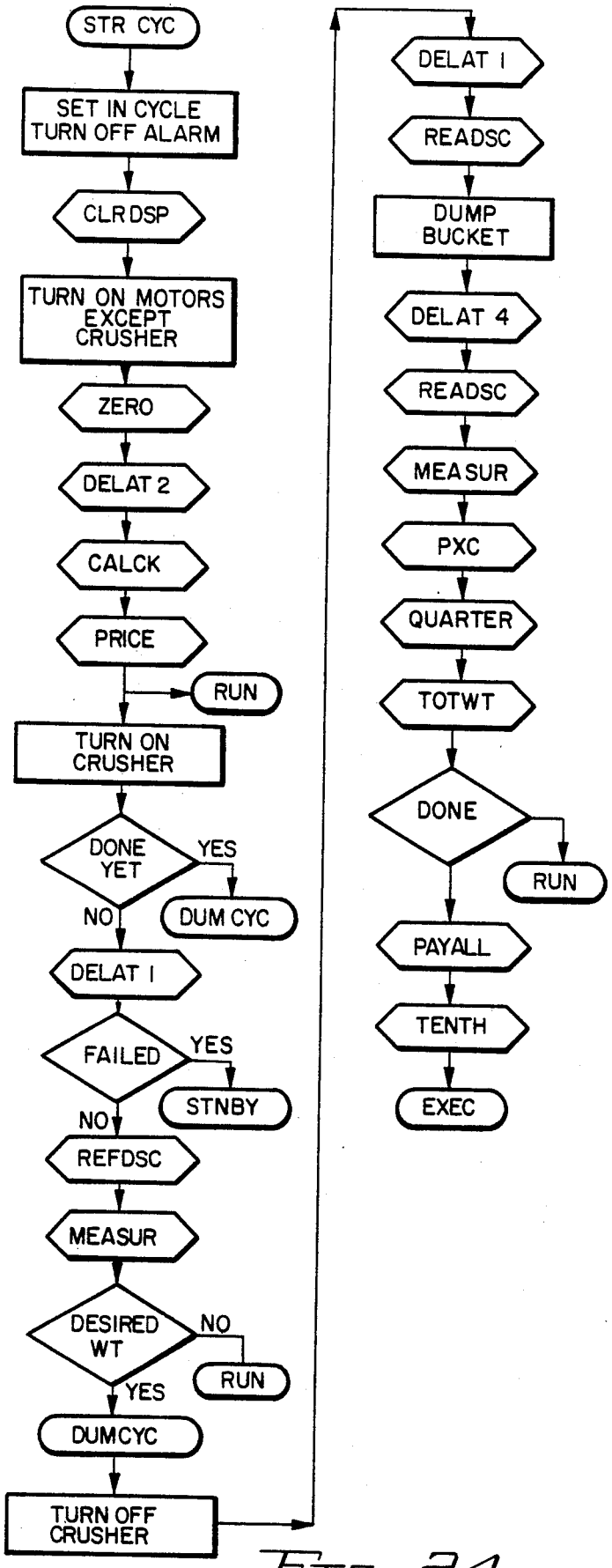
FIG. 24 is a flow diagram of the major operational program STRCYC of the present invention.
Figure 25:
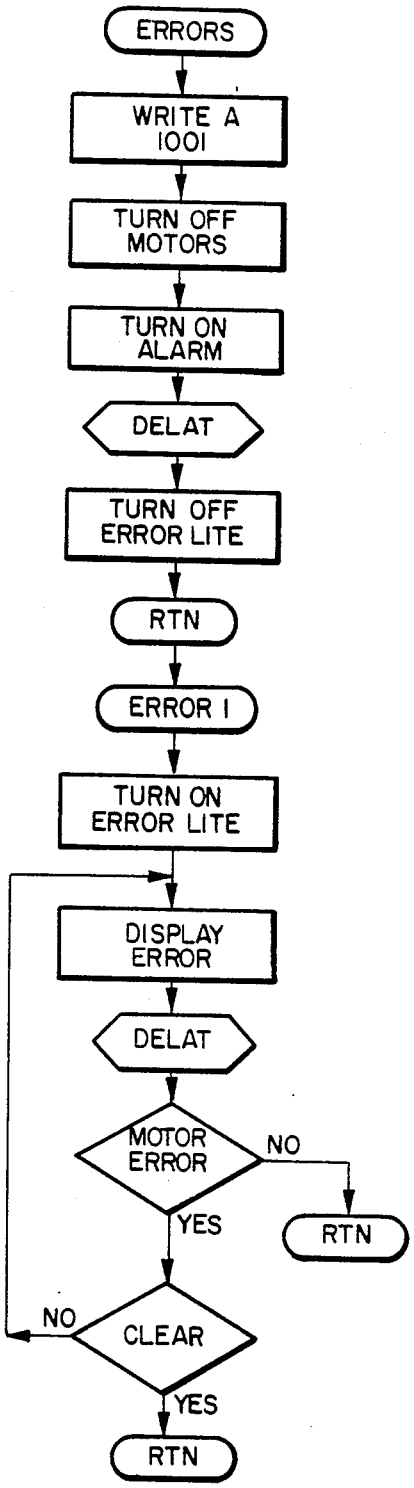
FIG. 25 is a flow diagram of the ERRORS routine of the present invention.
Figure 36:
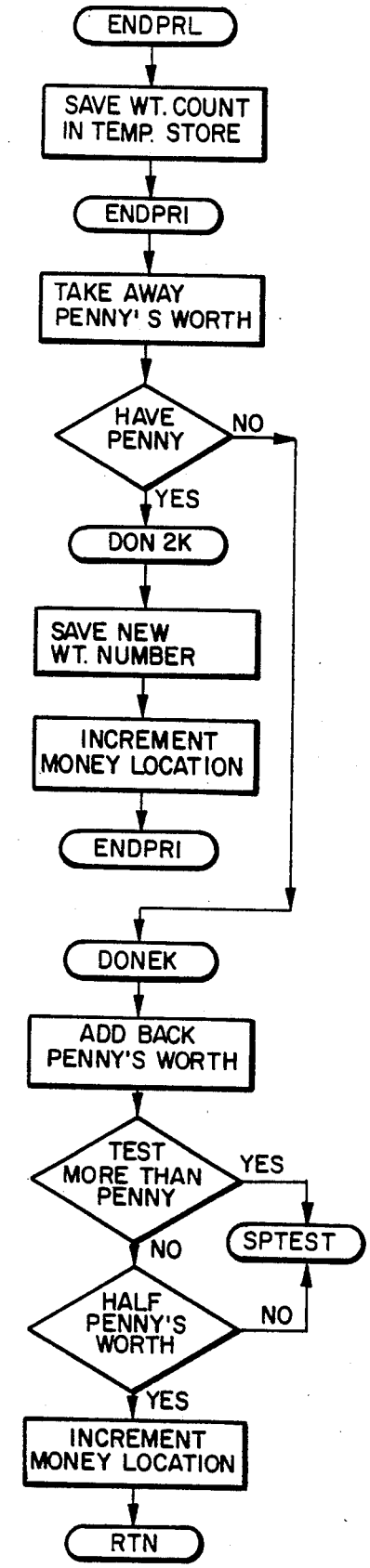
FIG. 36 is a flow diagram of the Paypenny sub-routine ENDPRL of the present invention.

The Initial routine in FIG. 22 is used to initialize the system when the power is first applied or when a reset occurs. It zeroes the RAM Area, it sets the stack pointer, it clears all outputs and then it tests the memory. After the memory test is complete, then the old data stored in permanent memory is restored to RAM and the timing/counting is set up. Next a test is performed to determine if power failed with the machine in cycle. If it was in cycle, then the contents of the bucket is dumped and the processor is forced into a wait loop looking for a start switch. Once a start switch is received, the start cycle routine is entered. When a normal cycle is encountered, the Initial routine ends and the Exec routine in FIG. 23 is entered. The Exec routine is the loop in which the processor executes code as long as a start switch, error or payout does not occur. When a start switch occurs, the latest value for the metal detect and the steel can detect is stored away for comparison during the processing of cans. This value is considered the nominal value for non-metal during this machine cycle. This value will be the reference value as long as the machine is in cycle. Once these values are stored away then the Exec routine is exited and the Strycyc routine in FIG. 24 is entered. Should a par out request occur while in Exec, then one of each of the coins is dispensed at a reasonable rate of, for example, every 400 milliseconds until the par switch is deactivated. Once par out has occurred, the drums that refill the coin dispenser are stopped and will not restart until a clear switch is received. Should an error occur while in the Exec routine, then the Error routine in FIG. 25 is called as a sub-routine. The processor remains in the Error routine until a pre-determined time, for example 30 seconds, has elapsed for an automatic re-try or until the error is cleared with the clear switch on the keyboard.

The Strcyc routine is the major operational routine for the system. It turns on the conveyor motors, initializes the displays, looks for weight in the bucket, monitors for error and looks for time out. It also determines when about one pound of weight is in the bucket so that final processing of the cans in the bucket can begin. As this routine is entered, its first task is to set the "in cycle" flag for power down purposes. This is followed by the clearing of the displays, turning on of the conveyor motors and then calling the Zero routine. The Zero routine is used to put the input bucket voltage, as received from the load cell, in the optimum range of the Analog-to-Digital converter. Upon return from the Zero routine, the Calck routine is called. This routine reads the known voltage associated with the load cell resistor to determine how many counts represent two pounds at this particular time. Should for any reason this reading be out of range then the Error routine is entered. Next, (in the Strcyc routine) the Price routine is called. in the Price routine the amount of compensation to be paid per pound is determined. Upon return from the Price routine the crusher motor is turned on and cans again start to fall into the bucket.

The processor now goes into a search loop to determine (1) the weight in the bucket, (2) time out, and (3) cans coming in but not reaching the bucket. It also looks for errors such as motor not running and out of money. When either the elapsed time of, for example, 20 seconds after the last can has passed the metal detector or when the weight of, for example, one pound is reached, then the system goes into the final weight and payout portion of the cycle. First, the crusher is shut off, to prevent cans from coming into the bucket. Then, after a suitable delay, final weight of the bucket with its contents is taken. Next, the contents of the bucket are dumped and again, after a suitable delay, the bucket weight is again measured. Then, the Measure routine in FIG. 29 is called so that the exact weight of the contents of the bucket is computed. Once the exact weight has been determined, then the Owed routine in FIG. 30 is called. This routine determines how much money is to be paid for the accumulated weight. The computation is in terms of quarters, nickels and pennies.

The next routine called is the Quarter routine. This routine tests for quarters to be paid. All accumulated quarters owed are dispensed and the program is returned to the Strcyc routine where it next calls the Weight routine in FIG. 32. This routine accumulates weight. Each time a pound of material is received, it displays this amount on the display at the front of the machine and it is stored in the accumulator counter which is part of the permanent memory storage unit. At this point in the program the processor makes a decision as to whether the cycle is concluded or if the cycle should be run again. When the cycle is not complete the crusher is turned back on and the above sequence is repeated. When final payout is entered, the remaining weight and money accumulated is processed for final payout. Remaining quarters, nickels and pennies are dispensed and all counters and displays then updated. The front panel pound display will now show the exact poundage to the nearest hundredth of a pound. The front panel money display will show the amount of money paid out. The cycles now being completed, the conveyors are stopped and the Exec routine is reentered.

The Error routine receives and processes errors such as motors not running, out of coins, no weight coming in when cans are coming in, bucket not emptying, load cell not there, and heavy detect closed too long. Retries of errors have been incorporated. Appropriate delays for each type of error before re-try can occur vary from, for example, 15 seconds to 10 minutes.

Figure 37:
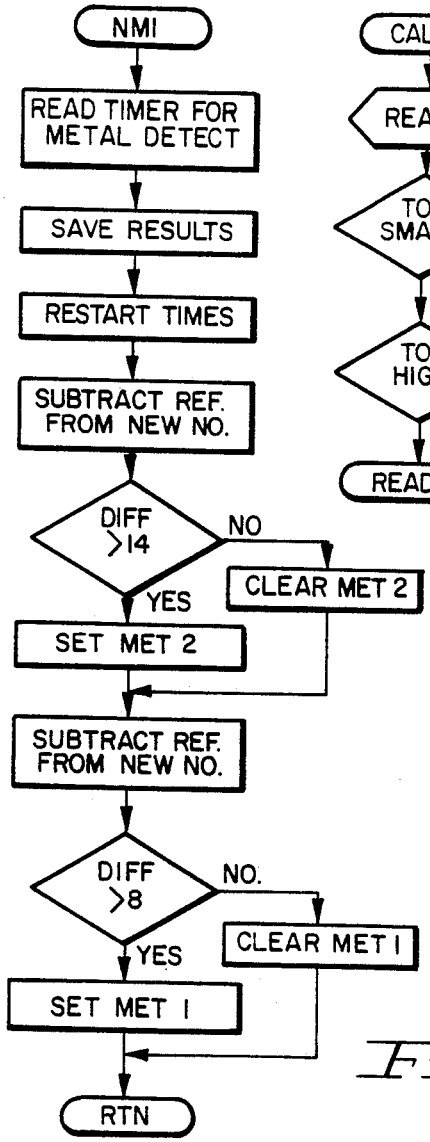
FIG. 37 is a flow diagram of the Non-Mascable Interrupt routine NMI of the present invention.
Figure 46:
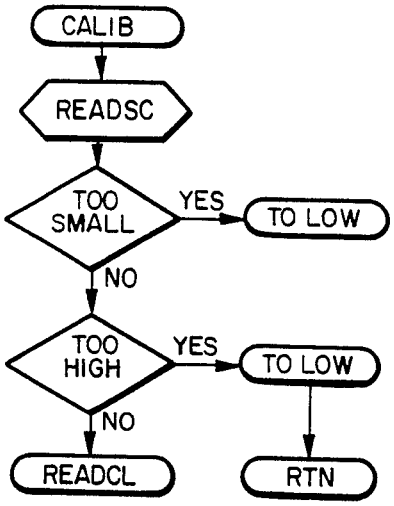
FIG. 46 is a flow diagram of the Calibration sub-routine CALIB of the present invention.
Figure 47:
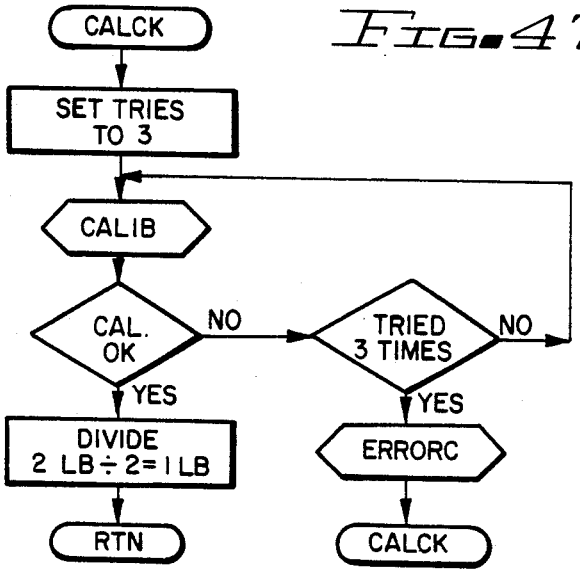
FIG. 47 is a flow diagram of the Calibration Check sub-routine CALIBCK of the present invention.
Figure 48A:
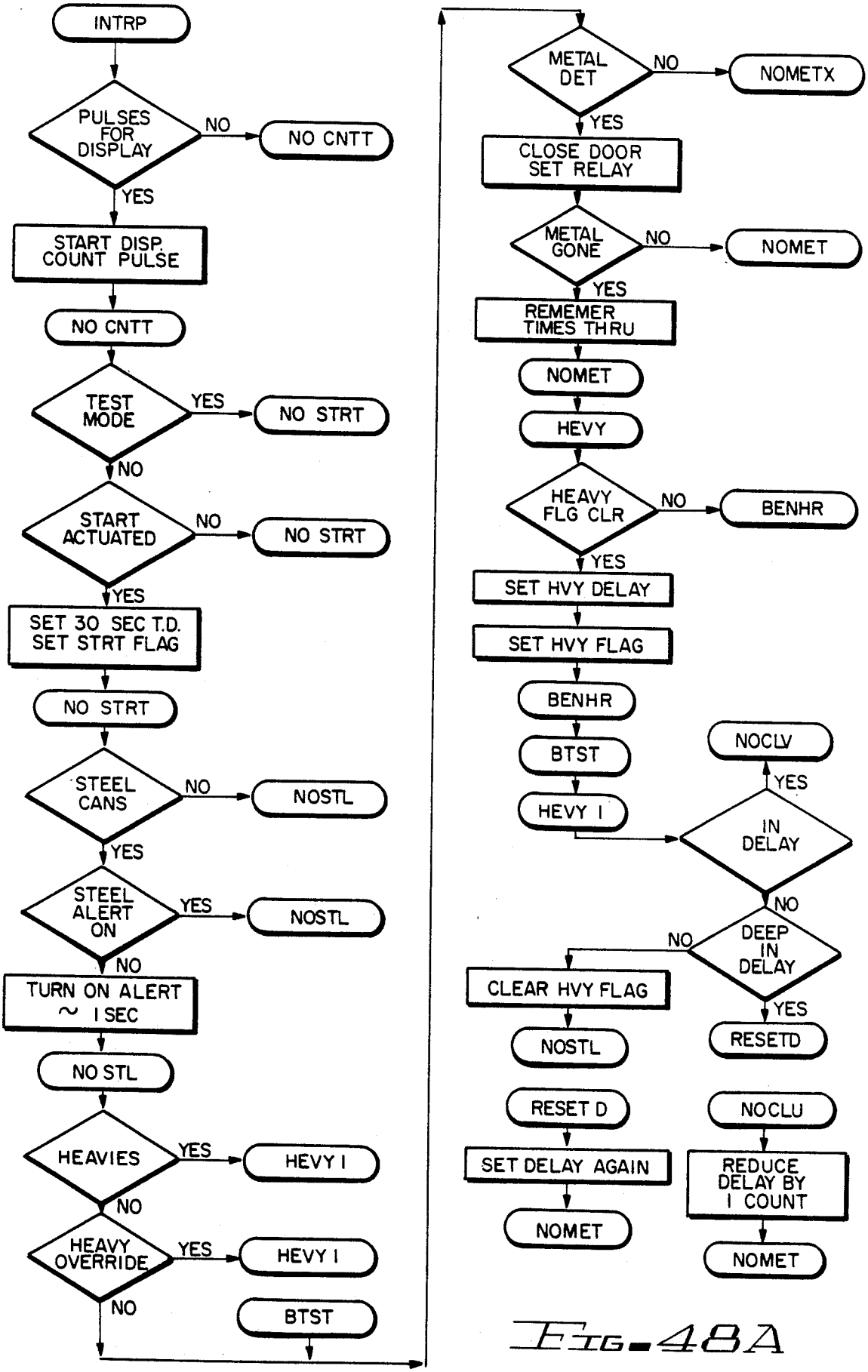
FIGS. 48 A, B, and C illustrate the flow diagram of the Interrupt program INTRP of the present invention.
Figure 48B:
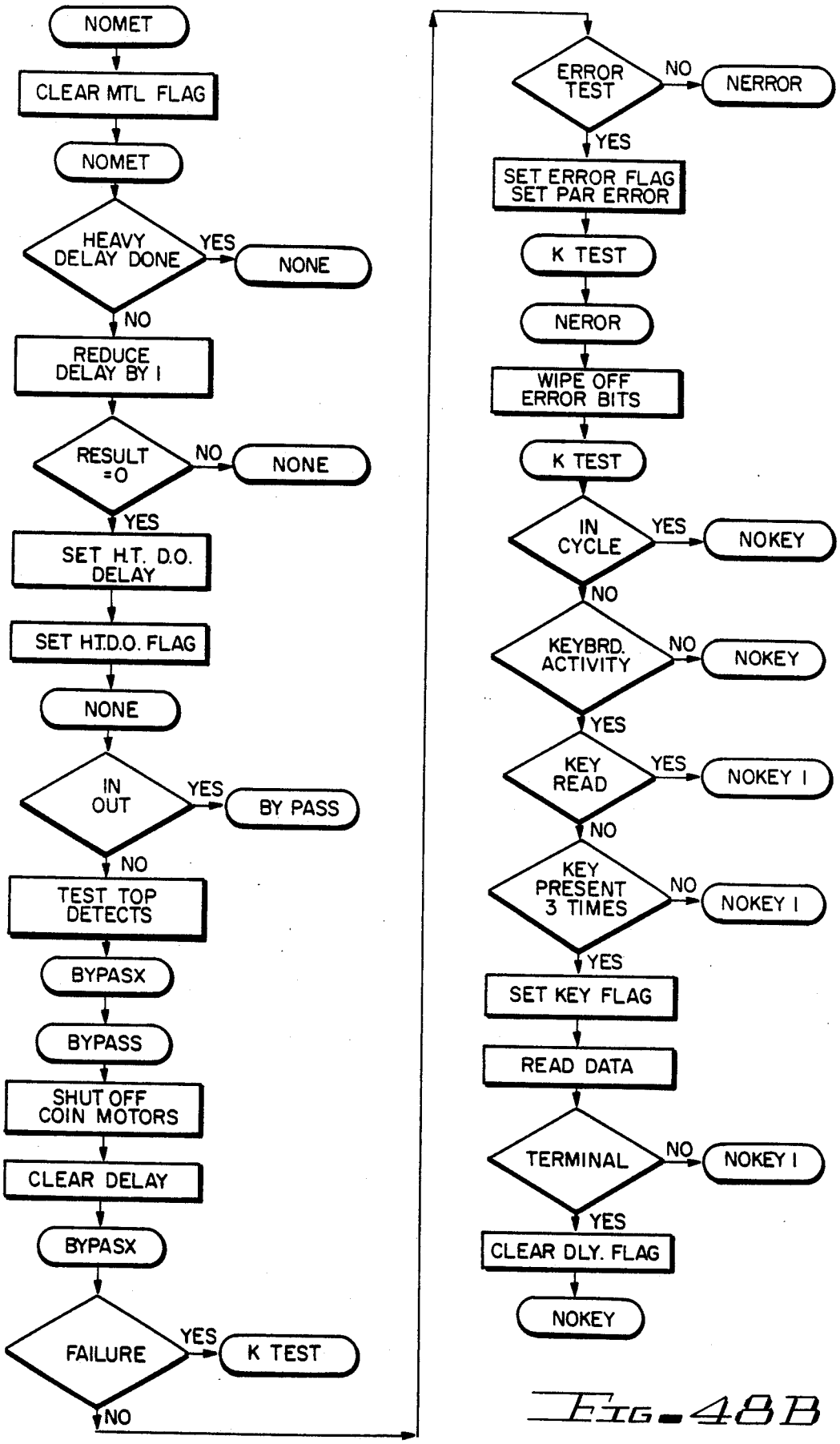
Figure 48C:
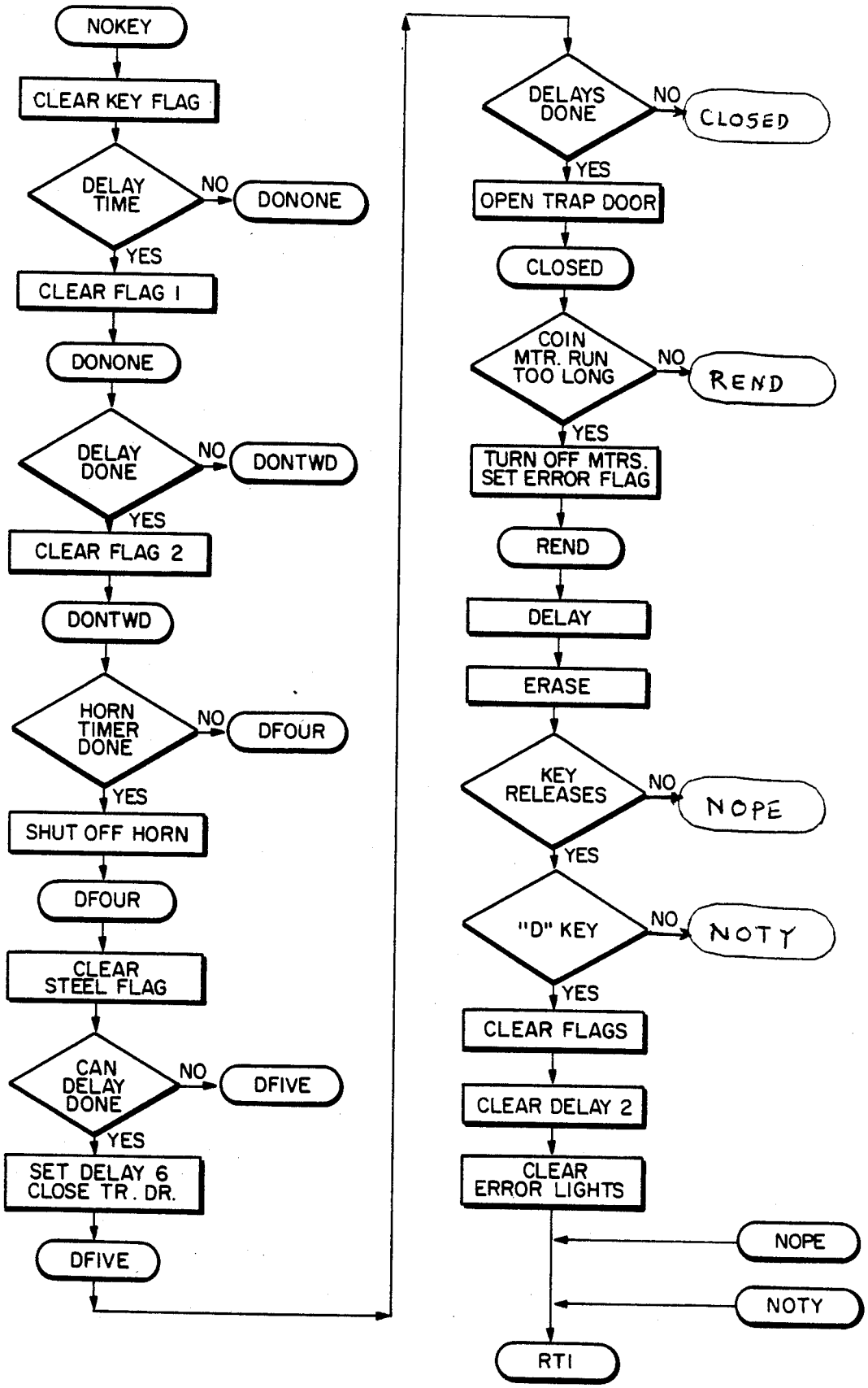

The NMI routine in FIG. 37 is used to determine the latest value of the metal and steel can detectors. It determines when a preset value that is greater than the threshold is reached and then it sets a flag to indicate to the system a substantial change between the new value and the just read value. Each time the timer/counters internal timer times out, this routine is entered because the non maskable interrupt NMI line is activated. For this application the interrupt is about every 16 milliseconds.

Operation, times, sensing, etc., is accomplished in real time using the maskable interrupt routine. In this routine the clock pulses to the front panel display, the start switch, the metal and steel detect, the heavy detect and delay, turning of the coin dispenser drums, error detector reading of the keyboard and sensing of the clear switch is accomplished.

First, a location, in which the count number for the front panel display is stored, and is tested. Should a count be needed, the display clock pulse is driven high. This pulse is concluded at the end of the Interrupt routine. After each test the count is decreased by one until it gets to zero. Next, the start switch is sensed. The sensing of the start switch is locked out when using the test mode. Assuming the test mode is not active, the sensing of a start switch sets a flag and sets, for example, a 30 second delay. Assuming a start switch, metal and steel cans are sensed using the data gathered during the NMI routine. Either the trap door is closed when metal is sensed, or the steel can alarm is signaled, when this sensing occurs. As material comes over the end of the conveyor, it is sensed to determine if it is too heavy by the heavy sensor. When this sensor provides a heavy signal, a delay is set that allows the heavy to be dropped through the trap door. During this time a heavy overrides the metal detector. Next, the routine processes data concerning coin dispenser demand. Should a top detect be sensed, the appropriate coin motor is turned on to drive the coin drum so that the coin dispenser is filled. Filling must occur within, for example, 30 seconds or the error flag will be set. Next the keyboard active input is sensed. When it is set and the data has not been used, it is ignored. When it is set and a key is not being processed, the data is stored and the key flag set. This allows the appropriate routine to recognize and use the data.

Finally, the fact that a clear position on the keyboard has been activated is detected. It is used to delete delays and clear flags so that the system is put back into operation.

The other software is used as part of the test or set up modes. When a key is pressed and the processor is executing code in the executive loop, the system enters the KEYBD routine where the key is processed. The following combination produce the indicated test results.

1. C0 enable steel and metal detector
2. C1 run a memory test
3. C2 dispense a penny every 4 sec
4. C3 dispense a nickel every 4 sec
5. C4 dispense a quarter every 4 sec
6. C5 dispense a token every 4 sec
7. C6 opens the bucket door for two sec every 4 sec
8. C7 closes the separator trap door for two sec every 4 sec
9. C8 run all motors
10. C9 run the displays
11. C# display weight in bucket The exit from all of these routines is accomplished with the "D" key. The set up code is confined to set up and reading of the counters and/or setting of pay rate. To set the pay rate a "B" followed by an "*" will allow the entrance of any pay rate up to $9.99. Exit is again by using the "D" key. The token set up is accomplished by using the "B" key followed by the "#" key. Token rate is from 1 to 99 pounds. To display the contents of the money counter an "A" is pressed with a "*". Immediately, amount of money paid out is displayed. Similarly, the display of the pounds counter is accomplished by pressing the "A" key followed by the "#" key. The accumulated pounds are then displayed to the nearest hundredth of a pound. The token drum can also be used as an additional quarter drum when the token rate is set to zero. Any time the keyboard is in use or testing is in progress, the out of order light is illuminated on the display panel.

The remaining flow diagrams of FIG. 38 through FIG. 48D add further description to the operation of the present system. All of the programming is within the level of ordinary skill given applicants' teachings. Totally obvious or conventional routines have not been diagramed or described to avoid confusion and cluttering this application.

With this detailed description of the specific apparatus used to illustrate the present invention and the operation thereof, it will be obvious to those skilled in the art that various modifications can be made without departing from the spirit and scope of the present invention which is limited only by the appended claims.

We claim:

1. A can collection apparatus for collecting aluminum cans from an assortment of trash, including tin-plated steel cans, plastics, paper items, glass, and the like, and for compensating the depositor of the aluminum cans based on the weight of the aluminum cans so deposited, said can collection apparatus comprising:

start means responsive to actuation by a depositor for initiating the system and starting all conveyor motors;

input conveyor means for transporting said assortment of trash from a first input conveyor station to a second input conveyor station;

input hopper means for receiving the deposited assortment of trash placed therein by a depositor, and for depositing same onto the first input conveyor station of said input conveyor means;

magnetic separator means proximate said second input conveyor station for separating out ferrous metal, including tin-plated steel cans, from said assortment of trash and dropping said ferrous metal into a steel can receptacle;

separator means including a separator conveyor means for transporting a non-ferrous assortment of trash from a first separator conveyor station to a second separator conveyor station, said first separator conveyor station having a separator input;

said second input conveyor station discharging said non-ferrous assortment of trash into the input of said separator means;

heavys detection means operatively disposed within the input of said separator means, and including an impact platform means for determining the weight of each of the items of said assortment of trash as they fall from said second input conveyor station onto said impact platform means as a function of the displacement of said impact platform means, said heavys detection means discharging all of said non-ferrous assortment of trash into the first separation conveyor station;

a digital metal detector means for separating out non-ferrous metal, such as aluminum cans, from the remaining assortment of trash, said second metal detection means including means for generating a transaction complete signal if no aluminum cans are detected for a pre-determined period of time indicating that the depositor is done placing said assortment of trash into the input hopper means;

means responsive to the detection of heavys and to the detection of non-ferrous metals such as aluminum cans for dropping heavys and non-metals, such as plastics, paper items, glass, and the like, into a non-metal and heavys receptacle;

weighing means including a weighing bucket whose weight is initially zeroed for weighing the crushed aluminum cans deposited therein on a continuous basis, means for sensing when the weight bucket is full and generating a full signal in response thereto, means responsive to at least one of said full signal and said transaction complete signal for initiating a cycle pause, taking a final weight reading, and activating a door dump solenoid to open the bucket door and drop the contents thereof, and means for reclosing the door and ending the cycle pause to begin weighing again;

crusher means receiving aluminum cans from the second separator conveyor station of said separator means for crushing said cans and emptying the crushed aluminum cans into said weight bucket, said crusher means being responsive to said cycle pause for shutting off for permitting incoming aluminum cans to be stored at the input thereof until crushing resumes when the cycle pause is ended, said crusher means further including detector means operatively disposed at the input thereof for generating a full alarm signal if too many aluminum cans accumulate at the crusher input;

a storage bin conveyor means for transporting crushed aluminum cans from a first storage bin conveyor station to a second storage bin conveyor station;

said input conveyor means, said separator conveyor means and said storage bin conveyor means operating on a continuous basis from the time a depositor activates the start means and begins placing said assortment of trash into the input hopper means until the cycle is complete and a transaction complete signal is received, said conveyors being responsive to various alarm signals indicative of a need to stop the conveyors for shutting down the continuous mode of operation until the alarm condition is cleared;

lateral transfer means operatively disposed proximate the output of said weight bucket for receiving crushed aluminum cans dumped from said weight bucket and transferring the said crushed aluminum cans to said first storage bin conveyor station;

a storage bin means operably disposed proximate the second storage bin conveyor station for transferring the conveyed crushed aluminum cans to said storage bin for temporary storage therein;

coin dispenser means responsive to control signals for dispensing compensation to the depositor in accordance with the measured weight of aluminum cans deposited, said coin dispensing means including means for detecting a coin jam and an out-of-coins condition and for generating an out-of-money alarm signal in response thereto, said coin dispenser means being responsive to control signals for periodically dispensing the highest valued coin therein each time a weight of crushed aluminum cans corresponding thereto is weighed, and for dispensing the remaining coins to provide compensation to the nearest one cent whenever a pause cycle occurs indicating that the weighing bucket is full or when the transaction is complete;

display means operably disposed to the depositor of aluminum cans for displaying thereto alarm conditions, an out-of-order condition, a separate out-of-money light, a continuous display of weight in some even integral amount, a continuous display of compensation calculated in the largest denomination coin present in the dispenser means, and for dispensing said coin for each weight unit corresponding thereto, and for displaying the full total weight to the nearest tenth and hundredth of a pound and the final total compensation to the nearest cent when the weighing bucket is full and when the transaction is complete;

microprocessor-based control means responsive to alarm signals, weight readings, start signal, compensation rate, time delays, and monitored status information for generating various control signals for controlling the operation of the present signal, said control means rechecking alarm conditions at periodic intervals for restoring system operation if the problem has been solved.

2. The apparatus of claim 1, wherein said digital metal detector means is a digital self-adjusting metal detector for separating non-ferrous metallic objects from non-metals and for generating a signal when a non-ferrous metal, such as an aluminum can, is detected.

3. The apparatus of claim 1, wherein said means for dropping heavys and non-metals, such as plastic, paper items, glass, and the like, into said non-metal and heavys receptacle includes a normally-opened separator dump door operably disposed above said non-metals and heavys receptacle;

solenoid means operatively coupled to said normally opened separator dump door, said solenoid means being responsive to the detection of a non-ferrous metal object, such as an aluminum can, for closing the door and permitting the separator conveyor means to transport said aluminum can over said closed separator dump door to the input of said crusher means; said solenoid means then restoring the separator dump door to its normally-opened position.

4. The apparatus of claim 1 further including means for automatically dispensing at least one manufacturer's coupon per transaction through a coupon slot as a bonus to depositors for conserving aluminum, saving energy, and cleaning up the environment, and to encourage depositors to use a given manufacturer's products or the like, the coupons being dispensed at no cost to the depositors.

5. The apparatus of claim 1 wherein said input conveyor means includes means operably disposed proximate thereto for detecting the occurrence of a jam thereon and generating a jam alarm signal indicative thereof.

6. The apparatus of claim 1 wherein said storage bin conveyor includes means operably disposed proximate the storage bin conveyor for detecting the occurrence of a jam thereon and for generating a storage bin conveyor jam alarm signal indicative thereof.

7. The apparatus of claim 1 wherein said start means includes a digital metal detector means operably disposed proximate said input hopper means for detecting metal material placed into the input hopper by a depositor and generating a signal indicative thereof, said control means being responsive to said indicative signal signal for generating a start command signal and turning on the system.

8. The apparatus of claim 1 wherein said start means includes a start switch.

9. The apparatus of claim 1 wherein said input conveyor means includes a driven conveyor drum proximate to said input conveyor discharge station, a plurality of magnetic means operably disposed about the surface of said drum for attracting and retaining ferrous metal objects, such as tin-plated steel cans and the like, to the outside surface of an input conveyor belt through at least 180 degrees as said belt circles said drum before losing magnetic attraction and dropping said ferrous metal material after the portion of the first conveyor means on which the ferrous material was magnetically retained passes off of the drum, and further including delivery chute means operably disposed beneath the point on said drum where the magnetic attraction becomes insufficient to hold said ferrous material for receiving the dropped ferrous material and directing same to the said steel can receptacle.

10. The apparatus of claim 1 wherein said heavys detector means further includes a cantilever beam member;

a counterweight operatively disposed proximate one end portion of said cantilever beam member; said impact platform being pivotally attached to said cantilever beam member; and microswitch means operatively associated with the opposite end portion of said cantilever beam member for being activated whenever an article of sufficient weight falls upon said impact platform and is heavy enough to overcome the counterweight on said cantilever beam and permit the opposite end theretof to contact said micro-switch, said micro-switch generating a heavys alarm signal indicative of the presence of a heavy falling on said impact platform.

11. The apparatus of claim 1 wherein said system includes a telephone link with a remote station for servicing said apparatus, an auto-dialer means for automatically dialing the telephone number of said remote station and conveying various alarm messages thereto, and wherein said microprocessor-based control means includes means responsive to alarm conditions for activating said auto-dialer means, including activating said auto-dialer in response to a signal indicating that the storage bin is full and must be emptied.

12. The apparatus of claim 1 further including means for generating signals indicative of various alarm conditions and transmitting same back to a remote station via communication means for requesting a truck for emptying said storage bin, for requesting maintenance, for requesting a supply of coins, and the like.

13. The apparatus of claim 1 including self-adjusting means associated with said microprocessor-based control means for providing critical adjustments on zeroing, initializing, calibration, and metal sensing without human intervention for calibration or the like.

14. The apparatus of claim 1 wherein means for storing the compensation ratio for the aluminum cans is selectively adjustable from 1¢ per pound to $9.99 per pound.

15. The apparatus of claim 1, wherein said weighing bucket includes a flange operatively disposed above the entrance thereto;

a plurality of first fastening means operatively coupled to said flange at positions insuring an even distribution of the bucket weight therebetween;

a stabilizer platform;

a plurality of second fastening means equal in number to said plurality of first fastening means and operatively coupled to said stabilizer platform and positioned to insure an even distribution of any weight applied thereto;

a plurality of strap means operatively securing corresponding first and second fastening means for supporting said weighing bucket, said weighing means further including a load cell;

a universal joint operatively coupling said load cell to said stabilizer platform for significantly improving the weighing accuracy of said weighing means.

16. The apparatus of claim 15 wherein said plurality of first fastening means, said plurality of second fastening means, and said plurality of strap means each include 3.

17. The apparatus of claim 15 wherein said weighing bucket door includes a lightweight durable bucket door to reduce oscillations due to opening and closing the bucket door.

18. The apparatus of claim 17 wherein said bucket door further includes a polypropylene plastic material for achieving a long-lasting extended life while simultaneously damping or eliminating transient oscillations when the door is opened and closed.

19. The apparatus of claim 1 further including means for automatically calibrating said weighing means, said automatic calibrating means being updated at the start of each new cycle of operation for improving the accuracy of the said weighing means.

20. The apparatus of claim 19 further including means for initalizing said load cell, said load cell initializing including a sample resistor means having a voltage displacement value exactly equivalent to a strain on the load cell of a pre-determined fixed weight, said resistor means being switched into the circuit and the resulting voltage measured by said microprocessor means, the measured value of voltage being used to establish the weight equivalent of said pre-determined amount under the present set of variable conditions for insuring a good load cell measurement accuracy under all conditions.

21. The apparatus of claim 1 wherein said input conveyor means includes flapper means operably disposed proximate a rising portion of said conveyor means for preventing said assortment of trash from becoming stuck on top of the conveyor lugs for preventing jams and the like and for preventing cans and the like from rolling back down the conveyor.

22. The apparatus of claim 21 wherein said input conveyor means further includes brace means operably disposed proximate to top surface of said conveyor means for stripping out over-sized objects and material such as paper bags, plastics, and the like, to prevent jams.

23. The collector apparatus of claim 21 wherein each of said conveyor means further includes means of detecting jams and generating an alarm signal indicative thereof.

24. The apparatus of claim 21 wherein said flapper means of said input conveyor includes a mercury switch means for determining whether or not the input conveyor is moving.

25. The apparatus of claim 1 wherein said separator conveyor means operably disposed proximate said conveyor means for detecting a jam thereon and generating a separator jam alarm signal indicative thereof.

26. The collector apparatus of claim 25 further including means for detecting a loss of power and generating a signal indicative thereof, said control means being responsive to said signal indicative of the loss of power for generating a reset signal, and said non-volatile memory being responsive to said reset signal for automatically storing the working data into the non-volatile memory for preserving same throughout the power out situation until power is once more restored and normal system operation resumed.

27. The apparatus of claim 1 wherein the said separator conveyor means includes flapper means operably disposed proximate the top surface of said conveyor for preventing said assortment of trash from becoming stuck on top of the conveyor lugs and the like to prevent jams and to prevent cans from falling backward.

28. The apparatus of claim 27 further including a second display means internal to said housing for displaying at least one of alarm conditions, full status conditions, accounting data and the like to maintenance personnel and the like.

29. The apparatus of claim 27 wherein said flapper means of said separator conveyor includes a mercury switch means for determining whether the separator conveyor is moving.

30. The apparatus of claim 1 wherein said storage bin conveyor means includes flapper means operably disposed proximate the top surface of said conveyor for preventing crushed aluminum cans from being stuck proximate to top of conveyor lugs for preventing a jam or the like and to prevent cans from rolling back down the conveyor.

31. The apparatus of claim 30 wherein said flapper means of said storage bin conveyor includes a mercury switch means for determining whether the storage bin conveyor is moving.

32. The apparatus of claim 1 further including means for detecting a steel can dropping into said steel can receptacle and for generating a steel can signal in response thereto said control means responsive thereto for advising the depositor thereof.

33. The apparatus of claim 32 wherein said steel detecting means includes a digital metal detector operably disposed proximate the dropping means for detecting ferrous metal objects, including tin-plated steel cans, and generating a signal indicative thereof, said control means operating said display to advise the depositor that a steel can was received, said digital metal detectors signals being counted by said control means to determine when said steel can receptacle is full.

34. The apparatus of claim 32 further including means for detecting when said steel can receptacle is full and generating a full receptable alarm signal in response thereto.

35. The apparatus of claim 34 further including means for detecting when said non-metal and heavys receptacle is full, and generating a receptacle full alarm signal indicative thereof.

36. The apparatus of claim 1 wherein said storage bin further includes a separation partition means operatively separating the said storage bin from said input conveyor means, separator means, crusher means, weighing means, and storage bin conveyor means; said apparatus further including a centrifugal fan means, a motor for driving said centrifugal fan means, a substantially hollow housing means having an opening in the upper portion thereof, a paddle wheel metering means operatively disposed in said opening for rotating to deposit a given amount of crushed aluminum cans into said housing with each partial revolution between said paddles, means for operatively coupling the output of said centrifugal blower into an inlet in a rear portion of said housing, a means for directing substantially all crushed aluminum cans conveyed in said storage bin into said metering device, conduit means operably coupled to an outlet on the opposite end of said housing for conveying by blowing crushed aluminum cans metered into said housing out of said storage bin for loading into transportation means for transport to a recycling center or the like.

37. The apparatus of claim 36 wherein said conduit means includes means operably disposed up one wall of said storage bin and across the ceiling to an outlet in said housing for blowing stored cans therethrough, said conduit means having a generally rectangular cross-section.

38. The apparatus of claim 36 wherein said control means keeps track of the weight of aluminum cans emptied from the weighing bucket to determine when the storage bin is full and generating an alarm signal indicative thereof.

39. The apparatus of claim 36 wherein said metering means includes a motor for driving same and the force of said centrifugal fan is such that the crushed aluminum cans from said storage bin are passed through said metering device and out of said bin at a rate of approximately 5,000 pounds of crushed aluminum cans per hour, this rate being selectively variable by increasing speed of metering means, size of opening, and paddles and the like.

40. The apparatus of claim 36 wherein said storage bin includes means for detecting when said storage bin is full and generating a storage bin full signal in response thereto.

41. The apparatus of claim 1 further including means for self-testing various alarm conditions periodically to assist in trouble-shooting and the like, and for automatically restarting if the alarm condition has cleared.

42. The apparatus of claim 41 further including means responsive to the occurrence of an alarm condition for testing the alarm condition on a periodic basis to minimize down time and restore the operation of the system if the alarm condition is cleared.

43. The apparatus of claim 1 wherein said microprocessor-based control system includes a non-volatile memory for storing the current compensation rate and the like to prevent tampering.

44. The apparatus of claim 43 wherein said non-volatile memory automatically stores away working data each time the power goes off, the memory system including means for detecting an impending power failure and sending a signal indicative thereof to said microprocessor-based control system, said control system generating a store signal and transmitting same to said non-volatile memory to insure that all working data is saved until the power is again restored and system operation is re-established.

45. Collector apparatus for collecting scrap metal of a given type from an assortment of refuse including ferrous metals, non-ferrous metals, and non-metals, such as glass, plastic, paper, and the like, and for compensating depositors of such scrap metal of a given type based on the weight of said scrap metal of a given type deposited, comprising:

input hopper means adapted to have an assortment of refuse, including metal of said given types, placed therein;

classifier means for classifying and separating said scrap metal of a given type from said assortment of refuse;

an input conveyor means having an input conveyor motor for transporting said assortment of refuse deposited in said input hopper means to said classifier means;

ferrous metal separator means operatively disposed proximate the upper end of said input conveyor means for separating out ferrous materials, including tin-plated steel cans, from said assortment of refuse, and for depositing said ferrous scrap metal which is not of said given type, into a first receptacle;

said upper end of said input conveyor means depositing the remaining non-ferrous assortment of refuse into said classifier means;

means operably disposed at the input of said classifier means for detecting heavys and generating a signal indicative thereof;

said classifier means further including digital metal detector means for detecting non-ferrous metals such as aluminum cans, said classifier means depositing said detected heavys and undetected non-metals into a second receptacle;

a crusher powered by a crusher motor, for crushing non-ferrous scrap metal of a given type;

a classifier conveyor means for transporting non-ferrous scrap metal of said given type to the crusher;

a weigher having a hopper for weighing material dropped into the hopper, said weigher being positioned so that the material passing through the crusher is deposited in the hopper, said weigher including means for producing electrical signals which are a function of the weight of the hopper and of the material placed in the hopper from the crusher; said weigher generating said weight indicative signals on a continuous basis and including means for determining when a pre-determined weight of aluminum cans have been deposited into said hopper for generating a signal indicative thereof;

said means for detecting non-ferrous metals generating a transaction complete signal whenever no incoming aluminum cans have been detected for a pre-determined period of time;

said weighing means responsive to a control signal generated in response to said transaction complete signal and said indicative signal for entering a time out state;

said time out state turning off said crusher motor so that incoming aluminum cans accumulate in the input thereto during the weighing operation, and said weighing means delaying a predetermined time for stabilizing the weighing bucket and obtaining a final reading of bucket plus deposited crushed aluminum cans, mean responsive to the termination of the weighing operation for opening the bucket dump door and dumping the contents thereof;

said weighing means weighing the hopper itself after a predetermined period of time for stabilization, so that the weight of the bucket plus contents less the weight of the bucket is equal to the weight of the contents to a very high degree of accuracy;

a storage compartment for said non-ferrous metal of a given type;

a storage bin conveyor means having a storage bin conveyor motor for transporting crushed non-ferrous metal of said given type dumped from said weigher hopper to said storage compartment for temporary storage therein;

a coin dispenser means responsive to the control signals for dispensing compensation to the depositor, for producing an out-of-order alarm system for identifying the absence of coins to be dispensed, and a jam alarm signal for indicating the presence of a coin jam within said dispenser;

means for monitoring the operation of the motors and producing a motor alarm signal indicative of a failure thereof;

jam monitoring means operably disposed proximate to said input conveyor means, said separator conveyor means, and said storage bin conveyor means, for detecting a jam and generating a jam alarm signal indicative thereof;

digital metal detecting means associated with the chute directing steel cans into said first receptacle for tin-plated steel cans and for ferrous metals and operably disposed proximate said chute for detecting steel cans and the like and enerating a count signal indicative thereof;

means responsive to an indication that said first receptacle is full for generating an alarm signal indicative thereof;

means associated with said non-metal and heavys receptacle for detecting when said receptacle is full and generating an alarm signal indicative thereof;

means operably disposed proximate the input of said crusher for detecting the presence of the jam and generating an alarm signal indicative thereof, and for detecting when the input to said crusher is full for generating an alarm condition indicative thereof;

means for detecting when storage bin is full and generating an alarm condition indicative thereof;

a microprocessor-based control means for producing control signals for energizing and de-energizing the input conveyor motor, the classifier conveyor motor, the crusher motor, and the storage bin conveyor motor; for automatically calibrating the weighing system; for automatically initializing the load cell; for dumping the weigher hopper; for determining the weight of said given type of non-ferrous metal deposited in the weighing bucket; for determining the amount of compensation to be paid to the depositor; for controlling the dispensing of the largest value of coin in the dispenser each time the weight in the bucket is incremented by a corresponding amount; means for displaying the compensation and incrementing same each time said largest value of coin in said dispenser is dispensed; means for continually weighing the contents of said weighing hopper indicating to the depositor each time a given increment is added, signalling time out in response to a transaction complete signal and in response to the weight in said weighing bin having reached a predetermined amount for turning off the crusher motor and allowing incoming cans to accumulate at the input thereof while the weighing operation is completed, for initially weighing, after a predetermined delay, the weight of the hopper plus contents, for subsequently dumping the contents, for then weighing, after a predetermined delay, the weight of the empty bucket, for calculating the difference to arrive at the final weight for which the depositor is to be compensated, displaying the weight to the depositor to the nearest tenth and one-hundredth of a pound and displaying the compensation to the nearest one cent, operating said dispenser means in terms of lesser value coins to pay the final amount to said nearest cent, said control means responsive to said alarm signals for energizing alarms as appropriate, for indicating alarm conditions and out-of-order indications on said display means, and for de-energizing the motors of said apparatus if the condition causing an alarm persists for more than a predetermined period of time, said control means further including means for periodically retesting the alarm condition and re-activating the system if the alarm condition no longer exists.

46. The collection apparatus of claim 45 wherein said scrap metal of a given type is aluminum and primarily aluminum cans, and said ferrous metal is primarily tin-plated steel cans, and wherein said non-metals include glass, plastic, paper, and the like.

47. The collector apparatus of claim 45 wherein said means for detecting heavys includes a heavys door operably disposed at the entrance of said classifier means and responsive to the weight of articles of said non-ferrous assortment of refuse as they fall on said heavys door and displace a member associated with said door a pre-determined distance for determining articles heavier than a pre-determined threshold weight.

48. The collector apparatus of claim 45 wherein said means for detecting non-metals includes a digital self-adjusting metal detector means used to separate non-ferrous metallic objects from non-metals, said digital self-adjusting metal detector also generating a transaction complete signal whenever no non-ferrous metallic objects have been detected for a predetermined period of time, indicating that the depositor has completed his transaction.

49. The collector apparatus of claim 45 wherein said classifier means includes a normally-opened trapdoor operably disposed above said non-metals and heavys receptacle for normally dumping non-metal materials, such as plastics, paper, glass, and the like, plus heavys therethrough, and means responsive to the detection of non-ferrous metals, such as aluminum cans, for generating a signal indicative thereof, said microprocessor-based control means being responsive to said indicative signal for generating a control signal and further including means responsive to said control signal for closing said trapdoor to enable the classifier conveyor means to transport said non-ferrous metal into said crusher with non-metal refuse and heavys being dropped through said trapdoor into said second receptacle.

50. The collector apparatus of claim 45 wherein said heavys detector includes a heavys door, a cantilever beam pivotally connected to said heavys door, a counterweight proximate the end of said cantilever beam for setting a threshold weight for determining a heavy; and a microswitch operably disposed proximate the opposite end of said cantilever beam, such that objects falling onto said door will displace the opposite end of said cantilever beam some distance, and when the distance is sufficient to contact said microswitch, said microswitch generates a signal indicative of the detection of a heavy at the input of said classifier means.

51. The collector apparatus of claim 45 wherein weigher apparatus includes means for auto-calibration of said weigher means at the start of each cycle, means for initializing said load cell to improve the voltage-to-count ratio thereof and thereby the accuracy of said weighing system.

52. The collector apparatus of claim 45 further including means for detecting aluminum cans entering the classifier but not reaching the weighing bucket.

53. The collector apparatus of claim 45, wherein said input conveyor means, said classifier conveyor means, and said storage bin conveyor means include means for preventing jams.

54. The collector apparatus of claim 45 wherein a pre-set computation rate is stored in a non-volatile static memory so as to render it tamperproof.

55. The collector appartus of claim 45 wherein said input hopper means includes a curved slide means for preventing persons from inserting arms and the like and getting injured or committing vandalism.

56. The collection apparatus of claim 45 wherein said hopper includes a flange operably disposed above the opening thereof, and said weigher apparatus further includes a rectangular plate, strap means operably disposed between said flange and said plate equally distributing the weight of said hopper and the contents thereof over said plate, a load cell for measuring the weight of said bucket, and a universal joint operatively coupling the load cell to the plate for greatly improving the accuracy of the weighing apparatus.

57. The collector apparatus of claim 56 wherein said hopper further includes a hopper dump door for emptying the contents of said hopper when the weighing operation is complete, means for detecting the presence of an open door and generating an alarm signal indicative thereof, solenoid-operated means for releasing said door, said door including a lightweight plastic material such as polypropylene for damping and substantially eliminating transient oscillations produced when opening and closing said door, thereby further improving the accuracy of the weighing system.

58. The collector apparatus of claim 45 wherein said input conveyor means continually operates throughout the cycle and does not stop, even during the weighing operation, when the weighing operation begins, the crusher motor stops and the aluminum cans supplied by said input conveyor means and said classifier conveyor means are temporarily stored at the input of said crusher until the weighing operation is complete and the crusher is again energized.

59. The collector apparatus of claim 58 wherein said crusher includes means operably disposed at the input thereof for detecting the presence of a jam and generating a crusher jam signal indicative thereof and for detecting when the crusher input is full for generating a crusher full alarm system indicative thereof.

60. The collector apparatus of claim 45 wherein said storage bin is physically separated from said input conveyor means, said classifier means, said crusher, said weighing means, and said storage bin conveyor means;

and wherein said apparatus further includes a centrifugal fan having a fan motor, said centrifugal fan producing a stream of air, and means for directing said stream of air through said storage bin for emptying said bin by blowing the crushed aluminum cans out of said bin and into the back of a means for carrying the cans to a recycling center or the like.

61. The collector apparatus of claim 60 wherein said storage bin includes a housing means;

an aperture in the top of said housing means;

paddle-like metering means operatively disposed in the aperture of said housing, said metering means collecting a pre-determined amount of crushed aluminum cans in adjacent paddles and metering motor means for operatively rotating said paddle means for dumping said pre-determined amount of cans between paddles into said housing with each fraction of a rotation thereof; and means for operatively coupling the output of said centrifugal fan into one end of said housing and conduit means operatively coupled to the opposite end of said housing to an outlet proximate the ceiling for blowing crushed aluminum cans out of said storage bin and into means for conveying the crushed aluminum cans to a recycling center or the like.

62. The collector apparatus of claim 61 wherein said storage bin further includes sloping slide means for directing substantially all crushed aluminum cans fed into said storage from said storage bin conveyor means toward said metering means and where the force of said air and the speed of said paddle-like metering means, is such that approximately 5,000 pounds of crushed aluminum cans per hour can be emptied from said storage bin without manual intervention.

63. The collector apparatus of claim 62 wherein said rate is selectively variable.

64. The collector apparatus of claim 61 wherein said conduit has a generally rectangular cross-section.

65. The collector apparatus of claim 45 wherein each of said jam detection means, said receptacle full detector means, and said tin-plated steel can detection means, includes an electro-magnetic radiation detector which operates in the infrared spectrum.

66. The improved collector apparatus of claim 65 wherein said classifier includes a normally-opened trapdoor means operably disposed above said second receptacle for dropping non-metals and heavys therethrough into said second receptacle;

solenoid means responsive to the detection of non-ferrous metal by said digital metal detector for closing said trapdoor and allowing the classifier conveyor to transport the detected aluminum can into the input hopper of the crusher; and further including means for overriding a metal detection signal for maintaining said trapdoor opened whenever a heavy is calculated to arrive at said trapdoor on said classifier conveyor for dumping said heavy into said second receptacle even though it may comprise metal.

67. In a collection apparatus for collecting aluminum cans from an assortment of material and for compensating a depositor for such aluminum cans as a function of the weight of the aluminum cans deposited in the storage compartment of the apparatus, said apparatus having an input means for receiving said assorted material placed therein by a depositor, a start button for initiating operation of the system, a first conveyor for transporting assorted material from the input means to a classifier, said classifier detecting and segregating ferrous metal such as tin-plated steel cans from the non-ferrous materials and for depositing the ferrous metal in a ferrous metal receptacle and for depositing the non-ferrous material into a classifier conveyor, said classifier also including means for detecting heavys, metal detector means for detecting non-ferrous metals, such as aluminum cans, and means for separating non-ferrous metals from non-metals, said classifier conveyor transporting non-ferrous metals comprising aluminum cans to a crusher input hopper for loading said aluminum cans into a crusher and for dumping non-metals and heavys into a second receptacle, said crusher compacting aluminum cans and loading the crushed aluminum cans into a weigher bucket of a weigher means for measuring the weight of the crushed aluminum cans in said bucket, a storage bin, a storage bin conveyor means for transporting the crushed aluminum cans after being weighed and dumping same into the storage bin, and a microprocessor-based control system for initiating the system, for energizing the various motors of the system, for monitoring system operations, for controlling system initiation and calibration, for processing alarm signals, for performing weighing calculations, for performing compensation calculations, and for operating a coin dispenser means for paying the calculated compensation to the depositor, the improvement comprising:

said means for detecting heavys includes impact platform means operably disposed within the entrance of said classifier for receiving the various non-ferrous materials dropped from the end of said first conveyor means;

a cantilever beam pivotally coupled to said impact platform means, said cantilever beam including an elongated beam portion and a counterweight operably disposed proximate the end portion of said elongated beam for establishing a threshold weight over which valve any falling object will be classified as a heavy;

a microswitch means operably disposed proximate the opposite end of said cantilever beam and a predetermined distance therefrom, the weight of an object falling onto said impact platform means being taken as a function of the displacement of the impact platform means and the opposite end of said cantilever beam, said opposite beam of said cantilever beam activating said microswitch whenever the weight of an object falling on said impact platform is greater than the threshold established by said counterweight; and said microswitch generating a heavys signal to said microprocessor-based control system in response to the detection of a heavy falling upon said impact platform.

68. The improved collection apparatus of claim 67 wherein said classifier for detecting and segregating ferrous metals includes an end portion of said first conveyor, the end portion of said first conveyor including an upper conveyor drum and a plurality of magnetic devices operatively disposed about the outer surface of said drum, the rotation of said magnet-covered drum by said first conveyor attracting ferrous materials, such as tin-plated steel cans, to the surface of said first conveyor for at least 180 degrees around said drum, with said magnetic attraction weakening as said first conveyor comes off of said drum until said ferrous materials are dropped from said first conveyor;

chute means for operatively receiving the ferrous materials dropped from said first conveyor means for operatively directing said ferrous materials into said ferrous metal receptacle.

69. The improved collection apparatus of claim 67 further including a metal detector means for detecting non-ferrous metals, such as aluminum cans and generating a signal indicative thereof.

70. The improved collection apparatus of claim 67 wherein said metal detection means includes a digital self-adjusting metal detector for separating non-ferrous metallic objects from non-metals, said digital metal detector including means for generating an aluminum can detection signal each time such detection occurs, said signal being supplied to said microprocessor-based control system for generating a termination complete signal whenever no aluminum cans are detected for a pre-determined period of time, and for indicating to the microprocessor-based control system when aluminum cans are entering the classifier but not reaching the weighing bucket.

71. The improved collection apparatus of claim 67 further including means for determining the number if aluminum cans that have passed said metal detector in said classifier but have not reached said weighing bucket.

72. The improved collector apparatus of claim 67 further including digital self-adjusting metal detector means operably disposed proximate said chute means for detecting the presence of a tin-plated steel can dropped into said ferrous receptacle and for generating a signal indicative thereof, and wherein the said microprocessor-based control system includes means responsive to said steel can indicative signal for displaying the fact that a steel can has been deposited to the depositor.

73. The improved collector apparatus of claim 72 further including electromagnetic radiation producing and detection means operably disposed proximate the top of said ferrous receptacle for producing a receptacle full alarm signal whenever the ferrous receptacle is full, and said second receptacle including electromagnetic radiation and detecting means including electromagnetic radiation in the infrared spectrum for detecting when said second receptacle is full and generating a second receptacle full alarm signal indicative thereof.

74. The improved collections apparatus of claim 73 wherein said crusher input hopper includes electromagnetic radiation producing and detecting means, including radiation in the infrared spectrum for detecting the presence of a jam in said crusher input hopper and generating a crusher jam alarm system indicative thereof and for detecting a crusher input full condition and generating an alarm signal indicative thereof; and said control system responsive to said jam signal and said full signal for generating a command for stopping all conveyors until the condition causing the alarm is rectified.

75. The improved collector apparatus of claim 67 further including display means for displaying both the weight and compensation plus various alarm conditions to the depositor.

76. The improved collector apparatus of claim 75 wherein a second display means is operatively disposed within said apparatus for displaying alarm conditions and codes for assisting maintenance personnel and the like.

77. The improved collection apparatus of claim 67 wherein said first conveyor, said classifier conveyor, and said storage bin conveyor are operated continuously for improved system throughput;

means responsive to the weight of crushed aliminum cans in said hopper having attained a predetermined weight for generating a begin weighing command;

said microprocessor-based control system responsive to at least one of said begin weighing commands and said transaction complete signal for initiating a time out state;

control system responsive to said time out state for stopping said crusher and accumulating incoming aluminum cans at the crusher input while said time out state exists;

for terminating the time out state when weighing is complete; and means responsive to the termination of said time out state for reactivating the crusher to restore normal system operation.

78. The improved collection apparatus of claim 77 wherein said weigher includes a load cell and said weighing bucket and the crushed aluminum cans therein are weighed on a continuous basis as cans are added from the output of said crusher, said weight bucket and the crushed aluminum cans therein being accurately weighted a pre-determined time delay after said time out state is declared and the combined weight reading is sent back to said control system, said control system generating a dump command, said weight bucket including a dump door and means responsive to said dump command opening said bucket door and emptying the contents of said bucket onto said storage conveyor, said bucket including means for closing said bucket door after the weight bucket is emptied, said load cell measuring the weight of the empty bucket after a pre-determined time delay after the door is closed and sending the weight reading back to the control system, said control system subtracting the weight of the empty bucket from the weight of the bucket plus cans to calculate the weight of the cans and then multiplying the weight of the cans by a stored compensation rate to get the actual compensation due the depositor, said control system responsive to the weight of said empty bucket for ending said time out state and restoring normal system operations by reactivating said crusher.

79. The improved collection apparatus of claim 78 wherein said bucket door includes a lightweight durable plastic material such as polypropylene for reducing transient oscillations due to opening and closing the bucket door and for achieving a long-lasting extended life door.

80. The improved collector apparatus of claim 78 wherein said weight bucket includes a flange operatively disposed above the input opening thereto;

fastening means operatively connected to three separate portions of said flange for evenly distributing the weight of said bucket and the contents thereof;

a weight distribution platform having three fastening means operatively disposed thereon for equally sharing the weight distribution of said bucket and the contents thereof;

strap means operatively connecting each of the fastening means of said flange to a corresponding fastening means of said weight distribution platform for equally balancing and supporting the weight of said bucket;

load cell means for generating electrical signals indicative of the weight of said bucket and the contents thereof; and a universal joint operatively coupling said load cell and said weight distribution platform for improving the weighing accuracy of the system.

81. The improved collection apparatus of claim 78 further including means for auto-calibrating said weigher, said auto-calibrating means including an analog to digital converter;

an instrument amplifier for receiving signals from the load cell and amplifying the load cell signal;

means for summing the amplifier output;

means for providing the summed output to the input of an analog-to-digital converter;

means for coupling the output of the analog-to-digital converter to the microprocessor-based control system;

a latching digital-to-analog converter;

means for amplifying the output of the digital-to-analog converter to provide an inverted signal and means for summing the inverted signal with the output of the instrument amplifier to produce a signal within the range of the analog-to-digital converter to provide a resulting voltage;

establishing a reference setting for the analog-to-digital converter and the digital-to-analog converter using a diode array; and means for adjusting the voltage so that it lies within the full input voltage range of both the analog-to-digital converter and the digital-to-analog converter, thereby automatically calibrating the weighing system.

82. The improved apparatus of claim 81 further including means for initializing the load cell for accurate weighing over a wide range of variables including a resistor having a voltage displacement value exactly equivalent to the strain on the load cell of a fixed number of pounds, means for switching said sample resistor in and measuring the resultant voltage;

utilizing the measured voltage to establish a weight of said fixed number of pounds under the presence of variable conditions, so that even if the variables change, the accuracy of measurement will still be within acceptable accuracy tolerances.

83. The improved collection apparatus of claim 78 wherein said weigher and said control means include means for detecting an open bucket door and generating the signal indicative thereof.

84. The improved collection apparatus of claim 67 including the non-volatile memory means for storing the present rate of compensation to prevent tampering and the like.

85. The improved collection apparatus of claim 84 further including means for detecting an impending power failure and generating a signal indicative thereof;

said microprocessor-based control system being responsive to said signal indicative of an impending power failure for transmitting a store imformation command; and said non-volatile memory being responsive to said store information command for storing all current working information therein until power is restored.

86. The improved collection apparatus of claim 67 wherein said apparatus further includes display means operably disposed adjacent said input means for displaying information to the depositor, said display means for displaying weight in predetermined increments on a continuous basis so long as crushed aluminum cans continue to be fed into said weighing bucket;

for displaying compensation increments in the highest value of coins available in the coin dispenser each time a weight equivalent of the highest coin value is placed into the weighing bucket;

for displaying final values when the transaction is complete, including the exact weight of aluminum cans deposited to the nearest tenth and one-hundredth of a pound and the total value of compensation to be paid therefor to the nearest penny.

87. The improved collection apparatus of claim 86 wherein said coin dispenser includes means for dispensing at least quarters, nickels, and pennies, means responsive to each unit of weight deposited into the weighing bucket corresponding to the largest value of coin in said coin dispenser for dispensing one of said coins and for continuing to dispense said largest value of coin in the dispenser each time that weight of aluminum cans corresponding thereto is added to the weight bucket and finally dispensing smaller value coins when the transaction is complete and the weight is final to compensate the depositor for the value of aluminum cans deposited to the nearest penny.

88. The improved collector apparatus of claim 67 further including means for separating said storage bin from the remainder of said system;

means for generating the stream of air; and means responsive to said stream of air for blowing substantially all crushed aluminum cans stored in said storage bin out of said storage bin and into means for receiving said crushed aluminum cans for carrying same to a recycling center or the like.

89. The improved collector apparatus of claim 88 wherein said means for generating a stream of air includes a centrifugal fan and a fan motor for powering said fan and wherein said means responsive to said stream of air includes an enclosed housing operably disposed in the bottom of said storage bin;

aperture means formed in the top of said housing;

metering means having a metering motor for rotating a shaft and paddle means operatively coupled to said rotating shaft such that the space between adjacent paddles collects a predetermined amount of crushed aluminum cans and carries this metered amount into the housing with each partial revolution of said shaft;

means for operatively coupling the output of said centrifugal fan to an input of said housing; and conduit means operatively coupled to the output of said housing, up to the ceiling of said apparatus and adjacent an aperture through a wall of said apparatus for transporting the air-driven crushed aluminum cans from said storage bin through said conduit means and out said opening for emptying said storage bins quickly and without human intervention.

90. Improved collector apparatus of claim 89 wherein said storage bin includes flow-directing chutes extending from a predetermined distance proximate the ceiling of the apparatus to the aperture in said housing to that substantially all cans dropped into said storage bin are funnelled into said metering means and wherein the rate of air flow is such that approximately 5,000 pounds of cans an hour can be pneumatically pumped out of said storage bin and into a transport means for taking the cans to a recycling center or the like.

91. The improved collection apparatus of claim 90 wherein the rate at which crushed aluminum cans which are pumped out of said storage bin may be selectively varied by increasing and decreasing the rotation of said metering means.

92. In a collection apparatus for collecting aluminum cans from an assortment of material and for compensating a depositor for such aluminum cans as a function of the weight of the aluminum cans deposited in the storage compartment of the apparatus, said apparatus having an input means for receiving said assorted material placed therein by a depositor, a start button for initiating operation of the system, a first conveyor for transporting assorted material from the input means to a classifier, said classifier detecting and segregating ferrous metal such as tin-plated steel cans from the non-ferrous materials and for depositing the ferrous metal in a ferrous metal receptacle and for depositing the non-ferrous material into a classifier conveyor, said classifier also including means for detecting heavys, metal detector means for detecting non-ferrous metals, such as aluminum cans, and means for separating non-ferrous metals from non-metals, said classifier conveyor transporting non-ferrous metals comprising aluminum cans to a crusher input hopper for loading said aluminum cans into a crusher and for dumping non-metals and heavys into a second receptacle, said crusher compacting aluminum cans and loading the crushed aliminum cans into a weigher bucket of a weigher means for measuring the weight of the crushed aluminum cans in said bucket, a storage bin, a storage bin conveyor means for transporting the crushed aluminum cans after being weighed and dumping same into the storage bin, and a microprocessor-based control system for initiating the system, for energizing the various motors of the system, for monitoring system operations, for controlling system initiation and calibration, for processing alarm signals, for performing weighing calculations, for performing compensation calculations, and for operating the coin dispenser means for paying the calculated compensation to the depositor, the improvement comprising:

said first conveyor, said classifer conveyer, and said storage bin conveyor operating continuously from the initiation of the cycle until the transaction is complete for improving the throughput of the system;

said metal detection means for detecting non-ferrous metal includes means for generating an aluminum can detection signal each time an item of non-ferrous metal is detected;

said control system being responsive to said aluminum can detection signal for generating a transaction complete signal whenever no aluminum can detection signal has been generated for a predetermined period of time;

weighing means including means for detecting when the contents of said weight bucket have reached a predetermined weight for generating a time to weigh signal;

said microprocessor-based control system including means of responding to at least one of said transaction complete and said time to weigh signal for initiating a time out state;

said weighing means including a load cell for continually generating an electrical signal indicative of the weight of said weight bucket plus the contents thereof, said load cell being responsive to said time out signal for weighing the bucket plus contents after a predetermined time delay, said microprocessor-based control system being responsive to the completion of weighing said bucket less the contents thereof for generating a dump signal, said bucket including the dump door and means responsive to said dump signal for operatively opening said door to drop the contents thereof to said storage bin conveyor and means for closing the door after all cans have been dumped from the bucket, said load cell means weighing said empty bucket a predetermined time delay after said door closes and said microprocessor-based control system subtracting the weight of the bucket from the weight of the bucket plus contents to get the weight of the crushed aluminum cans contained therein and for multiplying the weight of the crushed aluminum cans by the present compensation rate stored in a non-volatile memory to prevent tampering for obtaining the amount to be paid the depositor, said microprocessor-based control system ending said time out state and reactivating the crusher when the weighing operation is complete for returning the system to normal operation.

93. The improved collection apparatus of claim 92 wherein said bucket door includes a lightweight durable plastic material such as polypropylene for damping out and terminating transient oscillations produced from opening and closing said door while simultaneously extending the life of said door.

94. The improved collection apparatus of claim 92 wherein said weight bucket includes a flange operatively disposed above the entrance thereto;

said weighing means including a connection platform;

strap means for operatively connecting portions of the flange of said bucket to corresponding portions of said connection means for evenly distributing the weight of the bucket thereover;

a load cell means for continuously generating an electrical signal indicative of the weight of the bucket plus contents; and a universal joint means operatively coupling said load cell and said connecting means for more accurately weighing the contents of said bucket.

95. The collection apparatus of claim 92 wherein said apparatus further includes means for auto-calibrating said weighing means at the start of each cycle and for initializing the load cell by recalculating the representative voltage with a standard voltage at the beginning of each cycle.

96. In a collection apparatus for collecting aluminum cans from an assortment of material and for compensating a depositor for such aluminum cans as a function of the weight of the aluminum cans deposited in the storage compartment of the apparatus, said apparatus having an input means for receiving said assorted material placed therein by a depositor, a start button for initiating operation of the system, a first conveyor for transporting assorted material from the input means to a classifier, said classifier detecting and segragating ferrous metal such as tin-plated steel cans from the non-ferrous materials and for depositing the ferrous metal in a ferrous metal receptacle and for depositing the non-ferrous material into a classifier conveyor, said classifier also including means for detecting heavys, metal detector means for detecting non-ferrous metals, such as aluminum cans, and means for separating non-ferrous metals comprising aluminum cans to a crusher input hopper for loading said aluminum cans into a crusher and for dumping non-metals and heavys into a second receptabcle, said crusher compacting aluminum cans and loading the crushed aluminum cans into a weigher bucket of a weigher for measuring the weight bucket of a weigher means for measuring the weight of the crushed aluminum cans in said bucket, a storage bin, a storage bin conveyor means for transporting the crushed aluminum cans after being weighed and dumping same into the storage bin, and a microprocessor-based control system for initiating the system, for energizing the various motors of the system, for monitoring system operations, for controlling system initiation and calibration, for processing alarm signals, for performing weighing calculations, for performing compensation calculations, and for operating the coin dispenser means for paying the calculated compensation to the depositor, the imrovement comprising:

said first conveyor, said classifier conveyor, and said storage bin conveyor operating continuously fron the initiation of the cycle until the transaction is complete for improving the throughput of the system;

said metal detection means for detecting non-ferrous metal includes means for generating an aluminum can detection signal each time an item of non-ferrous metal is detected;

said control system being responsive to said aluminum can detection signal for generating an aluminum can detection signal each time an item of non-ferrous metal is detected;

weighing means including means for detecting when the contents of said weight bucket have reached a predetermined weight for generating a time to weigh signal;

said microprocessor-based control system including means of responding to at least one of said transaction complete and said time to weigh signal for initiating a time out state;

said weighing means including a load cell for continually generating an electrical signal indicative of the weight of said weight bucket plus the contents thereof, said load cell being responsive to said time out signal for weighing the bucket plus contents after a predetermined time delay, said microprocessor-based control system being responsive to the completion of weighing said bucket less the contents thereof for generating a dump signal, said bucket including the dump door and means responsive to said dump signal for operatively opening said door to drop the contents thereof to said storage bin conveyor and means for closing the door after all cans have been dumped from the bucket, said load cell means weighing said empty bucket a predetermined time delay after said door closes and said microprocessor-based control system substracting the weight of the bucket from the weight of the crushed aluminum cans contained therein and for multiplying the weight of the crushed aluminum cans by the present compensation rate stored in a non-volatile memory to prevent tampering for obtaining the amount to be paid the depositor, said microprocessor-based control system ending said time out state and reactivating the crusher when the weighing operation is complete for returning the system to normal operation:

wherein said apparatus includes a display operatively disposed proximate and input means for viewing by the depositor;

said apparatus for compensating a depositor including a coin dispenser for dispensing several differend denominations of coins for the like;

said display being operatively controlled by said microprocessor-based control system for continually displaying a weight reading and updating same each time a fixed increment of weight is added to the hopper, means for displaying and periodically updating the value of compensation to be paid to the depositor in multiples of the highest denomination coin in said dispenser, said microprocessor-based control system being responsive to the termination of said time out state for indicating on said display means the exact weight of aluminum cans received from the depositor to the nearest one one-hundredth of a pound and the total value of compensation to be paid therefor to the nearest penny.

97. The improved collection apparatus of claim 96 wherein said display means includes a separate means for brightly illuminating an "out of money" condition and a seven segment LED display means for displaying an out of order message and for displaying other types of alarm conditions, so that the displayed message or alarm condition is clearly visible even in bright sunlight; and said coin dispenser being responsive to said microprocessor-based control system for dispensing one of the highest denomination coins each time the weight equivalent thereof is dropped into said bucket, so that the depositor is being compensated on a continuous bases as the crushed aluminum cans are placed into the bucket, and for paying any remaining compensation due at the end of the time out period in smaller denomination coins so as to make payment to the nearest penny possible.

98. The improved collection apparatus of claim 97 further including coupon dispenser means and a slot in said apparatus, said coupon dispenser means being responsible to at least one of start of transaction, end of transaction and predetermined weight and coin amounts for dispensing at least one manufacturer's coupon, store coupon, and the like through said slot for said despositor and without charge thereto.

99. In a collection apparatus for collecting aluminum cans from an assortment of material and for compensating a depositor for such aluminum cans as a function of the weight of the aluminum cans deposited in the storage compartment of the apparatus, said apparatus having an input means for receiving said assorted material placed therein by a depositor, a start button for initiating operation of the system, a first conveyor for transporting assorted material from the input means to a classified, said classified detecting and segregating ferrous metal such as tin-plated steel cans from the non-ferrous materials and for depositing the ferrous metal in a ferrous metal receptacle and for depositing the non-ferrous material into a classified conveyor, said classifier also including means for detecting heavys, metal detector means for detecting non-ferrous metals, such as aluminum cans, and means for separating non-ferrous metals, said classifier conveyor transporting non-ferrous metals comprising aluminum cans to a crusher input hopper for leading said aluminum cans to a crusher and for dumping non-metals and heavys into a second receptacle, said crusher compacting aluminum cans and loading the crushed aluminum cans into a weigher bucket of a weigher means for measuring the weight of the crushed aluminum cans in said bucket, a storage bin, a storage bin conveyor means for transporting the crushed aluminum cans after being weighed and dumping same into the storage bin, and a microprocessor-based control system for intitiating the system, for energizing the various motors of the system, for monitoring system operations, for controlling system initiation and calibration for processing alarm signals, for performing weighing calculations, for performing compensation calculations, and for operating the coin dispenser means for paying the calculated compensation to the depositor, the improvement comprising:

said first conveyor, said classifier conveyor, and said storage bin conveyor operating continuously from the initiation of the cycle until the transaction is complete for improving the throughput of the system;

said metal detection means for detecting non-ferrous metal includes means for generating an aluminum can detection signal each time an item of non-ferrous metal is detected;

said control system being responsive to said aluminum can detection signal for generating a termination complete signal whenever no aluminum can detection signal has been generated for a predetermined period of time;

weighing means including means for detecting when the contents of said weight bucket have reached a predetermined weight for generating a time to weigh signal;

said microprocessor-based control system including means of responding to at least one of said transaction complete and said time to weigh signal for initiating a time out state;

said weighing means including a load cell for continually generating an electrical signal indicative of the weight of said weight bucket plus the contents thereof, said load cell being responsive to said time out signal for weighing the bucket plus contents after a predetermined time delay, said microprocessor-based control system being responsive to the completion of weighing said bucket less the contents thereof for generating a dump signal, said bucket signal for operatively opening said door to drop the contents thereof to said storage bin conveyor and means for closing the door after all cans have been dumped from the bucket, said load cell means weighing said empty bucket a predetermined time delay after said door closes and said microprocessor-based control system subtracting the weight of the bucket from the weight of the bucket plus contents to get the weight of the crushed aluminum cans contained therein and for multiplying the weight of the crushed aluminum cans by the present compensation rate stored in a non-volatile memory to prevent tampering for obtaining the amount to be paid the depositor, said microprocessor-based control system ending said time out state and reactivating the crusher when the weighing operation is complete for returning the system to normal operation; and further including means for detecting an open bucket door and generating an alarm signal indicative thereof.

100. In a collection apparatus for collecting aluminum cans from an assortment of material and for compensating a depositor for such aluminum cans as a function of the weight of the aluminum cans deposited in the storage compartment of the apparatus, said apparatus having an input means for receiving said assorted material placed therein by a depositor, a start button for initiating operation of the system, a first conveyor for transporting assorted material from the input means to a classifier, said classifier detecting and segregating ferrous metal such as tin-plated steel cans from the non-ferrous materials and for depositing the ferrous metal in a ferrous metal receptacle and for depositing the non-ferrous material into a classifier conveyor, said classifier also including means for detecting heavys, metal detector means for detecting non-ferrous metals, such as aluminum cans, and means for separating non-ferrous metals from non-metals, said classifier conveyor transporting non-ferrous metals comprising aluminum cans to a crusher input hopper for loading said aluminum cans into a crusher and for dumping non-metals and heavys into a second receptacle, said crusher compacting aluminum cans and loading the crushed aluminum cans into a weigher bucket of a weigher means for measuring the weight of the crushed aluminum cans in said bucket, a storage bin, a storage bin conveyor means for transporting the crushed aluminum cans after being weighed and dumping same into the storage bin, and a microprocessor-based control system for initiating the system, for energizing the various motors of the system, for monitoring system operations, for controlling system initiation and calibration, for processing alarm signals, for performing weighing calculations, for performing compensation calculations, and for operating the coin dispenser means for paying the calculated compensation to the depositor, the improvement comprising:

means for operatively segregating said storage bin from said input conveyor, classifier conveyor, crusher, weigher, and storage bin conveyor;

A centrifugal fan for generating a high speed stream of air;

a hollow housing means operatively disposed proximate the floor of said storage bin;

an opening in the top of said housing means;

metering means including a paddle wheel operably disposed in said opening for collecting a predetermined quantity of crushed aluminum cans between adjacent paddles and dropping said cans sequentially into said housing as the paddle wheel is rotated;

said metering means including means for controlling the speed of rotation of said paddle wheel and thus the rate at which said quantities of cans are dumped into said hollow housing means;

means for operatively coupling the output of said centrifugal fan into an input of said housing means; and conduit means operatively coupling an output of said housing to an output port in said apparatus for blowing said cans out of said storage bin and into a vehicle means for carrying the cans to a recycling center or the like.

101. The improved collection apparatus of claim 100 wherein said conduit means has a generally rectangular cross-section.

102. The improved collection apparatus of claim 100 wherein said storage bin further includes flow-directing means operably disposed up the walls of said bin for receiving the crushed aluminum cans dumped therein by storage bin conveyors and directing substantially all of said cans into said metering paddle wheel to be pneumatically pumped out of the storage bin through said output conduit means at a rate of approximately 5,000 pounds of crushed aluminum cans per hour without human intervention or the like.

103. The improved collection apparatus of claim 102 wherein said storage bin further includes means for detecting when said storage bin of crushed aluminum cans is substantially full and for generating a signal indicative thereof and means for detecting when said bin is substantially empty and generating a signal indicative thereof.

104. The improved collection apparatus of claim 103 wherein said apparatus further includes communication means for signaling a remote location when at least one of the following conditions occurs: (a) the storage bin is full, (b) the ferrous metal receptacle is full, (c) the second receptacle is full, (d) an alarm condition exists which cannot be cleared, (e) the coin dispenser is out of coins, (f) some other type of alarm condition exists, and said microprocessor-based control system being responsive to one or more of said conditions for operating said communication device and signalling the remote station thereof.

105. The improved collection apparatus of claim 104 wherein said communications device includes a telephone line, an automatic dialer, means responsive to the control system for operating the automatic dialer to reach the control station, and means responsive to said control system for selecting a predetermined recorded message indicative of the particular problem at hand and transmitting same over said telephone line back to said remote station.

106. In a collection apparatus for collecting aluminum cans from an assortment of material and for compensating a depositor for such aluminum cans as a function of the weight of the aluminum cans deposited in the storage compartment of the apparatus, said apparatus having an input means for receiving said assorted material placed therein by a depositor, a start button for initiating operation of the system, a first conveyor for transporting assorted material from the input means to a classifier, said classifier detecting and segregating ferrous metal such as tin-plated steel cans from the non-ferrous materials and for depositing the ferrous metal in a ferrous metal receptacle and for depositing the non-ferrous material into a classifier conveyor, said classifier also including means for detecting heavys, metal detector means for detecting non-ferrous metals, such as aluminum cans, and means for separating non-ferrous metals from non-metals, said classifier conveyor transporting non-ferrous metals comprising aluminum cans to a crusher input hopper for loading said aluminum cans into a crusher and for dumping non-metals and heavys into a second receptacle, said crusher compacting aluminum cans and loading the crushed aluminum cans into a weigher bucket of a weigher means for measuring the weight of the crushed aluminum cans in said bucket, a storage bin, a storage bin conveyor means for transporting the crushed aluminum cans after being weighed and dumping same into the storage bin, and a microprocessor-based control system for initiating the system, for energizing the various motors of the system, for monitoring system operations, for controlling system initiation and calibration, for processing alarm signals, for performing weighing calculations, for performing compensation calculations, and for operating the coin dispenser means for paying the calculated compensation to the depositor, the improvement comprising:

said metal detector means for detecting non-ferrous metals including a digital self-adjusting metal detector for detecting the presence of aluminum cans and for generating an aluminum can detection signal each time an aluminum can is transported thereby by said classifier conveyor;

normally-opened trapdoor means for dumping non-metals and heavys into said second receptable;

said means for separating non-ferrous metals from non-metals including solenoid means operatively coupled to said trapdoor means for normally holding said trapdoor open to drop heavys and non-metals, including plastics, papers, glass, and the like, into said second receptacle and said solenoid means being responsive to the detection of an aluminum can for closing said trapdoor means for allowing said aluminum can to be transported to said classifier conveyor into the input hopper of the crusher.

107. The improved collection apparatus of claim 106 wherein said digital metal detector means and said microprocessor-based control system detect whenever an aluminum can has entered said classifier and has not reached said weight bucket.

108. The improved collector apparatus of claim 106 wherein said means for detecting heavys includes a impact plate operatively disposed at the input of said classifier;

a cantilever beam including an elongated end portion and an opposite end, said cantilever beam being pivotally coupled to said impact plate proximate the center thereof;

counterweight means operatively disposed on the elongated end of said cantilever beam for selectively establishing a threshold weight for determining whether or not a falling object is a heavy; and a microswitch operably disposed proximate the opposite end of said cantilever beam such that whenever a heavy falls onto said impact plate and displaces said impact plate and the opposite end of said cantilever beam a predetermined distance to activate said microswitch, said microswitch outputs a heavy detect signal.

109. The improved collection apparatus of claim 108 further including means responsive to said heavy detect signal for overriding said solenoid means and maintaining said trapdoor open to drop said heavy into said second receptacle, even if said heavy includes some metal.

110. The improved collection apparatus of claim 106 wherein said input conveyor, said classification conveyor and said storage bin conveyor are all operated continuously from initiation of the system until completion of transaction or increasing the throughput of said apparatus;

said metal detector means and said control system generating a transaction complete signal if no aluminum cans are detected for a predetermined period of time, indicating that the depositor is done placing cans into the input means;

means for detecting when the weight bucket contains a predetermined amount of aluminum cans and for generating a begin weighing signal in response thereto;

said control system being responsive to at least one of said transaction complete and said begin weighing signals for establishing a time out state;

said control system being responsive to said time out state for (a) turning off said crusher and storing incoming aluminum cans in the crusher input hopper;

(b) measuring weight of the bucket plus the weight of aluminum cans contained therein after a predetermined time delay;

(c) dumping the contents of said bucket after weighing is complete;

(d) measuring the weight of the empty bucket after a second predetermined time delay;

(e) calculating the weight of aluminum cans which were in the bucket and for which compensation must be paid;

(f) calculating the compensation to be paid to the depositor based on the calculated weight of aluminum cans deposited thereby; and (g) ending the time out state, re-energizing the crusher, and renewing system operation.

111. The improved collection apparatus of claim 110 wherein said crusher input hopper includes means for detecting when the hopper is full and generating a signal indicative thereof, said control system being responsive to said signal indicative of a full crusher hopper for terminating the operation of said conveyors until the weighing operation is complete.

112. In a method of controlling a collection apparatus for collecting aluminum cans from an assortment of material and for compensating a depositor for such aluminum cans as a function of the weight of the aluminum cans deposited in the storage compartment of the apparatus, said apparatus having an input means for receiving said assorted material placed therein by a depositor, a start button for initiating operation of the system, a first conveyor for transporting assorted material from the input means to a classifier, said classifier detecting and segregating ferrous metal such as tin-plated steel cans from the non-ferrous materials and for depositing the ferrous metal in a ferrous metal receptacle and for depositing the non-ferrous material into a classifier conveyor, said classifier also including means for detecting heavys, metal detector means for detecting non-ferrous metals, such as aluminum cans, and means for separating non-ferrous metals from non-metals, said classifier conveyor transporting non-ferrous metals comprising aluminum cans to a crusher input hopper for loading said aluminum cans into a crusher and for dumping non-metals and heavys into a second receptacle, said crusher compacting aluminum cans and loading the crushed aluminum cans into a weigher bucket of a weigher means for measuring the weight of the crushed aluminum cans in said bucket, a storage bin, a storage bin conveyor means for transporting the crushed aluminum cans after being weighed and dumping same into the storage bin, and a microprocessor-based control system for initiating the system, for energizing the various motors of the system, for monitoring system operations, for controlling system initiation and calibration, for processing alarm signals, for performing weighing calculations, for performing compensation calculations, for operating the coin dispenser means for paying the calculated compensation to the depositor, and for displaying both the weight and compensation plus various alarm conditions to the depositor, the improved method comprising:

sensing when the start button is pushed;

energizing the first conveyor, the classifier conveyor, the crusher, and the storage bin conveyor;

continuously operating said first conveyor, classifier conveyor, and storage bin conveyor until the depositor is done placing cans in the input means indicating that the transaction is completed;

detecting the presence of a heavy dropping from the first conveyor into the classifier;

maintaining a trapdoor open for dropping non-metal objects and heavys into the second receptacle;

closing the trapdoor to allow detected aluminum cans to pass through the classifier conveyor into the input hopper of the crusher;

detecting when the input hopper of the crusher is full;

determining the weight of material dumped into the bucket of the weigher on a continuous basis;

dispensing compensation in the largest coin denomination present each time a weight corresponding to said largest value denomination is weighed;

turning off the crusher whenever the depositor is through placing cans into the input means or the weight in the bucket has reached a value at which time weighing is commanded;

temporarily storing the incoming aluminum cans in the crusher input;

measuring the weight of the bucket plus the aluminum cans contained therein after a predetermined time delay;

generating a dump signal after said weighing is complete;

opening the bucket dump door in response to the dump signal for emptying the bucket into the storage bin conveyor;

closing the bucket door;

measuring the weight of the empty bucket after a predetermined delay time;

calculating the weight of the bucket plus the aluminum cans contained therein less the weight of the bucket to get the weight of aluminum cans deposited;

reading the current value of compensation stored in the non-volatile memory;

multiplying the weight of the aluminum cans deposited times the current compensation rate to get the total compensation due the depositor;

dispensing appropriate valued coins to compensate the depositor to the nearest penny;

displaying the continuous weight in predetermined increments, the ongoing compensation in increments of the largest value of coin in the dispenser, and the total weight at the end of the transaction to the nearest one-hundredth of a pound and the total compensation to the nearest penny;

restoring the operation of the crusher once the weighing cycle is complete.

113. The improved method of claim 112 further including the steps of stopping the conveyor whenever the input hopper of the crusher is full.

114. In a scrap metal collection apparatus, an electronic controller comprising:

means for automatically calibrating the weighing means and initializing a load cell to insure the accuracy of the system;

means for generating a transaction complete signal whenever no aluminum cans have been fed to the input by the depositor for a predetermined period of time;

means for detecting when a weight bucket has attained the predetermined weight at which weighing is advisable;

means responsive to the transaction complete signal and to the attainment of said predetermined weight for generating a time out state;

means for turning off the crusher to prevent additional crushed aluminum cans from being fed into the weigher hopper during said time out state;

means for weighing and recording, a predetermined time delay after declaration of the time out state, the weight of the scrap metal weighing container and its contents prior to immediately dumping the container;

means for subsequently weighing the empty container after a predetermined time delay after dumping;

means for subtracting the weight of the scrap metal weighing container its contents less the weight of the empty container to obtain the weight of the scrap metal contained therein; and means for operating said scrap metal collection conveyors on a continuous basis so long as the depositor supplies aluminum cans thereto for improving the throughput of the collection apparatus;

means for multiplying the weight of the scrap metal contained therein times the current compensation rate to obtain the total compensation due the depositor;

means for automatically calibrating the weighing means prior to the next cycle; and means for ending the time out state, re-energizing the crusher, and restoring normal system operations.

115. The electronic controller of claim 114 further including means for storing a plurality of coins each having a different value;

means for dispensing a coin of the highest value each time a weight equivalent thereof is deposited into the weighing means;

means responsive to the time out state for completing the compensation in lesser value coins to the nearest penny.

116. In a scrap metal collection apparatus, an electronic controller comprising:

means for automatically calibrating the weighing means and initializing a load cell to insure the accuracy of the system;

means for generating a transaction complete signal whenever no aluminum cans have been fed to the input by the depositor for a predetermined period of time;

means for detecting when a weight bucket has attained the predetermined weight at which weighing is advisable;

means responsive to the transaction complete signal and to the attainment of said predetermined weight for generating a time out stage;

means for turning off the crusher to prevent additional crushed aluminum cans from being fed into the weigher hopper during said time out state;

means for weighing and recording, a predetermined time delay after declaration of the time out state, the weight of the scrap metal weighing container and its contents prior to immediately dumping the container;

means for subsequently weighing the empty container after a predetermined time delay after dumping;

means for subtracting the weight of the scrap metal weighing container and its contents less the weight of the empty container to obtain the weight of the scrap metal contained therein;

means for multiplying the weight of the scrap metal contained therein times the current compensation rate to obtain the total compensation due the depositor;

means for automatically calibrating the weighing means prior to the next cycle;

means for ending the time out state, re-energizing the crusher, and restoring the normal system operations;

means for initially energizing the scrap metal collection conveyors and operating said conveyors on a continuous basis so as long as the depositor supplies aluminum cans thereto for improving the throughput of the collection apparatus;

said crusher having an input hopper and said system further including means for detecting when the crusher input hopper is full and generating the signal indicative thereof; and means responsible to said signal indicative of a full crusher input hopper for shutting of the conveyors until the time out stage is complete and crusher operation resumed.

* * * * *